US006752700B2

(12) United States Patent
Duescher

(10) Patent No.: US 6,752,700 B2
(45) Date of Patent: Jun. 22, 2004

(54) RAISED ISLAND ABRASIVE AND PROCESS OF MANUFACTURE

(76) Inventor: Wayne O. Duescher, 951 County Rd. C2 West, Roseville, MN (US) 55113

( * ) Notice: Subject to any disclaimer, the term of this patent is extended or adjusted under 35 U.S.C. 154(b) by 261 days.

(21) Appl. No.: 10/015,478

(22) Filed: Dec. 13, 2001

(65) Prior Publication Data

US 2002/0061723 A1 May 23, 2002

Related U.S. Application Data

(63) Continuation-in-part of application No. 09/715,448, filed on Nov. 17, 2000.

(51) Int. Cl.[7] ..... B24D 3/00; B24D 11/00
(52) U.S. Cl. ..... 451/59; 451/527
(58) Field of Search ..... 451/41, 59, 259, 451/526, 527, 529, 550

(56) References Cited

U.S. PATENT DOCUMENTS

| | | | | |
|---|---|---|---|---|
| 794,495 | A | | 7/1905 | Gorton et al. |
| 1,657,784 | A | | 1/1928 | Bergstom |
| 2,838,890 | A | | 6/1958 | McIntyre |
| 2,907,146 | A | | 10/1959 | Dyar |
| 3,246,430 | A | | 4/1966 | Hurst |
| 3,916,584 | A | | 11/1975 | Howard et al. |
| 4,256,467 | A | | 3/1981 | Gorsuch |
| 4,311,489 | A | | 1/1982 | Kressner |
| 4,930,266 | A | | 6/1990 | Calhoun et al. |
| 5,020,283 | A | * | 6/1991 | Tuttle ..... 451/550 |
| 5,107,626 | A | | 4/1992 | Mucci |
| 5,152,917 | A | | 10/1992 | Pieper et al. |
| 5,190,568 | A | | 3/1993 | Tselesin |
| 5,219,462 | A | | 6/1993 | Bruxvoort et al. |
| 5,232,470 | A | | 8/1993 | Wiand |
| 5,297,364 | A | * | 3/1994 | Tuttle ..... 451/527 |
| 5,318,604 | A | | 6/1994 | Gorsuch et al. |
| 5,437,754 | A | | 8/1995 | Calhoun |
| 5,496,386 | A | | 3/1996 | Broberg et al. |
| 5,549,961 | A | | 8/1996 | Haas et al. |
| 5,611,825 | A | | 3/1997 | Engen et al. |
| 5,820,450 | A | | 10/1998 | Calhoun |
| 5,888,121 | A | * | 3/1999 | Kirchner et al. ..... 451/41 |
| 5,910,471 | A | | 6/1999 | Christianson et al. |
| 6,080,215 | A | | 6/2000 | Stubbs et al. |
| 6,168,508 | B1 | * | 1/2001 | Nagahara et al. ..... 451/527 |
| 6,186,866 | B1 | | 2/2001 | Gagliardi |
| 6,217,413 | B1 | | 4/2001 | Christianson |
| 6,228,133 | B1 | | 5/2001 | Thurber et al. |
| 6,231,629 | B1 | | 5/2001 | Christianson et al. |
| 6,277,160 | B1 | | 8/2001 | Stubbs et al. |
| 6,537,140 | B1 | * | 3/2003 | Miller et al. ..... 451/259 |
| 6,540,597 | B1 | * | 4/2003 | Ohmori ..... 451/443 |

* cited by examiner

*Primary Examiner*—Joseph J. Hail, III
*Assistant Examiner*—David B. Thomas
(74) *Attorney, Agent, or Firm*—Mark A. Litman & Associates, P.A.

(57) ABSTRACT

Abrasive sheet materials, abrasive sheet materials with island distributions of abrasive particles, processes for manufacture of abrasive sheet materials with minimized abrasive content, processes for attaching abrasive particles exclusively on the top surface of raised islands in monolayers, and processes for attaching raised island foundation structures to inexpensive flexible backing sheets are described. The process for manufacturing the abrasive sheeting provides an economical method for providing improved quality abrasive sheeting, while also allowing for greater control over the shape and distribution of abrasive islands on the sheet than is available from present processes of manufacture.

39 Claims, 36 Drawing Sheets

FIG. 6 A
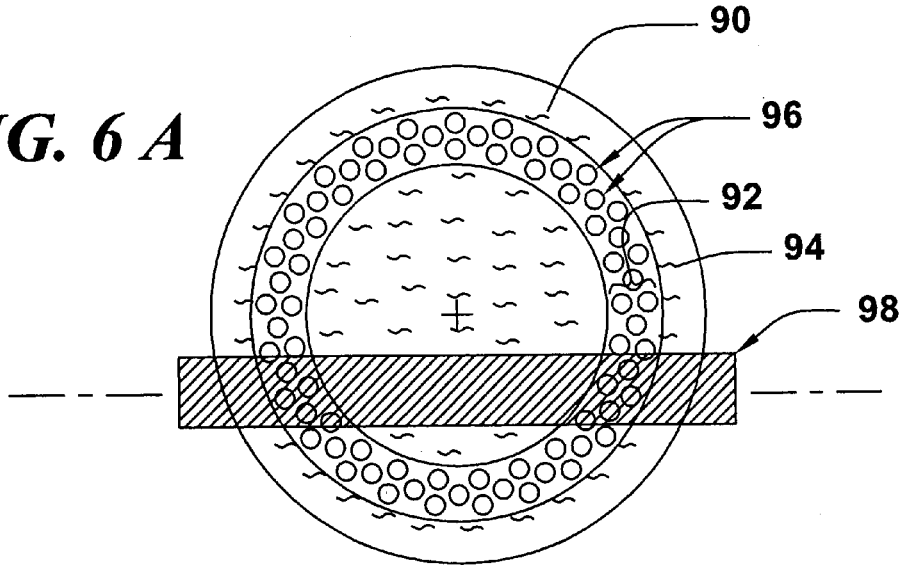
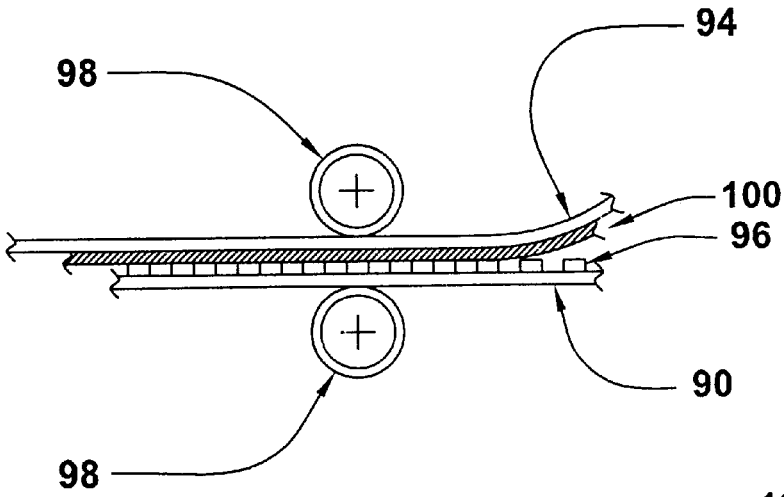
FIG. 6 B
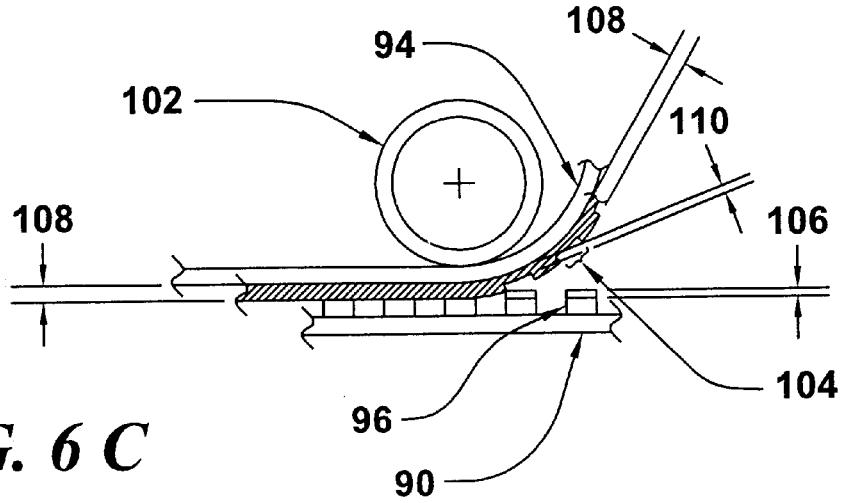
FIG. 6 C

RAISED ISLAND ABRASIVE AND PROCESS OF MANUFACTURE

CROSS REFERENCE TO RELATED APPLICATION

This invention is a continuation-in-part of U.S. patent application Ser. No. 09/715,448, filed Nov. 17, 2000 which is incorporated herein by reference.

BACKGROUND OF THE ART

1. Field of the Invention

The present invention relates to abrasive media and processes for manufacturing the abrasive media. The media are thin flexible abrasive sheeting used for lapping, polishing, it finishing or smoothing of workpiece surfaces. In particular, the present invention relates to such media used as removable or replaceable abrasive sheeting that are able to operate at high surface speeds, particularly media having an annular distribution of abrasive particles bonded in monolayers to the top surfaces of raised island shapes which are repeated in patterned arrays. Forming raised islands integrally attached to inexpensive backing sheets, precisely leveling the height of each island, resin coating the islands and applying abrasive particles to the resin economically creates an abrasive article which will grind a workpiece precisely flat and also generate a smooth workpiece surface. Coolant water freely passing through flow channels formed by the valley passageways between the raised islands flushes out grinding swarf and also minimizes hydroplaning of the workpiece.

2. Background of the Invention

High speed lapping and grinding using fixed abrasive on sheet disks for both rough grinding and smooth polishing is now a practical reality. Most performance issues relate to four primary concerns, 1) hydroplaning caused by water lubricant and 2) a free exit path for grinding debris swarf away from the contact area between the abrasive and the lapped article, 3) the utilization of all the abrasive particles attached to a sheet and 4) variations during abrading use created by thickness variations of abrasive disks along their tangential surfaces. Unique answers for all four problems of hydroplaning, debris path, use of particles and thickness variations have been defined and numerous solutions have been created.

This invention references commonly assigned U.S. Pat. Nos. 5,910,041; 5,967,882; 5,993,298; 6,048,254; 6,102,777; 6,120,352 and 6,149,506 and all contents of which are incorporated herein by reference.

The most serious problem remaining in the commercial use of high speed lapping and polishing processes is the availability of high quality abrasive article sheets that have certain important characteristics. The present invention describes sheets that can rapidly advance the use of high speed lapping by providing abrasive sheets that meet the needs of the technology. The sheets should be of a sufficient dimension (e.g., at least a 6 inch (15.3 cm) diameter, at least a 12 inch (30.5 cm) diameter, or at least an 18 inch (45.7 cm) or larger diameter, and have islands comprising abrasive particles (preferably secured to a substrate and preferably arranged in an annular band). The islands have an uppermost abrasive surface that is extremely flat and of uniform thickness. Conventional flat surface grinding or lapping platens are set up to use the full surface area of a circular shaped flat flexible sheet of abrasive. However, the abrasive contact surface speed of the rotating disk varies from a maximum speed at the outer radius to essentially mathematical zero at the innermost center at the disk (where the radius is zero). The grinding material removal rate is roughly proportional to the surface speed of the moving abrasive, so that most of the grinding or lapping action, and the most efficient grinding or lapping action occurs at the outer portion of a rotating disk. Not only is the inside portion of the abrasive disk not used to remove workpiece surface material, but also this portion of the abrasive is not worn down by the workpiece, resulting in a shallow, cone shape of the abrasive disk surface. This uneven wear continues with usage of the disk, with the cone angle progressively increasing to a sharper angle. This cone angle is translated to the surface of the workpiece that is intended for rigid axis lapping of a workpiece and prevents precision flatness grinding of the workpiece, transferring uneven surface contour to the workpiece surface. An effective answer to this uneven wear is to create an abrasive disk with a narrow annular band of abrasive material (at the outer edges of the annulus), allowing the abrasive to wear down more evenly across the full surface of the abrasive disk (which is essentially the annulus, not a continuous circular surface) as the disk is used. This type of media is not available commercially and probably would not be with present production methods. This is because the continuous method of manufacturing abrasive disks cannot technically or economically produce the necessary annular configuration.

Presently, an important method of manufacturing circular abrasive sheets is to coat a continuous web backing with diamond particles to form a coated sheet material and then to punch out round disks from the coated sheet material. Effectively, most of the expensive inner surface area of these disks is wasted. If a conventional coated disk is used with a platen having an outer raised annular ring, then all of the abrasive coated area located at a radius inside the ring is not used as it does not contact the workpiece surface.

Furthermore, it is not practical to punch out radial rings from a coated web sheet for a number of reasons. First, there is not necessarily a ready market for the smaller disk that remains left over from the center punch-out for the annular ring. Also, there is a large waste of coated web material left over between the circular disks that are cut out, even with proficient "nesting" of the circular rings. In addition, the extra flexible center-less annular abrasive ring not having backing on the inner radius when made of thin 0.005 inch (0.127 mm) thick polyester web has limited structural body strength for handling and mounting. The center-less ring cannot be practically used on a platen without creating many problems, including the problem that water and grinding swarf tend to collect under the inside radial edge of the loose annular ring sheet. Furthermore, round or bar raised-abrasive islands having a thin top coating of expensive diamond particles are needed to compensate for hydroplaning affects at high surface speed lapping. The only island type of abrasive media now available which can reduce hydroplaning is a diamond particle metal plated Flexible Diamond Products abrasive sheet supplied by the 3M Company (Minnesota Mining and Manufacturing Co.). However, due to the manufacturing process of this product, the product is commercially limited by at least two counts. First, each disk has large variations in flatness, or thickness, and, due to its unique construction, cannot be made flat enough to use effectively at high speeds where the unevenness is accentuated by the speed. Second, the Flexible Diamond Product abrasive sheet is constructed from plated diamonds, which have been unable to produce a smooth polished finish.

Another widely used product from 3M Company is the pyramid shaped Trizact abrasive, which helps with hydroplaning effects. However, it is only practical for this product to be created with inexpensive abrasive media such as aluminum oxide, which tends to wear fast and unevenly across its surface. Again, this is a continuous web type of product, which does to have the capability of having or maintaining precise abrasive thickness control.

Two common types of abrasive articles that have been utilized in polishing operations include bonded abrasives and coated abrasives. Bonded abrasives are formed by bonding abrasive particles together, typically by a molding process, to form a rigid abrasive article. Coated abrasives have a plurality of abrasive particles bonded to a backing by means of one or more binders Coated abrasives utilized in polishing processes are typically in the form of endless belts, tapes, or rolls which are provided in the form of a cassette. Examples of commercially available polishing products include "IMPERIAL" Microfinishing Film (hereinafter IMFF) and "IMPERIAL" Diamond Lapping Film (hereinafter IDLF), both of which are commercially available from Minnesota Mining and Manufacturing Company, St. Paul, Minn.

Structured abrasive articles have been developed for common abrasive applications. U.S. Pat. No. 5,152,917 (Pieper, et al.) discloses a structured abrasive article containing precisely shaped abrasive composites. These abrasive composites comprise a plurality of abrasive grains and a binder. U.S. Pat. No. 5,107,626 (Mucci) discloses a method of introducing a pattern into a surface of a workpiece using a structured abrasive article.

A new class of large diameter precise thickness disks that have an annular ring of raised islands coated with a thin coat of diamond abrasive particles is required for high speed lapping which requires a completely different manufacturing technique than has been employed in the past by the abrasives industry. The new batch type of processing required to produce these disks must be practical and cost effective. Eventually, this batch process of manufacturing a disk as a separate item should be converted partially or wholly into a continuous process when product sales volume demand warrants the investment in process equipment and converting technology.

The primary competitor for the sheet fixed abrasive polishing technology is slurry lapping, which is necessarily very slow, even though it has been progressively up-dated. Slurry lapping produces a flatter surface on a workpiece at the present time than can be accomplished by high speed lapping, which has limited the sale of the high-speed lapper machines. Other traditional grinding wheel machines can produce about the same flatness accuracy as the present configuration lapper but can not produce the associated smooth polish that typical workpiece parts require. Accurate flat and smooth surfaces are used on work piece component parts to prevent lubricating or other pressurized fluid leakage at the contact surface where these parts are mated stationary with other parts or where these parts are joined to dynamically rotate against each other.

High speed lapping uses expensive thin flexible abrasive coated disks that must be very precise in thickness and must also be attached to a platen that is very flat and stable. As the platen rotates very fast, this speed tends to "level" the abrasive as it is presented to the workpiece surface. At high speeds only the high spots of the abrasive contact the workpiece, the remainder of the disk abrasive is not used until the high spots wear down. Thus, it is necessary for the total system to be precisely aligned and constructed of precision components to initialize the grinding. Furthermore, the wear of the abrasive must proceed uniformly across both the surface of the sheet and the surface of each island to maintain the required flatness of both the effective abrasive surface and correspondingly, the workpiece surface. These issues have all been addressed in the latest configuration of a lapper machine along with the process techniques employed in operating it. To generate even wear with rotating abrasive disks, an annular raised abrasive is used as taught in U.S. Pat. Nos. 5,910,041; 5,967,882; 5,993,298; 6,048,254; 6,102,777; 6,120,352 and 6,149,506. However, the desired large disks are not available, as the size of commercially available abrasive disks is presently limited to about 12 inches (30.48 cm) diameter. This severely limits the width of the annular ring without the resultant much slower surface grinding speed at the inside diameter of the ring. This slower speed also results in reduced material removal from the portion of the workpiece at this inside radial location. Furthermore, as the inside radial section of the abrasive disk wears slowly, the outside diameter portion progressively wears down faster which results in an uneven surface on the annular ring. Having larger nominal diameter abrasive disks with fairly narrow annular bands will inherently take care of most of these problems.

The typical workpieces that are lapped initially are not flat and have rough surfaces. Most potential customers seem to want both very flat (within 2 light bands) and smooth polished surfaces.

A preferred abrasive flat lapping process is now done in two separate steps. First, the parts are ground flat using a rigid spindle running at full 3,000 RPM speed, a very small contact force of 1 to 2 lbs. (0.454 to 0.908 kg) and typically, 3M's 12 inch (305 mm) diameter metal plated diamond abrasive. Water flows between the round islands of abrasive, reducing hydroplaning. Hydroplaning typically produces a cone shaped ground surface. Second, parts are polished using a spherical action workpiece holder, with low to moderate contact forces of 2 to 15 lbs. (0.908 to 6.81 kg), and uses a smooth coated abrasive disk operating at lower speeds of about 1,000 RPM or less to prevent hydroplaning. At this time, no "island type" of coated abrasive is available for polishing in combination with an effective polishing method.

Generally, use of the metal plated diamond island style abrasive disks to remove material is considered to be "grinding," as the surface finish is not smooth to the high standards of polishing. Use of the coated abrasives creates very smooth surfaces and is considered to be "lapping". The plated diamond disks tend to be very durable and may last a long time during use. The coated diamond and other abrasive particle disks are much more fragile and are consumed much more rapidly.

With respect to performance, with rigid flat grinding, 2 light bands of flatness are obtained which is not sufficiently flat for many applications. Polishing results in acceptable smoothness, but typically creates new problems with flatness because of hydroplaning. Flatness defects created in the polishing step include both cone shapes and saddle shapes.

It is important that super abrasives such as diamond (or other materials having minimal mohs hardness values within at least 20%, or at least 10% of the hardness of diamonds) be used at a minimum surface speed of 5,000 SFPM (surface feet per minute) or 1,524 meter per minute to achieve fast material removal.

The high surface speed of the plated abrasive island articles creates extraordinary high rates of material removal of very hard materials and this perhaps can be increased even further with higher speeds. This is the primary reason for the interest of the high speed grinding and lapping.

Hydroplaning of parts using fine small particle coated abrasive will always be a problem at very high speeds until an abrasive article disk is available which has "islands" of abrasive which allows excess water to pass around the island edges. A recent new commercial form of abrasive disks that has the abrasive formed into small pyramids of abrasive is available and it initially works well from a hydroplaning standpoint when the pyramids are fresh and not too worn down. However, this Trizact® brand disk sold by 3M is created only with relatively soft aluminum oxide and tends to wear out fast. It is not logical that the manufacturer would use longer wearing diamond particles in these pyramid shapes, as each disk would consume so much diamond that the costs would be too high.

A number of inventions are beginning to be considered to address the desirability of using, abrasive islands to achieve acceptable lapper workpiece flatness but they have fundamental problems. In one example, island-like foundations, which are constructed of large diameter agglomerates comprising both abrasive particles and erodible filler materials, are used, but these large agglomerates tend to wear away at the abrasive article surface unevenly. In another example, abrasive articles with patterns of shallow sinusoidal shaped rounded island-like foundation ridge shapes, the ridges formed of filler materials, with abrasive particles coated conformally to both the peaks and valleys alike is described: the shallow ridge valleys are not necessarily oriented to provide radial direction water conduits on a circular disk for flushing grinding debris away from the work piece surface even prior to wear down of the ridges; and a substantial portion of the abrasive particles residing on the ridge valley floors remain unused as it is not practical to wear away the full height of the rounded erodible ridges to contact these lower elevation particles.

The preferred shape of a raised island abrasive article is rotational round disk with an outer annular ring of raised abrasive islands which can be manufactured in batches but the same raised island flexible backing material can be manufactured in continuous web form to create a linear article such as a rectangular sheet or a endless belt.

U.S. Pat. No. 5,611,825 (Engen) describes resin adhesive binder systems which can be used for bonding abrasive particles to web backing material, particularly urea-aldehyde binders. There is no reference made to forming or abrasive coating abrasive islands. He describes the use of make, size and super size coatings, different backing materials, the use of methyl ethyl keytone and other solvents. Loose abrasive particles are either adhered to uncured make coat binders which have been coated on a backing or abrasive particles are dispersed in a 70 percent solids resin binder and this abrasive composite is bonded to the backing. Backing materials include very flat and smooth polyester film for common use in fine grade abrasives which allow all the particles to be in one plane. Primer coatings are used on the smooth backing films to increase adhesion U.S. Pat. No. 5,820,450 (Calhoun) and U.S. Pat. No. 5,437,754 (Calhoun) discloses the use of individual spaced truncated cones and rectangular agglomerate blocks attached to 50 micrometer (0.00196 inch) thick polyethylene terephthalate (PET) with an 18 micrometer (0.0007 inch) thick ethylene acrylic acid copolymer (EAA) surface primer coating using toluene to solvent viscosity-thin a abrasive slurry binder where the agglomerates are spaced with gaps on the backing by use of a embossed carrier web having spaced receptacles filled with the abrasive slurry mixture. U.S. Pat. No. 6,228,133 (Thurber, et al.) describes the application of silane coupling agent to abrasive particles which increases the adhesion of the particle to the binder and priming the backing surface for increased adhesion of the binder by corona discharge, ultraviolet light exposure, electron beam exposure, flame discharge and scuffing; abrasive particles are applied by electrostatic coating.

U.S. Pat. No. 4,311,489 (Kressner) discloses the use of irregular surface agglomerates of abrasive particles and a binder where the agglomerate binder is weaker than the agglomerate make coat binder to permit gradual wearing down of the agglomerate.

U.S. Pat. No. 5,219,462 (Bruxvoort, et al.) discloses the use of dot patterned recesses or through-holes in a backing sheet which are filled with a slurry of fine abrasive particles having an expanding agent which expands the slurry to rise above each recessed hole. The passageways between the raised abrasive composite dots can pass water and slurry until the dots arc worn down. A disadvantage with this type of abrasive article is that all of the abrasive particles contained in the recess hole at a location below the exposed surface of the backing sheet is lost for abrading use. The importance of the control of height of the top of the dot is recognized in the disclosure in that a flat mold surface can be pressed against the non-hardened abrasive dots but no description is presented concerning the importance and accuracy of controlling the dot heights.

U.S. Pat. No. 794,495 (Gorton) discloses dots of abrasive on round disks formed by depositing abrasive particles on adhesive binder wetted dot areas printed on the backing, primarily to aid the free passage of grinding debris away from the workpiece surface. These dot areas are not elevated as raised island shapes from the surface of the backing.

U.S. Pat. No. 1,657,784 (Bergstrom) discloses a variety of abrasive particle primitive shaped areas with space gaps between the abrasive areas to provide a passageway for grinding swarf.

U.S. Pat. No. 3,246,430 (Hurst), U.S. Pat. No. 2,838,890 (McIntyre) and U.S. Pat. No. 2,907,146 (Dyar) disclose the effect of an uneven abrasive surface on a workpiece article and various techniques to create separated areas of abrasives.

U.S. Pat. No. 5,549,961 (Haas, et al.) discloses abrasive particle composite agglomerates in the shape of pyramids, truncated pyramids, and beads which are mixed in a slurry having ultrasonic energy used to lower the slurry viscosity and vacuum to minimize air bubbles. Abrasive composites are forced with abrasive article surface densities of 700 to 7,500 mold cavities per square centimeter. A typical truncated pyramid has a height of 3.15 mils (80 micrometer), a base of 7.0 mils (178 micrometer) and a top of 2 mils (51 micrometer) and is continuously abutted with adjacent pyramids to form a flat continuous sheet of abrasive. When a "daisy" form shape is cut out from a sheet, the daisy is flooded with water or water with additives including water soluble oils, emulsified oils, wetting agents which suggest low speed operation. Clay additives were used to improve the control of erodibility of the abrasive composite. Surface coatings including halide salts, metal oxides and silica were applied to the abrasive particles to increase adhesion.

U.S. Pat. No. 6,231,629 (Christianson, et al.) discloses a slurry of abrasive particles mixed in a binder to form truncated pyramids and rounded dome shapes on a backing. Fluids including water, an organic lubricant, a detergent, a coolant or combinations thereof results in a finer finish on glass. Fluid flow in valleys between the pyramid tops tends to produce a better cut rate and increased flatness during glass polishing. Abrasive diamond particles either have a blocky shape or a needle like shape and may contain a surface coating of nickel, aluminum, copper, silica or an organic coating.

U.S. Pat. Nos. 6,080,215 (Stubbs, et al.) and 6,277,160 (Stubbs, et al.) discloses side-by-side coatings of different size abrasive particles by use of abrasive coating slurries where the abrasive particles are surface coated with materials including coupling agents, halide salts, metal oxides including silica, refractory metal nitrides and carbides. Fillers including amorphous silica and silica clay are used in abrasive slurries which contain methyl ethyl keytone, MEK, and toluene, TOL in various mixture ratios. Drying patterns which can be seen visually and are referred to as Bernard cells alter the nature of the abrasive coating and their existence depends on airflow and heating conditions during thermal cure of the slurry binder. Polishing liquids used include lubricants, oils, emulsified organic compounds, cutting fluids and soaps.

U.S. Pat. No. 6,217,413 (Christianson) discloses use of phenolic or other resins where abrasive agglomerates are drop coated preferably into a monolayer of abrasive agglomerates and leveling and truing which levels or evens out the abrading surface is performed on the abrasive article resulting in tighter tolerance during abrading.

U.S. Pat. No. 5,910,471 (Christianson, et al.) discloses that the valleys between the raised adjacent abrasive composite truncated pyramids provide a means to allow fluid medium to flow freely between the abrasive composites contributes to better cut rates and increased flatness of the abraded workpiece surface.

U.S. Pat. No. 5,232,470 (Wiand) discloses raised molded protrusions of circular shapes composed of abrasive particles mixed in a thermoplastic binder attached to a circular sheet of backing.

U.S. Pat. No. 4,930,266 (Calhoun, et al.) discloses the application of spherical abrasive composite agglomerates made up of fine abrasive particles in a binder in controlled dot patterns where preferably one abrasive agglomerate is deposited per target dot by use of a commercially available printing plate. Small dots of silicone rubber are created by exposing light through a half-tone screen to a photosensitive silicone rubber material coated on an aluminum sheet and the unexposed rubber is brushed off leaving small islands of silicone rubber on the aluminum. The printing plate is moved through a mechanical vibrated fluidized bed of abrasive agglomerates which are attracted to and weakly bound to the silicone rubber islands only. The plate is brought into nip-roll pressure contact with a web backing which is uniformly coated by a binder resin which was softened into a tacky state by heat thereby transferring each abrasive agglomerate particle to the web backing. Additional heat is applied to melt the binder adhesive forming a meniscus around each particle, which increases the bond strength between the particle and the backing. The resulting abrasive has dots of abrasive particles on the backing but they are only raised away from the backing surface by the diameter of the abrasive agglomerates. Each abrasive agglomerate typically ranges in size from 25 to 100 micrometers and contains 4 micrometer abrasive particles.

U.S. Pat. No. 3,916,584 (Howard, et al.) and U.S. Pat. No. 4,112,631 (Howard) discloses the encapsulation of 15 micrometer and smaller diamond and other abrasive particles in spherical erodible composites as he discloses that large particles can be coated on abrasive articles or used in slurries without the need for encapsulation.

U.S. Pat. No. 6,186,866 (Gagliardi) discloses the use of protrusions having a variety of peak-and-valley shapes comprised of an erodible grinding aid where the protrusion shapes are surface coated with an adhesive resin and abrasive particles are drop coated or electrostatically coated onto the resin forming a layer of abrasive particles conformably coated over both the peaks and valleys. There are apparent disadvantages of this product. Only a very few abrasive particles reside on the upper most portions of the protrusion shaped peaks and this small fraction of the total number of particles coated on the surface will quickly be worn down or knocked off the peaks by abrading action due to their inherently weak resin support at the curved peak apex. As the abrading action continues with the wearing down of the erodible protrusions, more abrasive particles are available for abrading contact with a workpiece article but the advantage of the valleys used to channel coolant fluids and swarf has now diminished. The abrasive particles are very weakly attached to the sloping sidewalls of the protrusions due to the simple geometric vulnerability of bonding a separate particle to a protrusion wall side. Adhesive binder that does not naturally flow and surround the particle to generate substantial strength to resist abrading contact forces which will tend to leverage the particle and break it away from the wall. Much of the valuable superabrasive particles located in the valley areas are not utilized with this technique of particle surface conformal coating of peaks and valleys.

U.S. Pat. No. 5,190,568 (Tselesin) discloses a variety of sinusoidal and other shaped peak and valley shaped carriers that are surface coated with diamond particles to provide a passageway for the removal of grinding debris. The problems inherent with this technique include the change in localized grinding pressure, in newtons per square centimeter, when a work piece first contacts only a few abrasive particles located at the top of the peaks as compared to a greatly reduced pressure when the peaks are worn down and substantially more abrasive particle surface area is in contact with the workpiece. The inherent bonding weakness of abrasive particles attached to the sloping sidewalls is discussed and the intention for some of the lower abrasive particles located away from the peaks being used to structurally support the naturally weakly bonded upper particles. The material used to form the peaks is weaker or more erodible than the abrasive particles, which allows the erodible peaks to wear down, expose, and bring the work piece into contact with new abrasive particles. Uneven wear-down of the abrasive article will reduce its capability to produce precise flat surfaces on the work piece. Abrasive articles with these patters of shallow sinusoidal shaped rounded island-like foundation ridge shapes where the ridges are formed of filler materials, with abrasive particles coated conformably to both the ridge peaks and valleys alike is described. However, the shallow ridge valleys are not necessarily oriented to provide radial direction water conduits for flushing grinding debris away from the work piece surface on a circular disk article even prior to wear down of the ridges. Also, a substantial portion of the abrasive particles residing on the ridge valley floors remain unused as it is not practical to wear away the full height of the rounded ridges to contact these lower elevation particles.

U.S. Pat. No. 5,496,386 (Broberg, et al.) discloses the coating of a mixture of diluent particles and shaped abrasive particles on a make coat of resin where the function of the diluent particles is to provide structural support for the shaped abrasive particles.

U.S. Pat. Nos. 4,256,467 (Gorsuch) and 5,318,604 (Gorsuch. et al.) discloses abrasive articles where the coating of fibrous cloth at island areas built up in raised height by electroplating areas of the cloth positioned in contact with electrically insulated metal having arrays of exposed circular electrically conducting island forming areas. Abrasive particles contained in the electroplating bath are introduced to fall on the upper portion of the plated metal islands during the process of attaching them to the fiber islands. However, the particles do not lie in a common plane at a flat surface of the raised islands. Instead, the particles are attached at many different elevations within the island areas. This out of flatness occurs because the individual fibers of the cloth which support the build-up of plated metal to create raised island structures is not flat at the upper surface of the progressively built-up plated island due to the fibers being woven together to form the cloth material. The different height locations of the particles prevent the generation of precision smooth surfaces during the abrading action but the abrasive island articles are effective in producing flat work pieces. Another disadvantage of this product is that the plated cloth material must be stripped from the electrically conductive metal base and attached as a laminate with adhesive to a backing substrate to form an abrasive article. This laminated abrasive article structure does not have the precise thickness control due to thickness variations in both the island plated cloth material and the laminating adhesive film for effective utilization of the diamond abrasive particles for high speed lapping.

SUMMARY OF THE INVENTION

Lapper Process and Apparatus

Lapping or grinding with abrasives fixed to a flexible sheet is performed at high surface speeds of 3,000, 5,000 or 10,000 or more surface feet per minute (913, 1524, or 3,048 meters per minute), requiring the use of water-like lubricants to cool the workpiece and to carry away grinding swarf. A workpiece can be held rigidly or flexibly by a rotating spindle platen to effect grinding contact with a rotating abrasive platen, but the platen must be maintained precisely perpendicular to the abrasive surface to obtain a workpiece surface flat within about 2 lightbands. The aggressive cutting action of plated diamond island style flexible sheets requires the grinding contact perpendicular force to be near zero pounds at the start and end of the grinding procedure and to be controlled within plus or minus 0.5 pounds (227 grams) with a typical nominal force of 2.0 lbs. (0.908 kg) for an annular ring shaped workpiece having approximately 3.0 square inches (58.1 square cm) of surface area. Hydroplaning of the workpiece on the water lubricated abrasive is minimized when using abrasive covered raised island sheets, but is severe for uniformly coated abrasive disks generally used for smooth polishing or lapping. Hydroplaning causes cone shaped ground workpiece surfaces, even with raised platen annular rings. The abrasive platen must be ground very flat and the abrasive disk sheet must be precise in thickness to be used effectively at high speeds.

Abrasive disks of large 18 inch (0.457 m), 24 inch (0.609 m), 36 inch (0.914), 48 inch (1.22 m) or even 60 inch (2.3 m) diameter having an outer annular band of raised islands which have a thin precise coating of diamond particles can be produced effectively with very precise thickness control. Raised island foundation bases can be deposited on a backing by a variety of means on a variety of commonly available thin flexible plastic or metal backing materials. These island foundation base plateau surfaces are machined or ground after attachment to the backing to establish a precisely controlled thickness relative to the bottom surface of the disk backing material. It is not critical that the thickness of the backing be accurately controlled as with traditional precision backing for lapping abrasive articles as the islands are machined to a uniform height after they are deposited on the backing. Loose diamonds or other abrasive particles, including composite structured agglomerates, can be metal plated or organic resin binder coated as a single mono layer on top of the top flat surface of the islands. Abrasive particles can be attached to or drop coated or electrostatic coated onto a wet organic resin island surface coating. Abrasive particle slurry binders can be coated onto the island surfaces. Resin coatings are based on organic resins including phenolics and epoxies which have been used traditionally in the abrasive industry for many years. A make binder resin coating (is a batch coating for applying resin) can be applied to an island foundation top surface, abrasive particle powder applied, a partial or full resin cure effected, a resin size coat applied and then a full resin cure effected by heat or other energy sources. These disks principally would be produced by a batch process, but a more traditional continuous web process can also employ the same basic process technology of creating abrasive particle coated raised islands in array patterns where this abrasive web material can be converted to form annular disks or rectangular sheets or continuous belts or other abrasive articles such as daisy wheels. A wide range of abrasive articles can be produced with fine abrasive particle disk sheets or belts can be used for lapping and coarse particle disks can be used for grinding. All the abrasive articles can be used at high surface speeds, which fully utilize the increased abrading material removal rates which occur at high speeds, particularly with diamond particles.

A number of techniques are described to establish a uniform thickness of a make coat of binder to the top surface of island foundations which have been previously ground to a very precise height as measured from the bottom side of a backing material. One method to produce this make coat is to first spin coat a layer of binder resin onto a flexible sheet of backing and then to press this binder wetted coating onto the top surface of an annular array of raised islands attached to a round backing. Approximately one half (e.g., between 20% and 75%, or more) of the spin-coated binder is transfer coated to the island top surfaces when the spin-coated transfer sheet is separated from the island sheet. Abrasive particles can be drop coated onto the binder-wetted surface of the islands and then the binder can be partially or fully cured. Make coats of resin may be wet through the full thickness of the resin coat or only the surface of a partially cured resin may be given a wet surface condition by the application of heat or by other means prior to the application of abrasive particles. Subsequently, other size coats of binders can be applied to the island sheet, optionally coating either the island tops only, or covering both the island tops and the island valleys. Make coatings can be applied optionally by various printing techniques directly on the surface of the island both for the make coat, the size coat and other coatings. A variety of techniques are described which control the application of the abrasive particles to achieve a uniform density of particles on the surface of the islands where there is no more than 65 percent of a given island area surface covered by abrasive particles. Further, the resultant layer of particles is controlled to minimize the occurrence of more than a single (mono) layer of particles on an island surface. The resultant sheet or disk form of abrasive article has a single layer of abrasive particles bonded to island surfaces where the variation of height (measured from the backside of the abrasive particle backing) of adjacent particles on islands is typically less than one half the average diameter of the particle. One objective in the use of a single layer of abrasive particles is to utilize a high fraction of the expensive particles particularly the two superabrasives diamond and cubic boron nitride (CBN). Another objective is to minimize the dimensional change in the flatness of the abrasive article due to wear-down. A preferred abrasive particle size is 30 microns (micrometers) which is slightly more than 0.001 inch (25.4 microns). When the abrasive is fully worn away, the abrasive surface of the islands has therefore only changed by approximately 0.001 inch or 25.4 microns which is a very small change in height or flatness compared to other lapping abrasive articles in common commercial use at the present. A number of the present commercial articles are coated with fused spheres, pyramids and other agglomerate shapes which have nominal effective diameters of two to ten times or more, of the basic abrasive particles contained in the erodible agglomerate carrier shapes. These large agglomerates tend to wear unevenly from the contact with workpiece articles due both to the contact size of the workpiece typically being smaller than the abrasive article surface, and also, due to the increased wear-down at the outer diameter of an circular abrasive disk article and decreased wear-down at the slower surface speed movement at the inside diameter. When the agglomerate wears down unevenly on a portion of its surface, this uneven abrasive surface is now an presented to a new (sequential operation) work piece article which reduces the capability of the lapping process to quickly and economically effect the creation of a flat surface on the workpiece. The workpiece may be smoothly polished due to the characteristics of the fine abrasive particles imbedded in the erodible agglomerates, but the workpiece surface will tend not to be flat.

It is preferred that a single or monolayer of individual abrasive particles, such as natural or man-made diamond particles, be coated on abrasive island tops but a single or mono layer of erodible agglomerates made up of smaller abrasive particles can be used on top of the abrasive islands. In this work, each of the island foundations are high enough from the surface of the abrasive article backing that cooling water and generated grinding swarf can freely travel down the valleys between the island tops. The radial flow of water and debris swarf is created by the centrifugal forces generated by rotation of the abrasive sheet so the spent water exits the active grinding surface area of the disk while fresh clean water is supplied continuously over the whole time of the grinding event.

BRIEF DESCRIPTION OF THE DRAWINGS

FIG. 6A is a top view of a roller transfer coat system.

FIGS. 6B and C are cross-sectional views of a roller transfer coat system.

DETAILED DESCRIPTION OF THE INVENTION

Figure 1A:
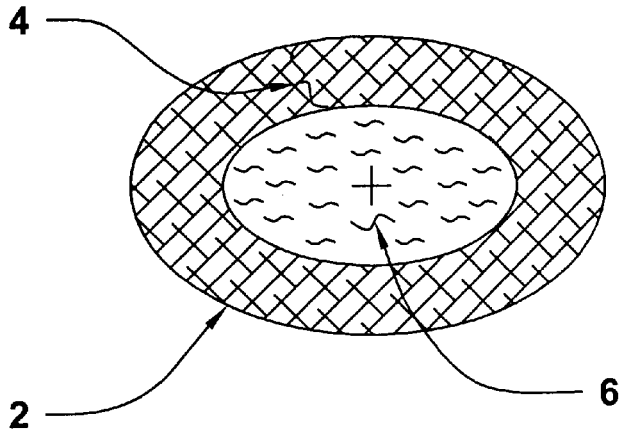
FIG. 1A and B are isometric views of spin coated annular abrasive disks.

Apparatus, abrasive sheets and methods are needed for super high speed lapping at greater than 500 surface meters per minute and even speeds of 3,000 or 5,000 or greater surface meters per minute with abrasive sheets of 6 inch (0.154 m), 12 inch (0.308 m), 18 inch (0.462 m), 24 inch (0.616 m), 36 inch (0.924 m), 48 inch (1.23 m) and 60 inches (1.53 m) in diameter.

The present invention may be further understood by consideration of the figures and the following description thereof.

The materials and processes of the present invention may be used, by way of non-limiting example, in various combinations as there are a variety of methods that could be used to create the desirable "island-like" coating patterns on abrasive disk products that are described here.

Spin Coated Annular Abrasive Disks

Problem: It is desired to produce abrasive disks which have an flat-surfaced outer raised annular ring of abrasive particles with a simple effective manufacturing method which takes up a minimum of facility space and which requires a minimum capital equipment investment. This manufacturing process needs to be suitable for a large abrasive particle size range, a range of abrasive disk diameters, and also for a wide selection of abrasive particle materials and disk backing materials. It is important to achieve good abrasive layer thickness control of the raised abrasive annular ring across the full raised area. The thickness is measured from the top exposed surface of the abrasive to the backside of the abrasive disk backing Solution: Annular bands of abrasive particles can be coated on thin flexible backings, or on stiff rigid backings, by using a spin coater to apply a uniform thin make coating of adhesive resin to a flat circular continuous disk backing and then drop coating loose abrasive particles onto this resin wetted annular ring. Particles of abrasive can also be attached to the wet resin surface by fixturing the backing upside down to a vacuum plate or chuck and using electrostatic particle coating techniques to project loose particles onto the resin surface. After abrasive particles are bonded as a single layer to the wet resin surface, the resin can be partially cured to stabilize the particles integral with the backing. A size coating can then be applied over the particles, by spin coating, spray coating, or other coating techniques. Also, a supersize coating can be applied over the size coating by a variety of coating techniques. The coated abrasive disk article can be fully cured where one, or all of the resin coatings can be cured by a variety of energy means including heat, light, UV, electron beam, and so on. Preferred resins are solvent thinned phenolics, epoxies and polyimides. Abrasive particles can range from 0.1 micrometer to 400 micrometers in diameter. Backing materials include 0.002 inch (50.8 micrometers) to 0.020 inch (508.0 micrometers) thick polyester, metal, cloth, fiber, or other materials. The resin make coating typically would be 10 micrometers thick. The disk diameter can range from 0.5 to 60.0 inches (1.27 to 152.4 centimeters). A coated disk article produced by this method would have a precise thickness over the full abrasive area when a precision thickness disk backing material is used.

Figure 1B:
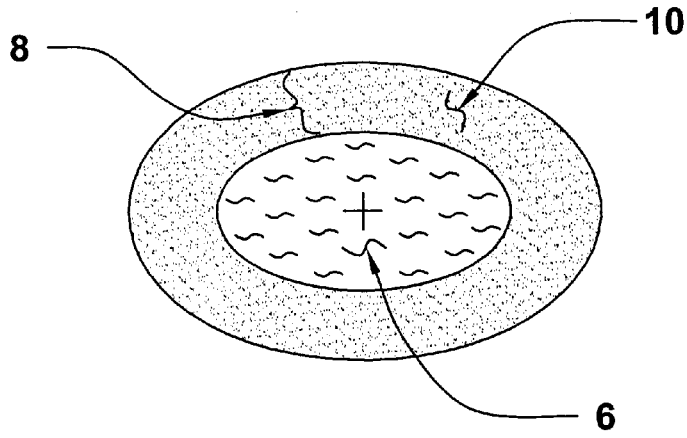

FIGS. 1, A and B are isometric views of a spin coated annular disk. FIG. 1A shows an abrasive disk 2 with a resin coated annular ring 4 coated on a disk backing 6. FIG. 1B shows a disk backing 6 with an abrasive particle coated annular ring 10 where the annular section 8 is raised above the backing 6 by the thickness of the abrasive particles plus the make coat of the resin 4.

Coated Island Edge Flatness Control

Problem: When a transfer sheet is used to apply a liquid make coat resin layer to the flat top surface of islands attached to a backing sheet, the resin layer will be pulled apart as the transfer sheet is separated from the islands leaving a "pulled-up" or lofted resin bead boundary to the island edges. When a diamond abrasive powder is drop-coat applied to the wet resin, diamond particles on this pulled-up resin outer island edge bead will tend to be raised from the diamond particles located on the island area central surface. It is desired that all the abrasive particles on each island be flat across the full island top surface with a uniform thickness of the abrasive sheet as measured from the island tops to the backing bottom.

Solution: When the coating resin is applied to all the island top surfaces by use of a resin coated transfer sheet, the transfer sheet is then separated from the island by the very thin resin coating remaining on the island surfaces would have a nominal thickness of approximately 10 micrometers (0.00039 inch) while the raised island foundation base height is much greater than the coated resin, with the island height having a typical elevation of from 0.005 to 0.020 inches (127.0 to 5080 micrometers). To re-level the pulled-up resin located at the island boundary edges, each island top flat surface can be subjected to a high velocity air or gas jet directed downward perpendicular to the island top flat surface. Any excess liquid pulled-up resin which is present at the outer periphery of the flat island would then be blown off the island flat surface and would then be moved downward on to the outer vertical wall of the island edge. The resin on the island surface would now tend to be somewhat thinner at the outer periphery of the island than at the island central area. This edge thinning would result in the diamond abrasive particles located at the outer island edge being a very small amount lower than the particles located at the central area of the island. The "soft-rounded" leading edge abrasive particle coated island can produce smoother work piece lapping than an island with a "square" sharp abrasive edge. This abrasive article with rounded island edges would also produce smoother work piece lapping than one with pulled-up island edges. A single air jet device can be used and the disk rotated under it to "soften" the resin edge of all islands on an annular abrasive disk by use of a slotted air bar. Individual air jets can be used on each island where a concentric air tube with a solid core can exert air jet pressure to the outer island edge only, protecting the central area. Also, air jets can be used to smooth or level the coated islands after the powdered abrasive particles are applied and the resin is still liquid.

Figure 2A:
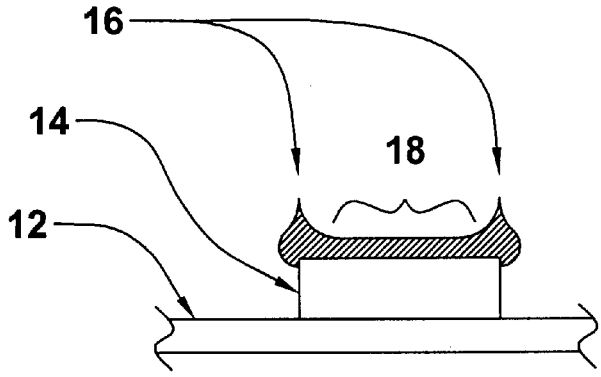
FIG. 2A and B show cross-sectional views of raised resin coated islands.
Figure 2B:
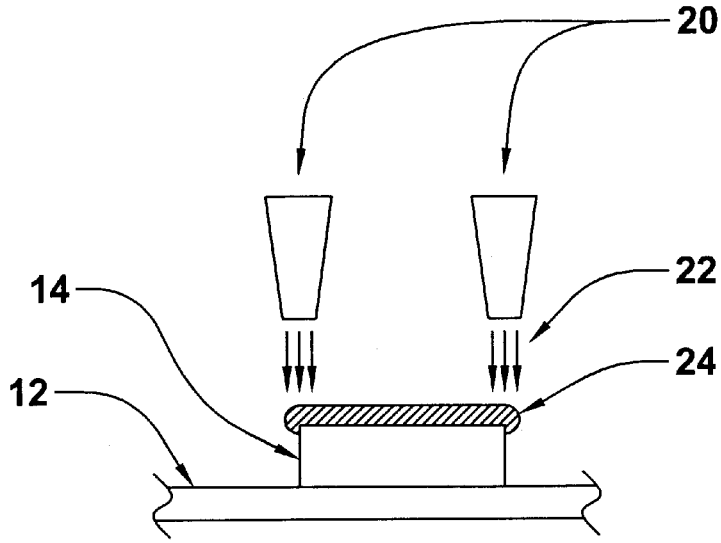
FIG. 2C is an isometric view of an air bar island edge resin smoothing system.
FIG. 2D is a cross-section view of an air bar resin edge smoothing system.

FIG. 2A shows a cross-sectional view of a raised island foundation base 14 attached to a coated abrasive disk backing 12 where pulled-up resin 16 exists at the outer boundary edge of the island foundation surface. The central area 18 of each island has a resin coating which lays flat and uniform in thickness across the full area. FIG. 2B shows a cross-sectional view of a disk backing 12 with raised island foundations 14 with air nozzles 20 producing high velocity airjets 22 directed toward the resin coated island surfaces to produce a leveled island boundary edge resin 24 which is rounded downward toward the backing 12.

Figure 2C:
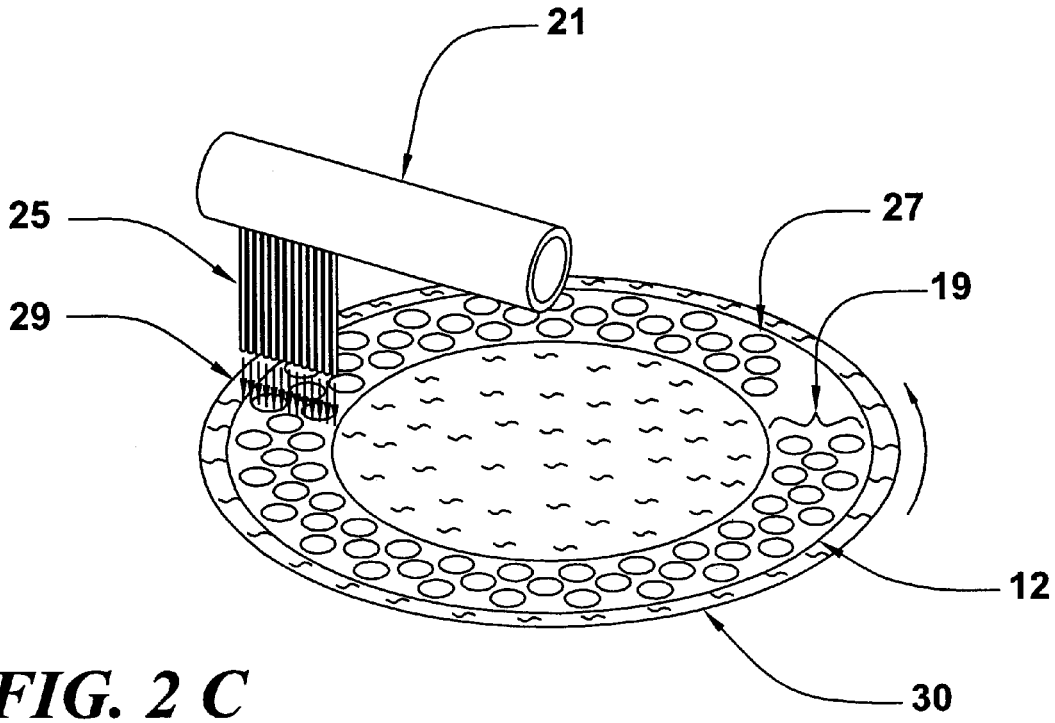

FIG. 2C is an isometric view of an air bar used to level the resin located at the edges of island surfaces. Resin coated islands 27 attached to a continuous disk backing 12 mounted on a rotating platen 30 are moved so the annular band of islands 19 move under an air bar consisting of hollow hypodermic needles 25 attached to an air jet pipe manifold 21. Typical needles are 2.0 inches (5.08 cm) long with a 0.40 inch (0.1 cm) inside diameter. Pressed air entering the manifold 21 exhausts at the open free ends of the needles as high speed air jet streams 29 directed downward against each of the island 27 surfaces as they are rotationally translated under the air bar. The disk backing 12 may make one or more revolutions to smooth the island edge resin and the air pressure may be changed at different times in the resin smoothing process.

Figure 2D:
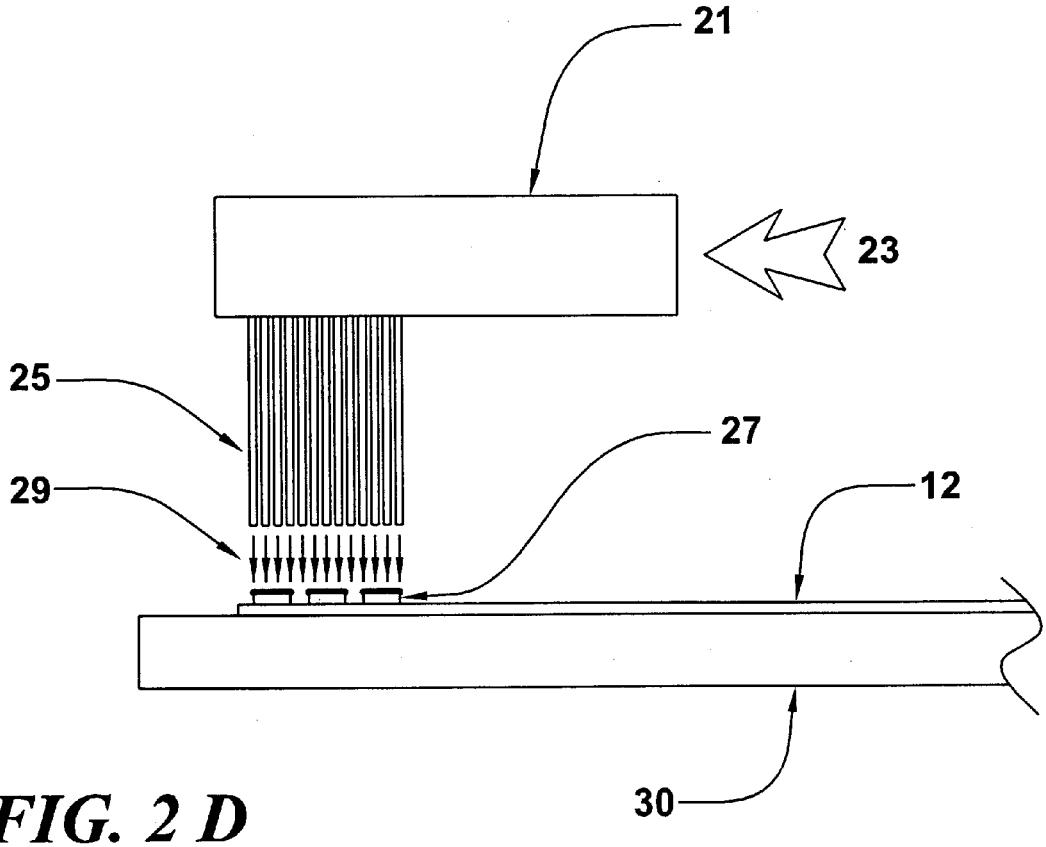

FIG. 2D shows a cross-section view of the air bar system where the resin coated islands 27 attached to the disk backing 12 are rotated by a platen 30 to allow airjet streams 29 exiting from hollow needles 25 with high pressure air 23 supplied by the manifold 21 to impact the islands.

Annular Raised Island Abrasive Manufacturing Cell

Problem: It is very expensive to set up a manufacturing facility to produce conventional diamond abrasive disks by converting continuous abrasive particle coated web into disks. Also the precision thickness web backing material used is expensive. Typically, a large roll of web backing is unwound, routed through a resin coating maker to deposit a make coat of resin, then loose diamond particles are deposited on the wet resin, or a slurry mixture of abrasive particles and resin is coated on the web, and the resin is partially solidified. A size coat is applied to the particles and the abrasive particle coated web is temperature cured in a oven or cured by other energy devices such as a electron beam unit. After winding the abrasive coated web on a roll, the roll is processed by a web slitter and a slit web band strip has circular disks cut from it. The excess abrasives coated web surrounding the cut disk is discarded even though it has been coated with expensive diamond or other abrasive particles. Highly skilled operators are required to operate this expensive equipment.

Solution: A very limited size manufacturing cell approximately 12 feet by 12 feet (3.65 m by 3.65 m), or 144 square feet (13.35 square meters), can be set up to manufacture annular raised island abrasive disks of up to 30 inches (76.2 cm) diameter in a batch type of process. Six separate pieces of equipment, or workbench stations, each with approximate dimensions of 4 feet by 4 feet (1.22 m by 1.22 m) can be set up in a sequential process to manufacture these very high quality abrasive disks. Semi-skilled operators can effectively use these equipment stations consisting of: 1.) an island font raised foundation coating and solidification station; 2.) a raised island foundation precision height grinding station; 3.) a spin coater used to apply "make" and "size" resin coatings on transfer sheets; 4.) a resin transfer coating bench; 5.) an abrasive particle drop coating station; and 6.) a stationary box oven. A single operator can sequentially process a single disk or a small batch of disks of a variety of sizes and product styles in a short period of time. The total cost of the process equipment and the associated facilities are a small fraction of that required for a traditional abrasive disk manufacturing production line. Multiple manufacturing cells for these batch production runs can be quickly set up as all of the equipment, including material handling devices, can be easily produced by special equipment builders located in any industrialized area in the world. Items such as workbenches and ovens can be purchased as standard commodity items. A wide range of locally supplied inexpensive non-precision thickness backing materials can be used for the round disk sheet backing stock material as only the precision ground height of the finished island base foundations is important. Island foundation structures are attached to the non-precision thickness disk-backing sheet and each foundation is ground to a precise height relative to the support size of backing by the height grinder prior to applying the island resin surface coating.

Figure 3:
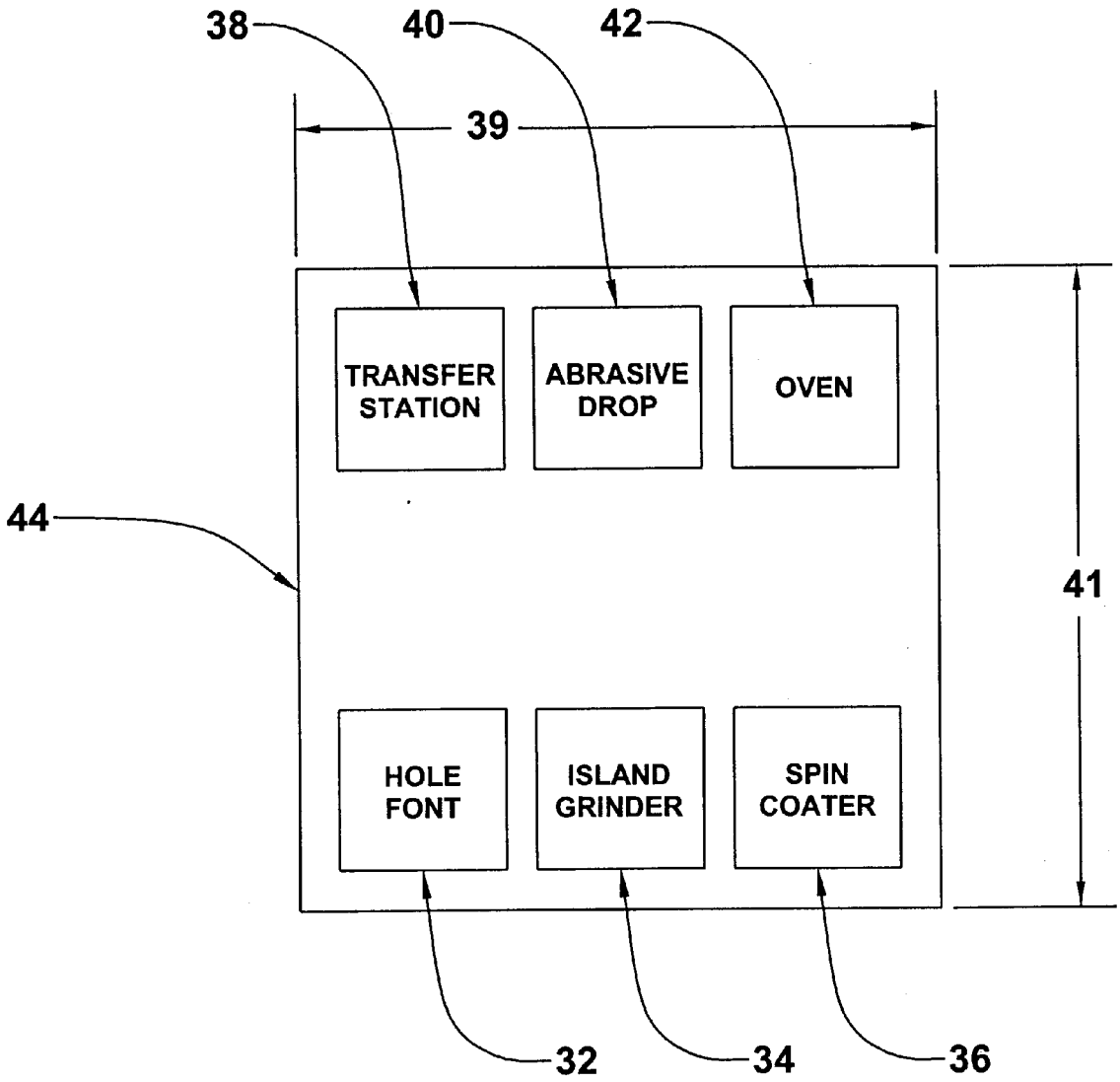
FIG. 3 is a plan view of an annular disk-manufacturing cell.

FIG. 3 is a plan view of an annular disk manufacturing cell abrasive having a length 39 on one side of 12 feet (3.65 m), and a length 41 on another side of 12 feet (3.65 m) with six process stations. At the hole font station 32, a disk backing is temporarily attached to a disk hole font to spry create polymer island base foundations on the backing. The island foundation grinder station 34 is used to precisely grind each island foundation to a precise thickness. The spin coater station 36 is used to apply a thin resin coating to a transfer disk-backing sheet. The transfer sheet 38 is used to transfer approximately one half of the thickness of the resin from the transfer sheet to the island foundation top surfaces on an abrasive backing sheet. The abrasive drop station 40 is used to apply abrasive powder to the resin coated island foundations. The oven station 42 provides curing action for both the island foundation bases and the abrasive particle make and size resin coatings on the disk. Raised island foundation structures can be applied to a disk backing by other techniques than a hole font casting mold at a station which has a size approximately the same as the hole font station. Likewise a resin make coat can be applied by alternative techniques to the island top surfaces at a station which has a size approximately the same size as the spin coat station.

Endless Belts With Raised Island Abrasives

Problem: Endless abrasive belts constructed by butt-splicing strips of abrasive sheeting tends to produce thickness variations for the belt at the butt joints greater than the 0.0001 inch (2.54 micrometers) thickness variation desired for smooth abrading action using an abrasive article having 0.001 inch (25.4 micrometer) diameter abrasive particle coated material.

Solution: An endless belt of sheet backing material can be made by use of a straight or angled butt joint having a tapered or "feathered" thickness adhesively bonded joint. This backing belt can then be turned "inside out", installed on a driven belt roller device with the belt routed over a precision idler roll and the inner belt surface ground flat as it passes its full length over the idler. Then the belt can be turned "inside out" again and island foundations can be deposited on the surface of the belt by a variety of deposition techniques. One technique would include having a single stationary drop injection head which deposits foundation bases on the belt as the belt is rotated while the belt is side-steered trammed by rolls which also move laterally to produce a pattern of raised foundation bases on the belt surface. Alternatively, the belt can be driven in a straight line as a roller system and the deposition head moved laterally. The island base foundations would then be precision ground to a uniform height by positioning the grinder head above the precision idler and moved laterally as the belt is driven. Then a narrow band of a continuous belt of web material is coated with a thin coating of adhesive binder resin and this resin wetted band is brought in contact with the raised foundation flat top surfaces to transfer approximately one half the thickness of the resin to foundation surfaces. The resin-coated band is traversed across the belt width during resin transfer. Diamond and other abrasive particles are drop coated on the wetted surface of the island tops. There is no "stop" or "start" resin coating bands along the length of the belt as the resin transfer belt is progressively advanced laterally across the belt width as the belt is driven forward with a speed match between the lateral motion and the belt downstream motion so that any given island foundation is only contacted once by the resin transfer belt. After solidification of the resin to attach or bond the abrasive particles to the belt, a size coat of resin is applied to the abrasive particles by the same resin transfer belt system or by spray coating or by using lateral travel resin transfer nip rollers. Transfer nip rollers can also be used to apply the make coat for the abrasive particles, if desired.

Figure 4A:
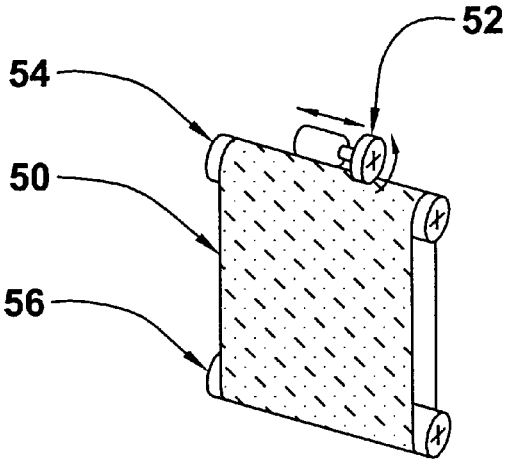
FIGS. 4A, B and C are isometric views of a system for raised island abrasive belt manufacturing.
Figure 4B:
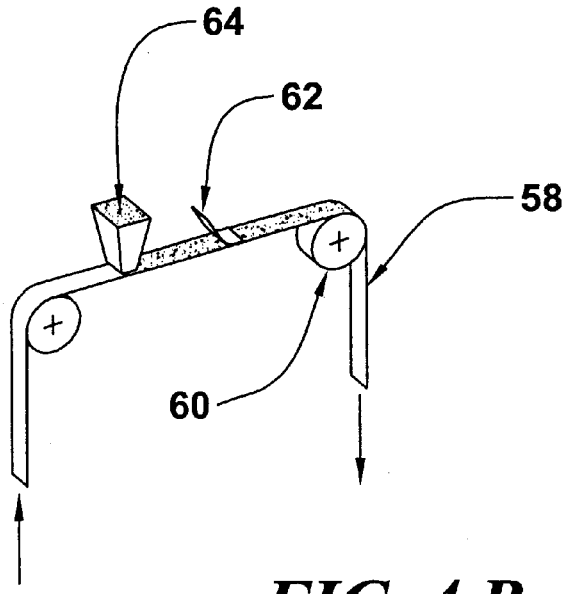
Figure 4C:
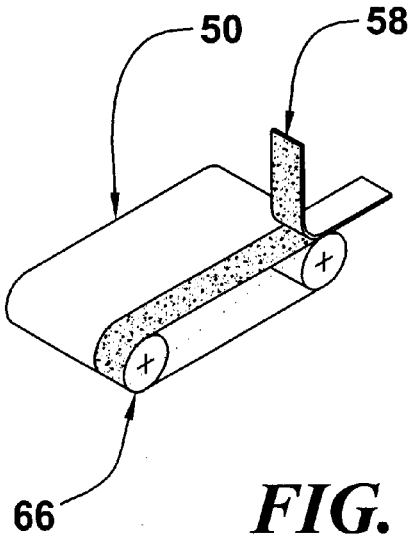

FIGS. 4, A, B and C are isometric views of a system for raised island abrasive belt manufacturing. FIG. 4A shows an abrasive belt 50 mounted on a roller system having a driven roll 56 and a precision idler roll 54 with a traversing grinding wheel 52 which grinds each island foundation to a precise height relative to the surface of the idler roll 54. The idler roll would have ABEC (Annular Bearing Engineering Committee) Class 9 mechanical roller bearings having a radial run-out tolerance of from 20 to 40 millionths of an inch (0.508 to 0.902 micrometers) or they would use air bearings which are of the same or better accuracy. The outer surface of the idler roll would be machined to a radial accuracy of about 50 millionths of an inch (1.27 micrometers). FIG. 4B shows a narrow resin coating transfer belt 58 coated by a combination resin container and applicator 64 with the belt deposited resin leveled by a smoothing blade 62 as the belt is continuously advanced with the use of an idler system 60. FIG. 4C shows a resin coated narrow belt 58 applying a strip of resin to an abrasive belt backing 50 with the narrow belt 58 being continuously advanced laterally across the width of the idlers to progressively coat the full width of the backing belt 50. The belt 50 is advanced by a driven roll 66.

Island Edge Flatness Leveling

Problem: When a thin 10.0 micrometer (or 0.00039 inch) coating of make coat resin is applied by a transfer sheet to the top surface of flat island foundations and the transfer sheet is separated from the islands, a very small raised portion of the resin would exist at the outer edges of each island due to the shear splitting of the resin. In the void areas between the island surfaces, all of the resin will remain with the transfer sheet but at the location of the island flat top surfaces, the resin will be split where approximately 50 percent of the resin remains on the transfer sheet and 50 percent will be transferred to the island tops. As the resin coating is very thin relative to a large 0.125 inch (0.32 cm) diameter of a circular island, the resin will be flat and uniform in thickness at the central flat area of the island top. The resin coating shearing action at the island edge can produce a raised bead on the island edge which is higher than the island central area by an amount which could be from one quarter to two or even four times the diameter of a 30 micrometer abrasive particle. When loose abrasive particles are drop coated on the island surface, the diamond or other abrasive particles located at this outer island raised bead would be significantly higher in elevation than the particles bonded to the relatively large surface area of the central portion of the island. This raised bead is not desirable as the abrasive particles on the bead would have to be worn away before the majority of the particles located on the interior central island area could be contacted by a workpiece. The beaded island edge is more of a problem when the size of abrasive particles is reduced in size down to 1 or 10 micrometers.

Solution: The system of applying a thin coating of resin by transfer coating to the top surface island foundations can be used which results in a raised bead of resin at the island boundaries, either for round or any other shape of island. Then abrasive particles can be drop coated onto the wet resin with particles attached to the resin bead having a higher elevation than the particles at the island interior surface. The raised bead of resin will have a tendency to exist outboard of the boundary of the rigid island foundation away from the island top flat surface. After deposition of the abrasive particles, a leveling plate system can be used to flatten each island. Here a thin flexible sheet would laid across the surface of the island annular ring band. Then another sheet of flexible cushion material and finally, a more rigid sheet would be added which will allow a uniform force to be applied to the top surface of each island, thereby driving the flexible cushion sheet, contacting the abrasive particles, downward. The raised resin bead would be driven down alongside the island vertical walls which would result in the whole top surface of each island to be leveled across the full surface of each, and all, islands. Vibration can be applied in various directions to enhance this leveling action. The leveling plate apparatus can be left in contact with the islands until the resin is solidified.

Figure 5A:
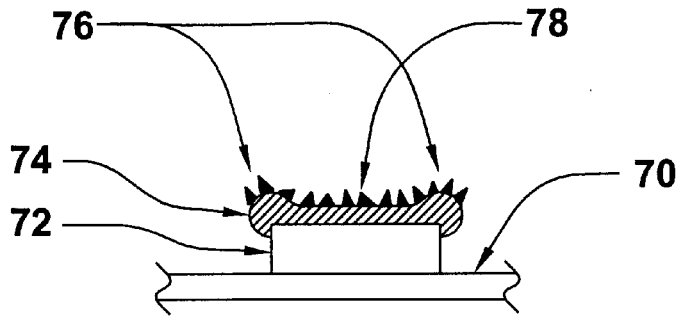
FIG. 5A and B are cross-sectional views of an island edge resin flattening system.
Figure 5B:
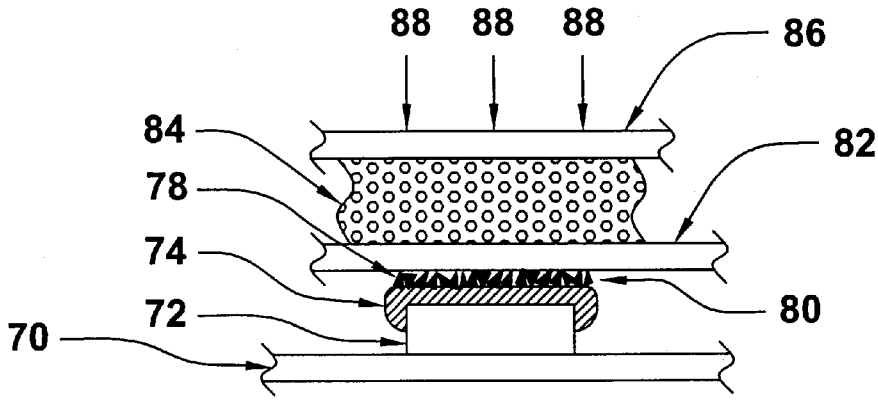

FIGS. 5A and B are cross-sectional views of an island edge resin leveling plate flattening system. FIG. 5A shows an abrasive sheet backing 70 having raised island foundations 72 coated with resin adhesive 74 having a raised bead of resin 76 which is lofted higher at the island boundary edge than at the island center area. Abrasive particles 78 are drop coated conformally to the surface of the island resin. FIG. 5B shows a raised island foundation 72 attached to a backing 70 coated with adhesive resin 74 having surface abrasive particles 78 where the particles 78 and the resin 74 are mutually flattened across the full width of the island surface by use of a surface contact sheet 82. Contact forces 88 are applied to a semi-rigid layer sheet 86 which presses on a flexible cushion foam layer 84 which applies a flat contact surface to the resin 74 which establishes a flat surface across the width of each island where particles located at the island edge 80 are flat with the island interior central area.

Annular Transfer Coat Abrasive Disk

Problem: It is desired to apply a very thin but uniform thickness resin to the top surface of raised islands as a make coating, then drop coat diamond, or other, abrasive particles and apply a strengthening size coat of resin after which the resins are fully cured by use of techniques and process equipment which is simple, inexpensive, productive and of small size. It is important that the resin coating thickness be uniform for each island. Also, annular ring abrasive disk articles which have diamond or other abrasive particles attached by electroplating in a monolayer to raised precision height island surfaces can offer good utilization of expensive abrasive particle materials; and also, offer the capability to produce smoother work piece surfaces than a cloth fiber based plated island abrasive article. Diamonds electroplated directly to the top flat surface of a island will not have tendency to break loose from the backing as compared to the common failure where the cloth fiber island structures tend to separate from the backing sheet. This failure occurs when grinding work piece impact forces tend to break the whole island structure loose from the backing when the lamination adhesive, which attaches the complete island structure to the backing fails. Further, metal backings with raised islands coated with at least a monolayer of abrasive particles supported in a layer of resin can provide increased durability in abrading use compared to plastic backing abrasive articles having resin bonded abrasive particles.

Solution: An annular ring of resin can be applied as a thin uniform thickness coating on a thin flexible backing disk sheet and this sheet can be used to transfer approximately 50 percent of the resin coating thickness to the top surface of the raised island foundations with the use of a contact roller system. The transfer sheet would be laid in direct contact with the annular ring of raised island surfaces and the roller would be held in controlled pressure contact with the transfer sheet as the roller is moved continuously across the full width of the disk to press the wet liquid resin into contact with the island surfaces to effect transfer of the resin to the island surfaces. In a like manner, a roller system can be used to progressively remove the resin transfer sheet progressively from the raised island sheet leaving a uniform make coat resin thickness on each island surface site. An alternative technique would be to pass a resin transfer sheet and raised island backing sheet sandwich through a nipped roller system where one or both rollers are rubber covered. After removal of the resin transfer sheet, abrasive particles are drop coated onto the wet resin island surfaces. Another alternative technique would be to apply a thin flexible cover sheet to the surface of the wet resin prior to applying abrasive particles and then applying a uniform downward pressure on this sheet to hold it against the island surface until a "B-stage" partial cure of the resin is effected. Then the cover sheet is stripped away and the surface of the resin on the islands is brought into a surface wetted state by the application of heat, solvents, or by other methods, after which abrasive particles are drop coated on the island surfaces. A number of these abrasive particle coated sheets can be stacked with interleaved separation sheets, a weight placed on top of the stack and a partial cure of the resin effected by processing the stack in an oven. A size coat of resin and a supersize coat containing grinding aids or lubricants can then be sprayed or transfer roll coated on each sheet, the sheets stacked again with separation release liner sheets and the stack given a final oven cure.

Abrasive articles having diamond or other abrasive particles attached by electroplating to individual islands can be produced by creating a flexible metal backing from a uniform sheet of metal where individual raised islands can be created in array patterns on the backing sheet by a variety of means. The islands can be machined from the surface of the metal backing sheet which would leave the metal adjacent to the island features less than 0.3 mm thick which will provide adequate flexibility to the backing sheet. Also, chemical etching of chemical milling of the metal can effectively form the raised island features after which the island top surfaces can be ground flat to a precise uniform height. Each island surface height is controlled to be within 20 micrometers of the other islands with the height defined by the thickness measured from the top of the island surface to the support side of the backing. An electrical insulating resin can be applied to the complete top surface of the island side of the backing and then this resin is removed from the island surfaces by cleaning it off with solvent wetted cloths prior to solidification of the resin; or the resin can be solidified and then removed from the island surface by machining or grinding it off. After exposing only the bare metal at the top surfaces of the islands, abrasive particles can be bonded to the island surface by electroplating them in an electroplating bath as they fall to the island surface during the plating process. Abrasive particles will not be plated to the resin coated areas located between the islands because the surface area at these locations is not electrically conductive. A monolayer of abrasives can also be resin bonded to the metal island surfaces by coating an abrasive resin slurry to the island surfaces; or a resin coating can be applied to the island surfaces and abrasive particles drop coated to the resin.

FIGS. 6A, B and C are top and cross-sectional views of a roller transfer coat system. FIG. 6A shows an abrasive disk 90 with an annular ring of raised island foundations 92 where the top surfaces of the island foundations 96 are contacted with the wet resin on a resin transfer sheet 94 which is progressively pushed into nip contact with the foundations 96 by a rotating rubber covered nip roll 98. FIG. 6B shows a cross-section view of the nip rolls 98 applying nip pressure to the sandwich of the continuous disk backing 90 and the transfer sheet 94 to force the resin adhesive layer 100 into direct contact with the foundation 96 top surfaces. FIG. 6C shows a similar nip peel-off nip roll 102 used to uniformly separate the transfer sheet 94 so that the original resin thickness 108 remains on the transfer sheet 94 in the areas where an island foundation 96 surface was not contacted. Approximately one half of the resin thickness 108 remains on the surface of the island foundation as shown by thickness 106 with a corresponding reduced resin thickness 110 left remaining on the transfer sheet. The disk backing 90 can be supported and slid along on a flat surface (not shown) under the roll 102 or another nip roll (not shown) can be used to support the disk sandwich. The resin transfer sheet 94 is shown being progressively separated from the resin coated island backing sheet disk 90 by pulling the transfer sheet 94 up after it leaves the roll 102.

Resin Transfer to Raised Abrasive Islands

Problem: It is critical to transfer diamond particle bonding resin to the surface of raised islands without raising a lofted bead resin coating at the island boundary edges when the transfer sheet is removed from the islands. It is also necessary to create a very uniform precise thickness of resin coating on each island surface. Use of production techniques which minimize the product manufacturing costs are important.

Solution: A sandwich of two disks can be prepared where a resin coated transfer disk sheet is placed over a raised island backing sheet where the wet resin is in contact with the island surfaces. This sandwich, comprised of a resin transfer sheet joined with a backing sheet, can then be placed on a conveyor belt. The conveyor belt would have one end positioned around the lower roll of a nipped roll set and the other belt end would be mounted around a driven roll. Rotating the lower nip roll advances the belt and the sandwich disk through the nip roll to progressively squeeze the wet resin onto the island surfaces, allowing air to exit the resin nip area without becoming entrained within the resin which is coated on the flat surface of the island. An alternative belt carrier system can extend beyond the nip rolls to carry the nip-compressed disk sandwich beyond the nip roll into another disk process station such as a heated oven, a light cure station, and so on (etc). The resin transfer sheet may be left in contact with the raised island backing until the resin is partially cured; or the transfer sheet may be removed immediately to leave approximately 50 percent of the resin on the island surfaces. In one process variation, immediately after separation of the resin transfer sheet, another cover sheet can be applied to the fluid resin wetted island tops and the new disk sandwich again processed through the nip roller. This nip would force the liquid raised resin located at the island boundaries back down flat to the surface of each and all islands. The cover sheet would be left in place on the raised islands until the resin became solidified enough that the island boundary resin would not "pull-up" again when the lower sheet was removed. A smooth clean polymer cover sheet can be easily removed at the time a resin is partially (B-stage) cured or a release liner cover sheet can be used. The B-stage resin can then be re-wetted by heat, chemicals, solvents, light sources or by direct contact of wrapping the backing sheet on a heated roll to allow diamond particles to be drop coated on the wet resin coated island foundation raised top surfaces only. Various chemicals can be coated on the islands or in the valleys between the islands to aid in the use of the abrasive article for grinding or lapping or for CMP (chemical machining processing).

Figure 7A:
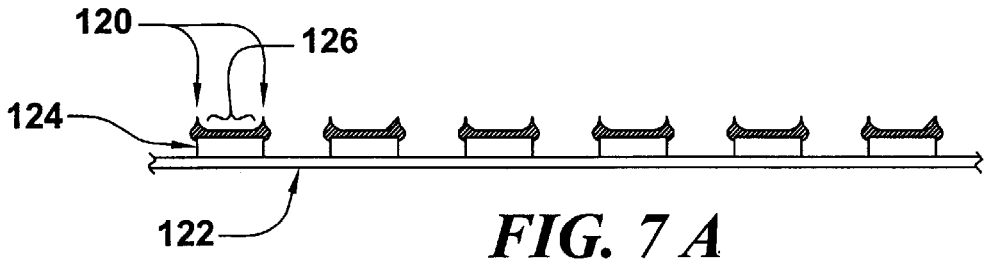
FIGS. 7A, B, C and D are cross-sectional views of resin transfer coating on island foundations.
Figure 7B:
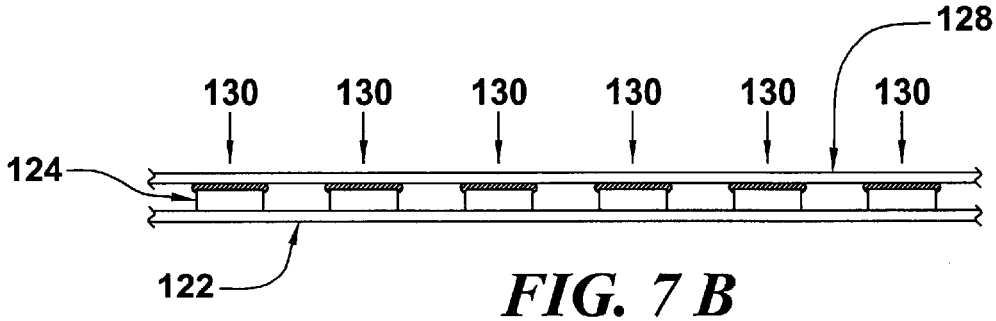
Figure 7C:
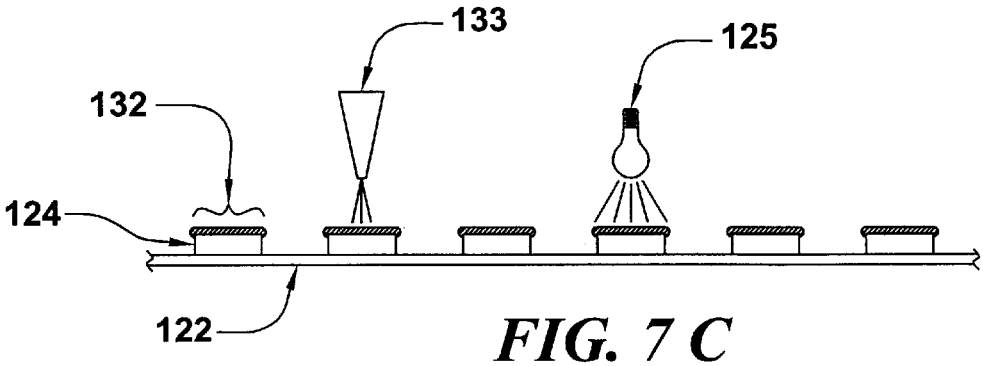
Figure 7D:
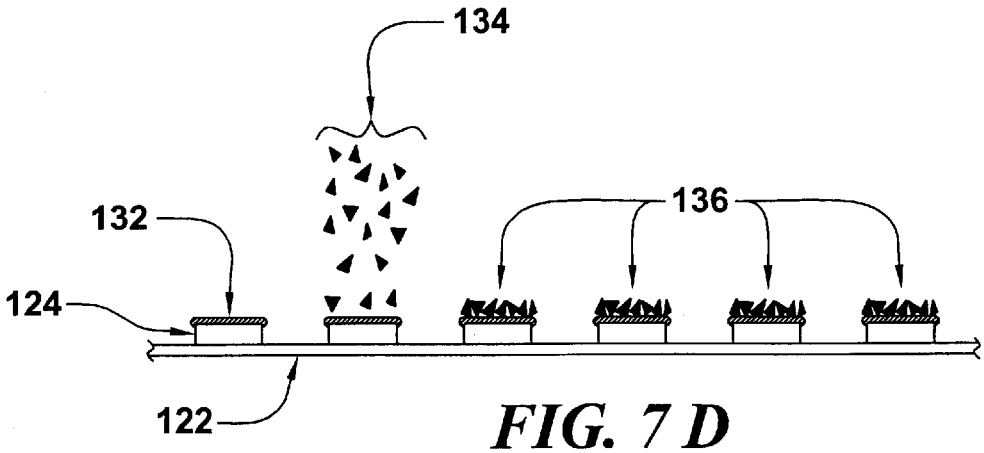

FIGS. 7A, B C and D are cross-sectional views of resin transfer coating on island foundations. FIG. 7A shows a sheet backing 122 with raised island foundations 124 with uniform thickness of resin 126 in the central areas of each island and raised beads of resin 120 at the outer boundary edge of the island 124 surfaces. FIG. 7B shows a backing 122 with raised islands 124 where the resin is flattened by a leveling sheet 128 which is forced downward with a modest or small pressure 130 over a period of time and left in place until the resin is semi-cured. FIG. 7C shows the backing sheet 122 having raised islands 124 where the semi-cured resin 132 is then re-wetted for drop coating of abrasive particle powder either by a heated air jet 133 or by a radial lamp or other energy source 125. FIG. 7D shows a sheet backing 122 with raised islands 124 having leveled wet resin coated tops 132 with abrasive particles 134 drop coated to produce abrasive particle top coated islands 136.

Figure 8A:
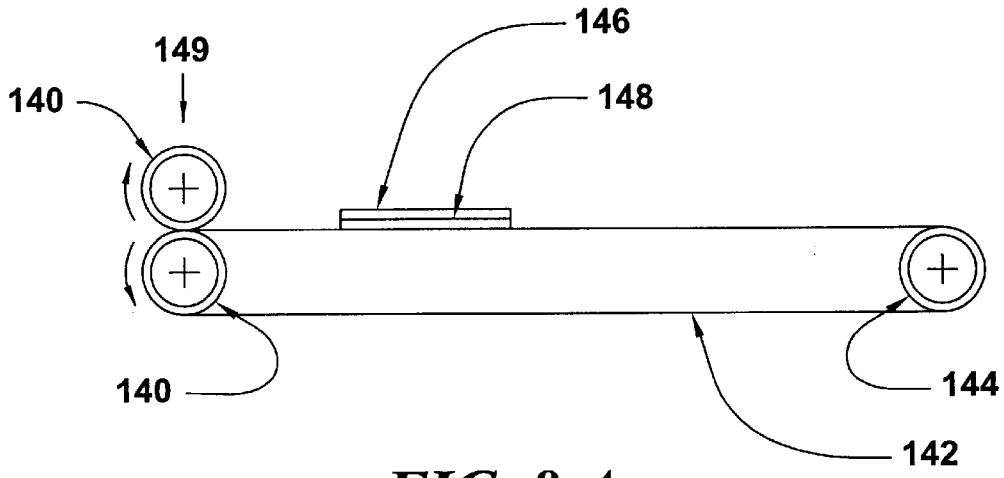
FIGS. 8A and B show cross-sectional views of a nipped belt disk carrier system.
Figure 8B:
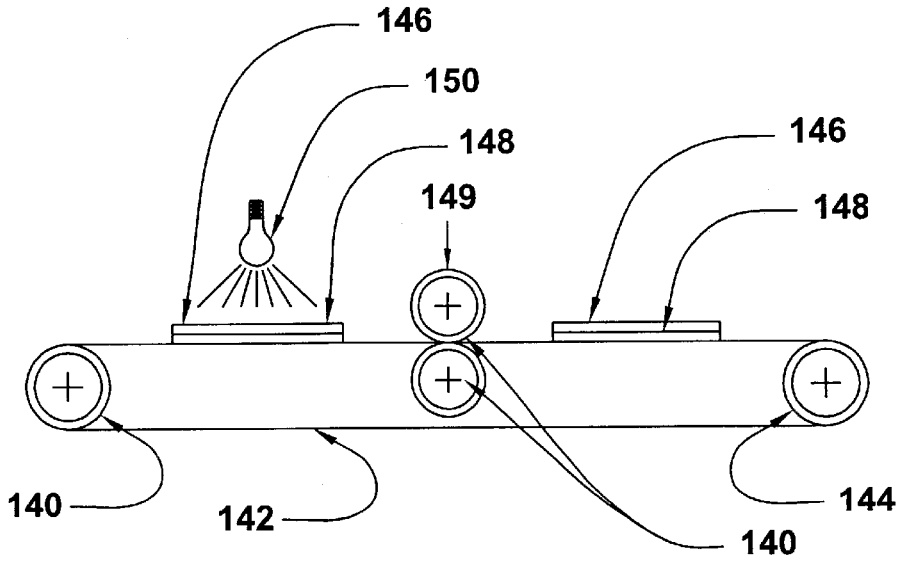

FIGS. 8A and B show cross-sectional views of a nipped belt disk carrier system. FIG. 8A shows a conveyor belt 142 mounted on a driven roll 144 and an idler roll 140 nipped to another idler roll 140 with a nip force 149. The belt 142 carries a sandwich of a resin coated transfer disk sheet 146 and a disk backing having raised island foundation 148 surfaces which are held in contact against the resin coating on the transfer sheet 146, where the sandwich is transported into the nipped rolls 140. FIG. 8B shows a conveyor belt 142 carrying a resin coated transfer sheet 146 in contact with an island backing sheet 148 into a nipped roll 140 set nipped by a force 149. A radiant or other heat or energy source 150 contacts the nipped sandwich of transfer sheet 146 and island backing sheet 148 after passing through the nipped rolls 140 to effect a partial cure solidification or cure of the resin.

Cushion Backing of Island Abrasive Sheets

Problem: It is desirable to provide a resilient cushion backing to a raised island abrasive particle coated disk which will allow each island to be conformably held to a workpiece surface as the abrasive disk moves relative to the workpiece. Uniform abrasive contact pressure assures even wear on the abrasive and allows the abrasive to conform to irregular or non-flat surfaces of the workpiece. It is important that all the diamond particles on an abrasive sheet be utilized.

Solution: Utilization of all the expensive diamond, or other, abrasive can be accomplished at slow or modest 500 to 2,000 surface feet per minute (152 to 610 meters per minute) or even slower abrasive speeds by adding a cushion pad layer to a raised island abrasive disk having a thin 0.003 inch (76.2 micrometer) thick polyester backing. The cushion pad may have a thickness of 0.031 to 0.250 inches (0.08 to 0.64 cm) or less and may be constructed of resilient, compressible plastic, including polyurethane foam, non-woven plastic fibers, felt or other materials. The cushion pad may be of a precise uniform thickness which can result in higher abrasive speed usage. The more that a cushion pad is compressed against a workpiece surface, the slower the abrasive lapping speed must be to allow time for the pad to locally compress and relax back to its original shape when contacting a workpiece. A wide variety of abrasive backing materials, pad thicknesses, raised island heights and sizes of abrasive particles can be optimized with different types of cushion pads. Cushion pad raised island abrasives can be used for hand-lap tools, continuous belts, belt strips and other article forms. Independent cushion pad islands can be constructed of compressible resilient foam material, including polyurethane foam, where the top surfaces of the raised foam islands are coated with a polymeric resin and abrasive particles are supported in the resin to form abrasive coated cushion pad islands where the islands may in patterned arrays in annular shapes, or other abrasive article shapes. Abrasive articles having independent foam island pads would be used at lower surface speed than abrasive articles having solid island foundation structures. A variety of abrasive articles can be constructed from continuous web sheets having these foam island structures.

Figure 9:
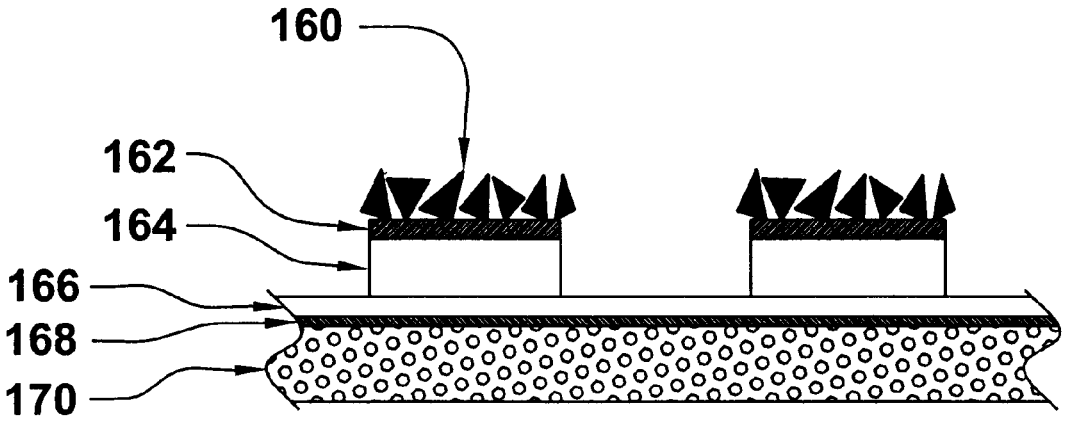
FIG. 9 shows a cross-sectional view of a raised island cushion pad abrasive article.

FIG. 9 shows a cross-sectional view of a raised island cushion pad abrasive article. Abrasive particles 160 are bonded with a resin layer 162 bonded to the top surface of a raised island foundation base 164 which is attached to a backing sheet 166 having a cushion pad 170 attached by a pad adhesive 168.

Spacer Plates for Stacked Abrasive Island Sheets

Problem: When multiple layers of abrasive particle coated island sheet disks are stacked during a manufacturing process step there is the possibility that valley gaps between islands on a sheet lower in the stack may affect the flatness or uniformity of the sheet stacked directly above. This is not a problem with the lowest sheet in the stack which would typically lie on a flat surface. Very thin backings with high raised islands can produce island top surface out-of-plane movement which may affect the flatness of abrasive particles bound in soft uncured resin coatings. This could be a particularly severe problem when resins are further softened in oven curing.

Solution: When individual disks are stacked for oven curing, the first abrasive raised island backing sheet in the stack can be positioned flat on a carrier plate which is both flat and smooth. Then a separator sheet of plastic or other material can be laid in flat contact with the abrasive particle surface of the raised islands which are coated on the wet uncured make coat resin. A stiff, flat and smooth divider plate is then laid on the surface of the separator sheet. Another abrasive powder coated island backing disk is laid on the top surface of the stiff divider plate to form the next layer group in the multi-layer sandwich. This process is repeated to form the abrasive disk stack where each island surface has a flat reference plane support in this multi-layer sandwich. A metal divider support plate conducts oven heat into the stack.

Figure 10:
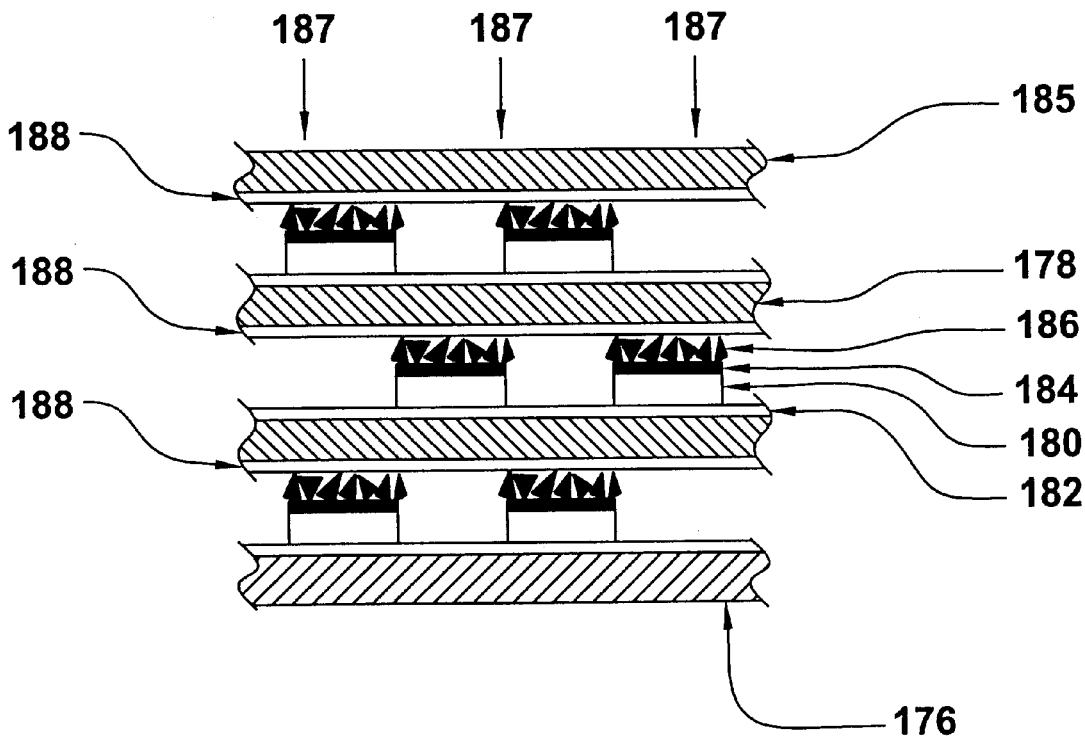
FIG. 10 shows a cross-sectional view of a stack of abrasive island sheets with spacer plates.

FIG. 10 shows a cross-sectional view of a stack of abrasive island sheets with spacer plates. A carrier plate 176 supports a stack of abrasive island disks which have a distributed force or weight 187 applied through a spreader plate 185. Each abrasive sheet consists of abrasive particles 186 bonded with wet resin 184 to the top surface of a raised island foundation 180 which is attached to a disk backing 182. Stiff or semi-stiff divider plates 178 allow each disk backing 182 to conform somewhat to the layers stacked below it.

Abrasive Coated Annular Ring Article

Problem: Fabricating a precision thickness abrasive disk by punching out an annular ring from abrasive coated web stock and laminating it to a sheet backing to provide a disk with a continuous surface across its full diameter is not desirable because of the potentially rough die cut circular edges and tangential or radial thickness variations of the composite disk due to variables in the laminating process.

Solution: A continuous coated abrasive disk article can be produced in an annular form shape by a batch process which will offer substantial cost savings as compared to other more traditional continuous web methods of manufacturing. A single abrasive disk can be produced in a sequence of manufacturing steps using many of the same materials of construction such as diamond abrasive particles, phenolic resins and polyethylene terephthalate backing that have been traditionally used in the abrasives industry. Here, only an annular ring of abrasive is coated on a disk backing as any abrasive particles located radially inside the annular ring are highly undesirable, and further, as particles located at this inside radius area are a waste of expensive abrasive materials. A make coat of resin is applied to a disk backing and abrasive particles are drop coated onto the resin. Resin is applied to a precision thickness flexible backing by spin coating a 10 micrometer thick make coat resin only on the outside periphery of the backing. Diamond or CBN (cubic boron nitride) abrasive particles can be drop-coated onto the wet resin. After partial curing of the resin, a size coat can be applied to the abrasive annular ring by spin coating or spray coating. The resin make coat can also be applied by spraying or transfer coating from a spin coated transfer sheet. An alternative coating method is to apply a thin coating of an abrasive particle filled abrasive slurry to an annular ring portion of a disk backing by spin coating the slurry mix on the backing. If it is desired that the outboard edge of the backing disk be free of abrasive, a pair of circular cutout mask patterns may be applied to the backing, leaving only an annular band of open area on the backing exposed. Then a thin resin make coat can be applied to the annular open area located between the masks. After removal of the masks, abrasive particles are drop coated on the wet resin, and the resin may be partially cured, or not cured. A resin size coat can then be sprayed on, even if the make coat resin is not cured. If the make coat is partially cured, a size coat can be spin coated on the abrasive annular ring. The spin-on resin would also coat the abrasive particle-free outboard disk annular ring area boundary which is not objectionable. These techniques of forming annular abrasive disks can be used with disks as small as 0.5 inch (1.27 cm) diameter and to disks as large as 60 inches (152 cm) diameter and may utilize diamond or CBN abrasive particles from 0.1 micrometer to 300 micrometer size. When spin coating is used, the resin may be applied in a stream only at the inner annular ring radius and flowed outward by the centrifugal forces due to the spinning action, or the resin stream may be applied by moving the stream radially during the spinning action. Likewise a single wide spray head may be used, or a narrow spray orifice head may be moved radially while the disk is rotated under the spray head to form the annular ring.

Figure 11A:
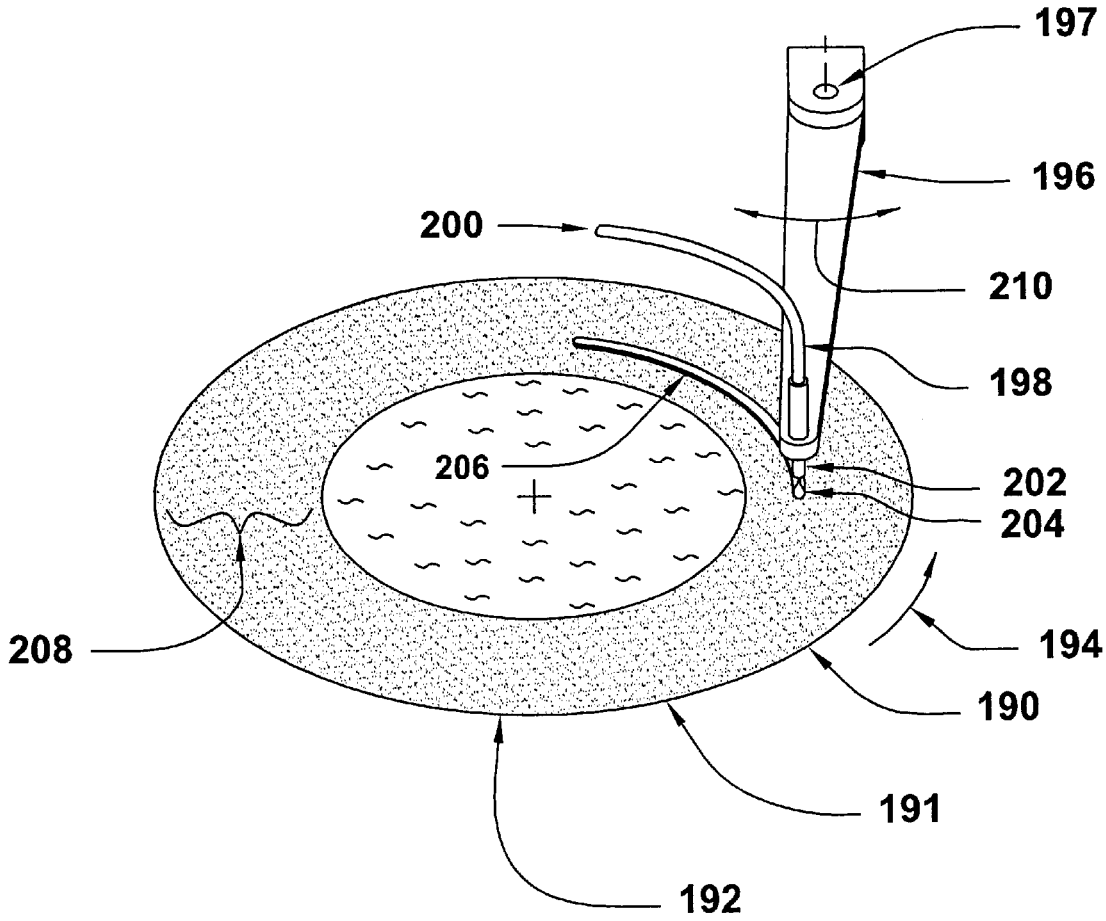
FIGS. 11A, B and C are isometric views of abrasive annular disk manufacturing techniques.
Figure 11B:
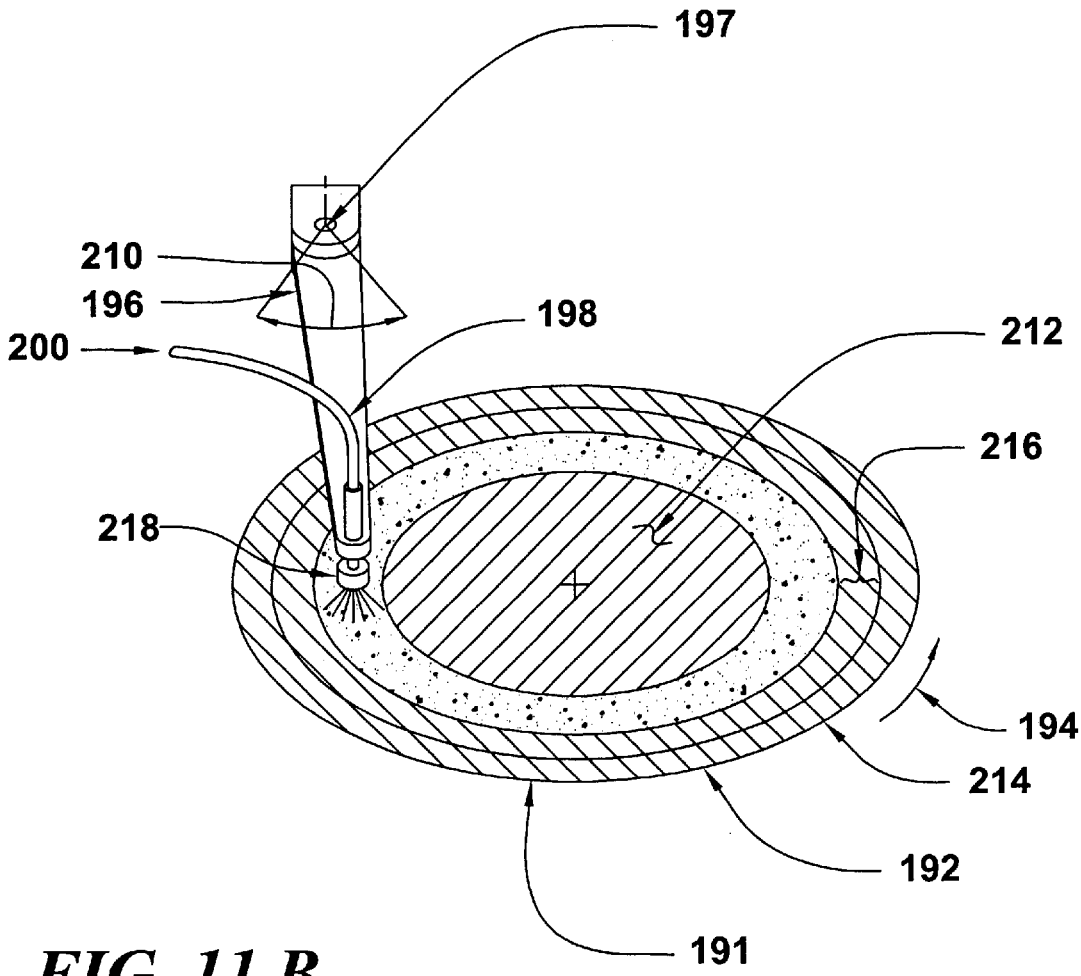

FIGS. 11A, B and C are isometric views of abrasive annular disk manufacturing techniques. FIG. 11A shows a disk-backing sheet 191 mounted on a platen 192 which has a spin coating rotation 194. Liquid resin enters a resin hollow tube 198 at an inlet 200 and the tube is mounted on a pivot arm 196 attached to a pivot joint 197 which allows a resin deposition stream 204 exiting from a resin head 202 to create tracks of resin 206 on the disk backing sheet 191 at the inner radial portion of an annular band of resin 208 which is created by centrifugal force which carries the resin track radially outward to develop a uniform thin layer of resin over the whole annular band 208 resin area. The resulting annular abrasive disk 190 will have the same size and shape as the disk backing 191 and annular resin band 208 after abrasive particles (not shown) are deposited. If it is desired to have an outboard border of the abrasive disk free of abrasive particles, a disk could be spin coated with resin extending across the full radial area of the annular band up to the edge of the disk backing. Prior to drop coating of abrasive particles, a circular cutout masking sheet having an inner diameter equal to the inside diameter of the protected border can be brought into contact with the outboard resin. Then the abrasive particles can be drop-coated onto the resin-exposed portion of the annular disk. When the outer mask sheet is removed, the outer border of the abrasive disk will be free of abrasive particle FIG. 11B shows a isometric view of a traversing spray head which can be used with masking font sheets to create an annular abrasive disk which has an outer border free of abrasive particles. The mask sheets can be used with different coating or abrasive particle drop coating techniques. First, the two inner and outer mask sheets can be used to leave only an annular band area exposed for spray coating of the resin, which would be followed by drop-coating of abrasive particles. Another technique would be to protect only the inner portion of the backing with a mask and then spray coat resin over the remaining backing surface. If an abrasive particle free border is desired, an outer radial mask can be placed over the resin wetted backing to protect the outer border from abrasive particles which are drop coated on the annular area only. The outer radial mask is removed prior to cure solidification of the resin. The make coat of the resin applied at this stage of the process is typically only about one third the depth or thickness of the abrasive particle diameters so the outer border disk boundary of resin would not impede the cutting action of the abrasive particles. A disk-backing sheet 191 is mounted on a platen 192 which is rotated at a controlled velocity 194. An outer annular ring shaped shield mask 214 and an inner circular disk shaped shield mask 212 are positioned in direct contact with the backing sheet 191 to protect a resin free outer border area 216 from a spray head 218 which applies liquid resin over the annular ring exposed area of the disk backing 191. A resin inlet 200 supplies liquid resin to a resin tubing 198 which is mounted to a pivot arm 196 attached to a pivot joint 197 which traverses over an angle 210 which is given a controlled motion to obtain uniform resin thickness over the full exposed annular area of the backing 191. A single pass of the backing under the spray head 218 may be used or multiple rotations of the platen may be used to evenly distribute the resin over the surface with a variety of platen rotation speeds and speed profiles. A fixed measured quantity of resin may be sprayed on a given disk backing 191.

Figure 11C:
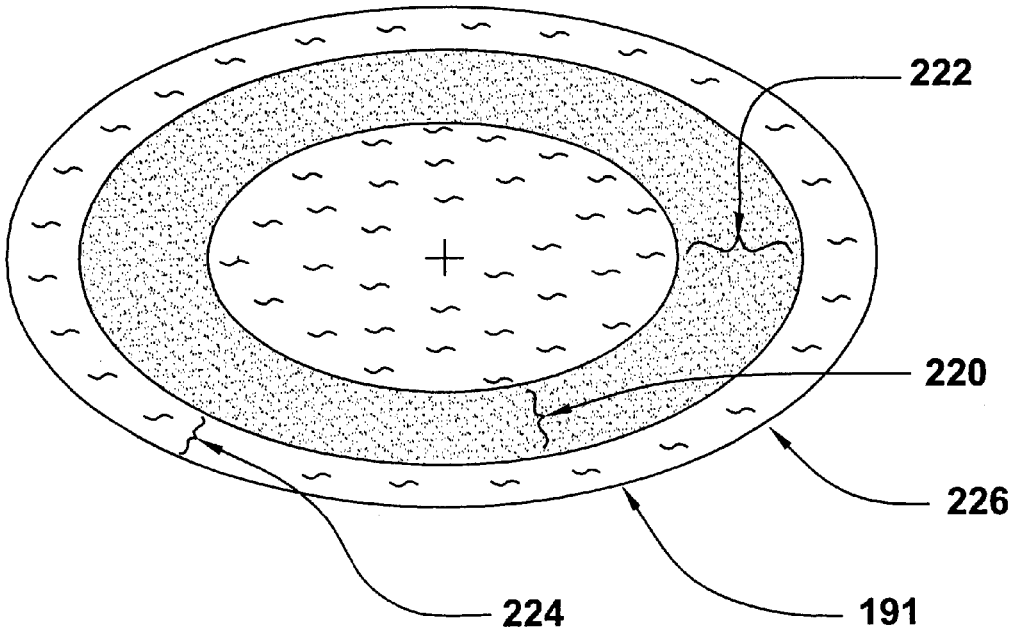

FIG. 11C shows a top view of a disk backing 191 with an annular ring of resin 220 which has a drop-coated abrasive particle annular band 222. An outer border area 224 of the annular abrasive disk 226 is free of abrasive particles and in one alternative application, the outer border area 224 can be free of resin coating.

Drop Abrasive Particles on Raised Islands

Problem: It is necessary to achieve open gap spacing between individual abrasive particles which are bonded to the top surfaces of raised island foundation bases for effective abrading action. If the particles are positioned directly adjacent to each other, the abrasive article tends toward having a characteristically smooth abrasive surface and the material removal cut rate is very reduced compared to an abrasive article having substantial gaps between individual particles. An abrasive article with a surface of closely spaced abrasive particles performs more as a bearing surface than a cutting surface particularly when used with water as a abrasive coolant or lubricant. If an excess of particles are dropped on a wet resin surface very few gaps will exist between the particles.

Solution: A number of techniques can be employed to obtain gaps between individual particles where the gap openings may range from 20 percent to 90 percent of the surface area where the particles cover as low as 10 percent and up to 80 percent of the island surfaces. A very fine screen mesh may be used as a head on a "salt shaker" particle drop coating device which is shaken or vibrated a range of distances above a wet resin coated disk or sheet having raised islands. Use of a small 1.0 inch (2.54 cm) diameter shaker screen head positioned 12.0 inches (30.5 cm) above a resin surface will produce wider particle gaps than if the head is positioned 6.0 inches (15.2 cm) above the resin. A variety of filler materials may be applied to the resin surface along with the abrasive particles with the result the filler material acts as a gap spacer between the abrasive particles. The filler material may be removed by solvents, mechanical means such as sand blasting, or it may be left in place to abrade away when the abrasive article is in use. Another technique to effect particle gap spacing is to apply a thin coat of resin which is activated by a light or energy source projected through a screen mesh font and the non-light activated resin washed away, leaving a fine grid pattern of partially cured resin. This resin can be re-wetted by use of heat or other light source energy or solvents to provide open-gap anchor sites for abrasive particles which are drop coated on the raised island surfaces.

Figure 12:
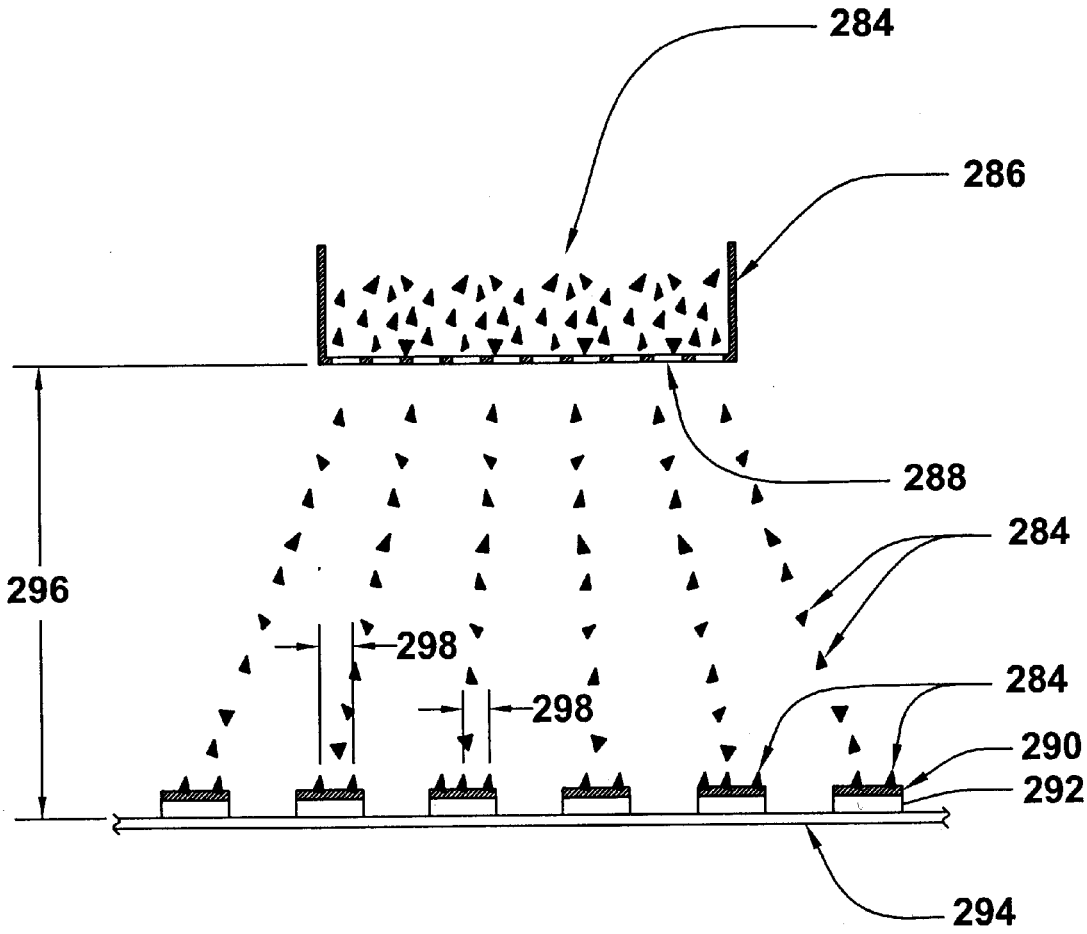
FIG. 12 shows a side view of a particle shaker box drop coating abrasive particles on raised islands.

FIG. 12 shows a side view of a particle shaker box drop coating abrasive particles on raised islands. Abrasive particles 284 are drop coated on wet resin 290 coated raised island foundations 292 which are attached to a flexible backing sheet 294. Abrasive particles 284 are held in a particle shaker container box 286 which has a fine mesh screen 288 at the bottom of the box to evenly distribute particles 284 as they free fall from the screen to the resin coated 290 island foundations 292. Abrasive particles 284 are sparsely separated on the islands 292 by a distance 298.

Abrasive Particle Drop Slitted Shield

Problem: It is important to have gap spacing between adjacent abrasive particles which are bonded to a make coat of resin to maximize the cutting action of each particle. A uniform distribution of sparsely spaced particles would provide the best cutting action.

Solution: A slotted shield device can be placed over the area of an annular disk where abrasive particles are allowed to free-fall vertically downward to the disk from a particle shaker screen device. A narrow slot opening in the particle shield would only allow particles within the slot changeable width open area to continue their trajectory until contacting the wet make coat resin on the disk annular area. The particle shaker source device would be constructed to provide a uniform distribution of particles across the width of the annular band; and also, the shaker would control the particle flow rate density of particles per minute per square inch of surface area. The annular disk would be rotated over different speeds where a faster speed would result in a sparser particle density on the surface of the annular ring. This technique of sparse particle coating can be used for a uniform abrasive particle coated surface or for raised island surfaces of any shape. The slot can also be used for electrostatic particle coating or for a particle spray stream where particles are driven toward the disk by being dropped on a wheel surface which propels the particles toward the disk backing. Particles can be introduced into an aspirated venturi nozzle and sprayed toward the slot shield. Excess particles can be collected and reused. Also, a fixed quantity of abrasive particles can be used per disk with multiple disk revolutions, as this fixed quantity is drop coated progressively on the disk wetted resin surface. Use of a fixed quantity of abrasive particles per abrasive disk assures that each disk has its desired total quantity of particles, and that they are properly distributed with gap spacing between particles which results in consistent abrasive action of each abrasive disk. Further, the abrasive particle distribution density, of the number of particles per square centimeter, can be controlled over the radial annular position on an annular abrasive disk. This distribution control can be accomplished by drop coating a large proportion of the particles on the outer annular disk radius, as compared to the inner disk radius, as the resin wetted disk backing is rotated under a small-sized abrasive particle-drop shaker head.

Figure 13A:
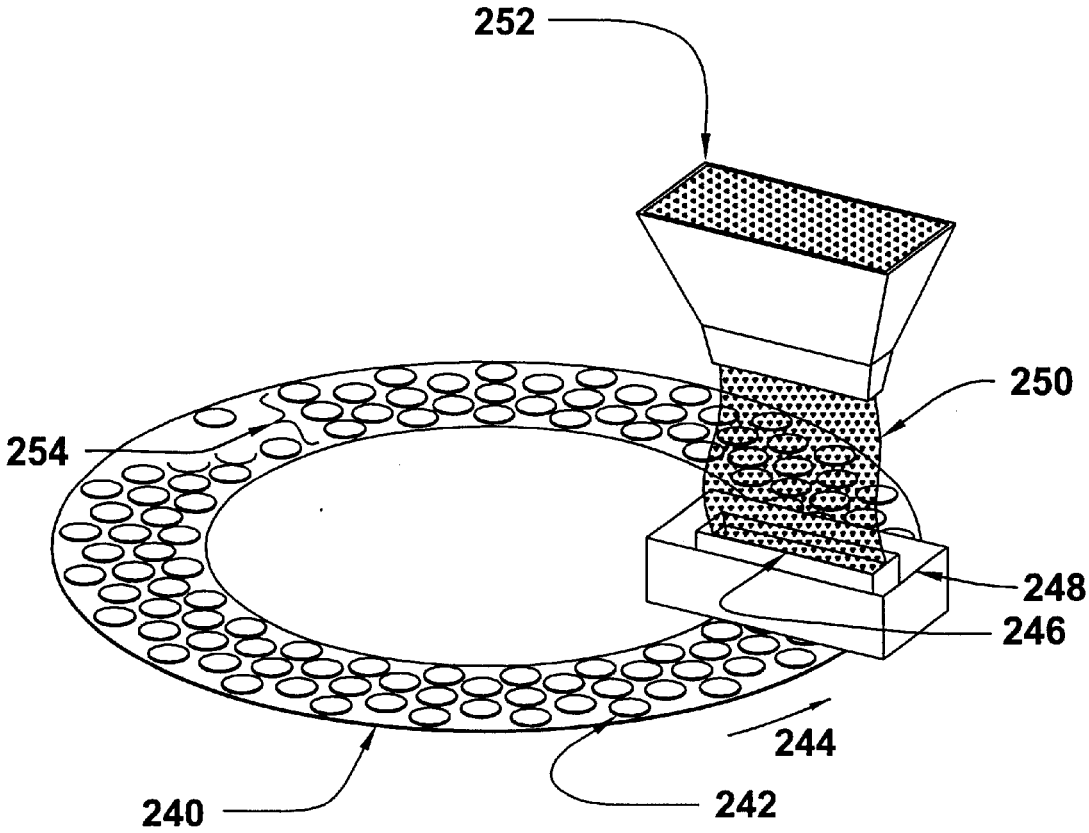
FIGS. 13A, B and C are top views and isometric views of an abrasive particle drop coating abrasive shield and particle coated islands.
Figure 13B:
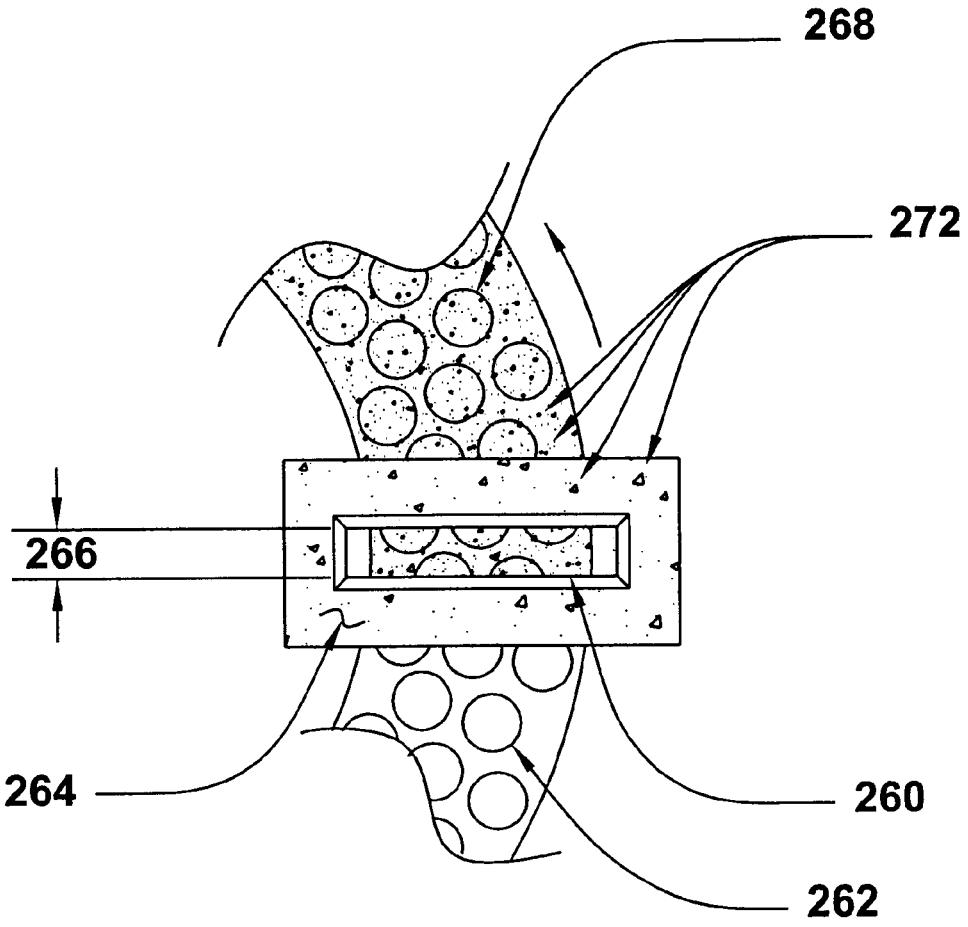
Figure 13C:
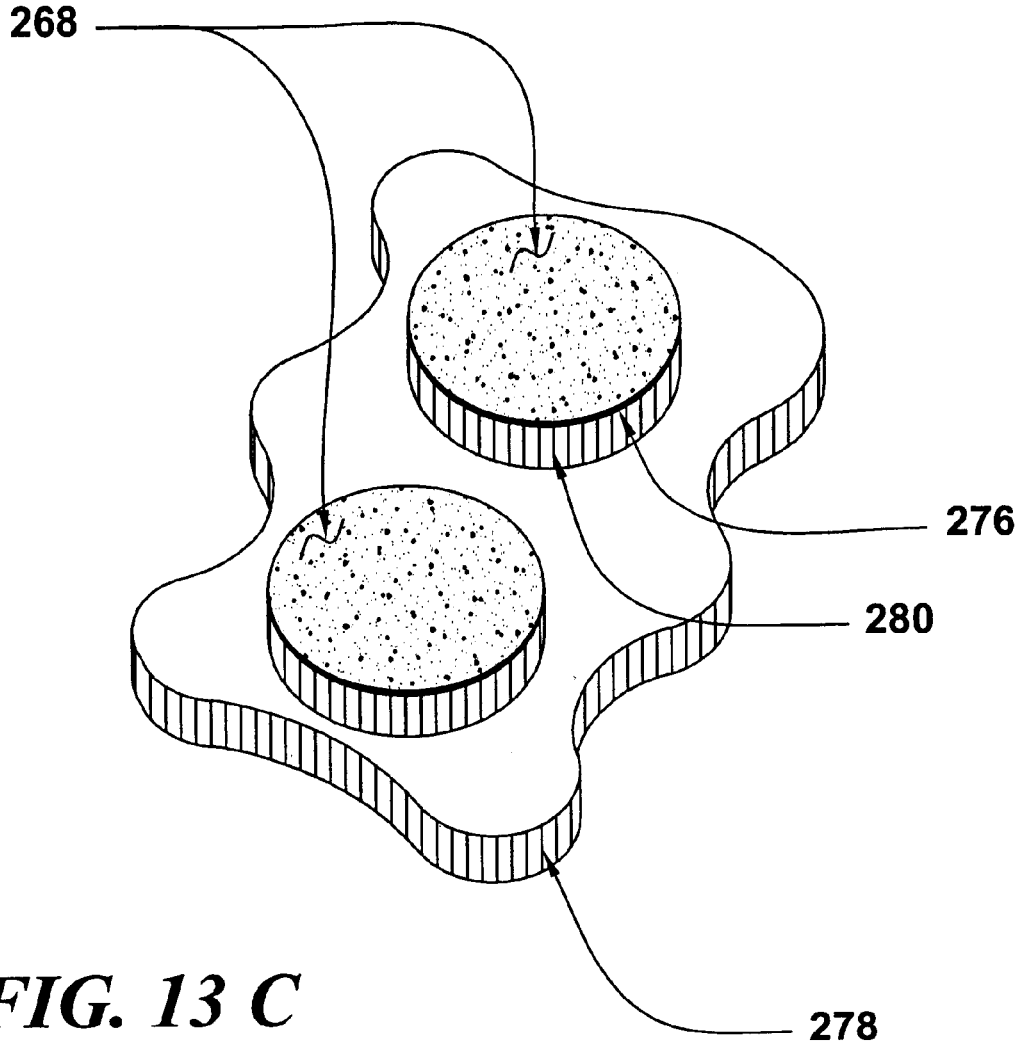

FIG. 13A shows a top view of an annular disk 240 having raised island foundations 242 arranged in an annular band 254 where the disk 240 has a rotational velocity 244. Free-fall abrasive particles 250 are distributed downward toward the wet resin coated (not shown) raised islands 242 in the area of a particle shield box 248 having raised walls. A slotted opening 246 in the shield box 248 is narrow in a direction along the tangential path of the annular band of islands 254 with a more narrow slot reducing the surface density of the abrasive particles which impact the wetted resin coated islands 242. The abrasive particle shaker box 252 can be mechanically adjusted or the shaker vibration amplitude or frequency changed to increase or decrease the flow rate of the abrasive particles dropped on the shield box. The spacing of particles on the resin-wetted islands can also be changed by increasing the rotational velocity 244 of the abrasive disk 240. The disk 240 may be rotated with different velocity profiles during the process of drop coating abrasive particles on its surface. A fixed quantity of abrasive particles may be coated on a specific annular disk 240 with a single rotation of the disk, or alternatively, the fixed quantity may be dispersed over multiple rotations of the disk 240 where some proportion of the particles are brought into contact with the wet resin each revolution. FIG. 13B shows an enlarged view of the particle shield box which has a shield floor 264 covered with excess loose abrasive particles 272 and shield box walls with a slot 260 with a specific downstream width 266. The abrasive disk has abrasive particle coated islands 268. FIG. 13C shows isometric views of two wet resin 276 coated raised islands 280 attached to a disk backing 278 having sparsely coated abrasive particle islands 268.

Raised Island Daisy Wheel Disk

Problem: It is difficult to grind a glass or plastic lens smooth with a raised island daisy wheel disk having electroplated diamond particles. Here the individual diamond abrasive particles, which tend to be positioned above the average height of the abrasive surface, will produce scratches in the workpiece surface. Abrasive particles located at the inner radius of the disk provides little abrasive cutting due to low surface speed.

Solution: A daisy wheel disk can be constructed in a typical configuration where five or more spokes protrude from a common hub on a flexible backing. A variety of shapes of island patterns, including circular shapes, can be deposited or attached to the outer periphery of the daisy wheel spokes. Only a few islands would be used at the inner radius, or optionally, no islands would be present at the very center of the daisy wheel disk. After the island foundations are attached to the backing and ground flat, a thin coat of resin can be coated only on the designated island foundations by use of a circular flexible resin transfer sheet which is pressed conformably to the island foundation surfaces to transfer approximately one half the thickness of the resin to the foundation surfaces. Then diamond or other abrasive such as CBN or aluminum oxide is drop coated onto the wet resin surface coated island tops. Each abrasive particle will lie flat on the top surface of each island and will remove material from a concave or convex surface because of the flexing of each spoke. The lense surface will be smooth, as there are no "high" abrasive particles. As an alternative, some or all of the raised islands may not be coated with abrasive but the raised island structures would allow passage of cooling water, or other fluids, or grinding agents including abrasive particles, and debris but yet support the central radial portion of the daisy wheel abrasive article against the lens when the daisy wheel is used for polishing.

Figure 14:
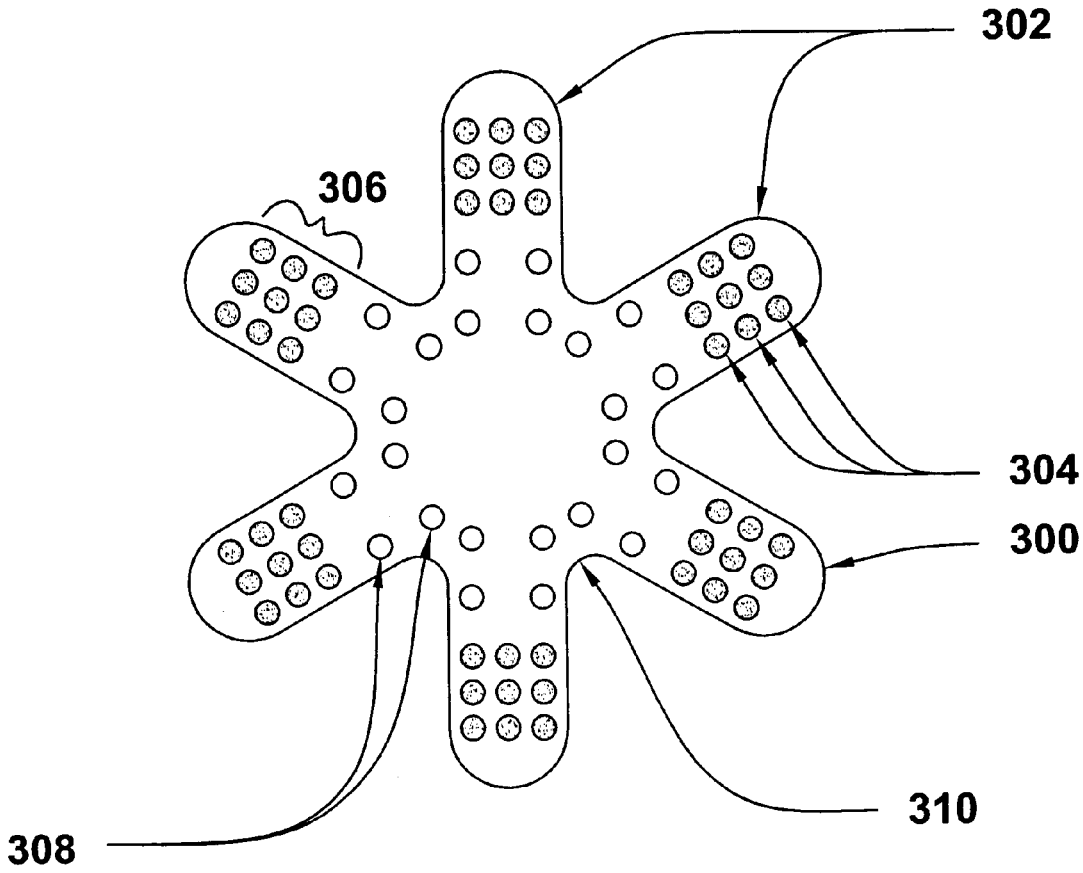
FIG. 14 shows a top view of a daisy wheel abrasive article.

FIG. 14 shows a daisy wheel disk 300 constructed of raised islands 304 and 308 attached to a flexible cutout shaped disk-backing sheet 310. The group 306 of raised islands 304 located on the spokes 302 of the daisy wheel disk 300 are coated with abrasive particles. The islands 308 located in the central portion of the daisy wheel optionally may not be coated with abrasive particles, or, they may also be coated with abrasive particles.

Electrostatic Abrasive Powder Transfer Sheet

Problem: It is difficult to adhesively bond abrasive particles to the surface of raised island foundations attached to a flexible backing sheet where each particle has a uniform gap spacing between adjacent particles. The preferred shape of the abrasive sheet article is an annular area of an array of raised abrasive coated islands integrally attached to a continuous circular-backing sheet. It is important to utilize as much of the typically expensive diamond or CBN abrasive particles as possible in the process with little or no waste. It is also important that each abrasive article have a controlled minimum and maximum quantity of particles on each disk for consistency of abrading performance.

Solution: An abrasive particle transfer process can be used where the abrasive particles are temporarily attached to an annular ring surface on a particle transfer sheet by an electrostatic coating process. These abrasive particles can be held attractively to a thin plastic, or other material, backing sheet by placing the sheet over the exposed surface of a electrical ground plate which is machined from metal into a flat annular ring form. The diamond, CBN, aluminum oxide, or other particles, can be electrostatically charged and then can be projected to the exposed surface of the abrasive particle transfer sheet in a manner where the particles are randomly scattered over the sheet in an annular pattern with a uniform nominal or statistical controlled spacing between each particle. A measured fixed quantity of abrasive can be progressively applied to the annular ring shape by rotating the annular sheet covered ground plate during a particle coating time period to allow the particles to be ejected toward the plate. The electrostatic source of particles can be moved radially across the surface of the rotating ground plate to increase the deposition density at the outer annular ring if desired to present a higher density of particles at the outer radius increased surface velocity of the abrasive disk article. After all of the fixed quantity of particles are attached by electrostatic bonding to the transfer sheet, a wet resin coated raised island foundation backing sheet, which has raised islands in an annular shape geometrically corresponding to the abrasive particle annular ground plate, is aligned and pressed into contact with the abrasive particles. These loose abrasive particles will become preferentially attached to the resin wetted island surfaces so when the raised island sheet is separated from the ground plate, each raised island will be coated with abrasive particles. Abrasive particles not wetted by the resin adhesive will remain on the ground plate backing sheet and can be recovered for future use by removal of the adhesive backing sheet from the ground plate. The ground abrasive sheet, which may be contaminated by wet resin, may be discarded. The raised island backing sheet may optionally be removed from the particle when the resin is wet, partially solidified or fully solidified. A heated ground plate can be used to effect a thermal partial or full cure of the resin prior to removal of the island backing sheet.

By pressing the island backing plate flat down on the surface of the particle transfer plate and holding it pressed together until the resin partially solidifies, the wetted resin located at the outer periphery of each island is molded flat to the exposed surface of the abrasive sheet and prevents the resin from raising above the plane of the island surface. The island foundations will be ground or machined to a uniform flat height as measured from the bottom side of the abrasive article backing sheet so that the raised height variation of each island is within 50 percent of the nominal diameter of the abrasive particles and preferred to be within 20 percent the diameter of the abrasive particles. The flat molded resin bead located at the outer periphery of each island top surface edge of the resin would tend to form a smooth rounded surface around the top edge of the raised island. This rounded bead edge would structurally reinforce the island edge and seal any loose island foundation structure fragments which are loosened or weakened by the island foundation flat grinding process.

To assure a consistent quality of abrading action, a fixed weight or volume quantity of abrasive particle powder can be premeasured prior to deposition on a specific abrasive article transfer sheet. The excess particles not bonded to the island top surfaces can be recovered for reuse.

Figure 15A:
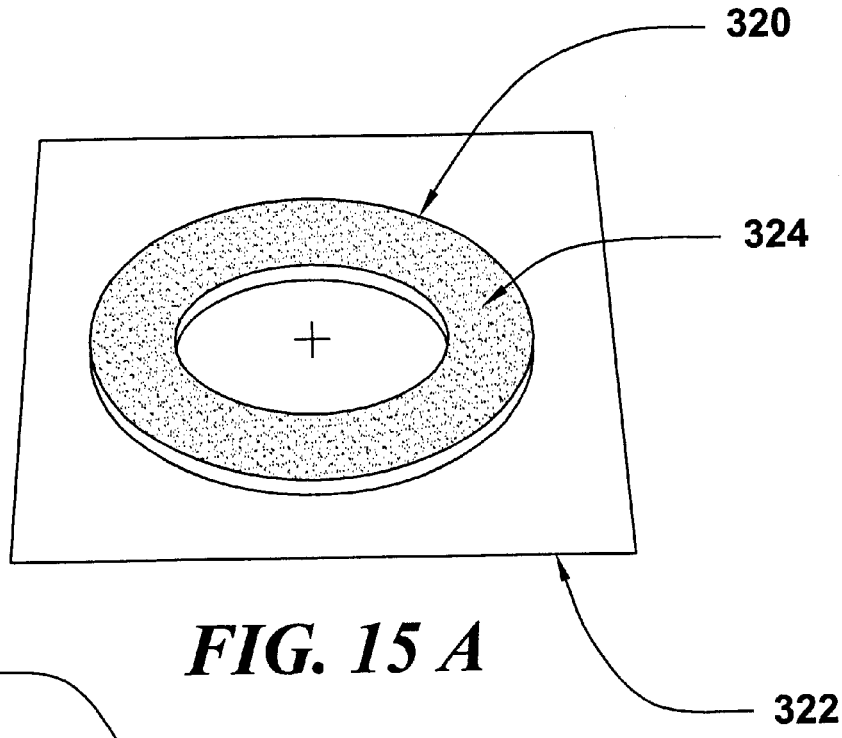
FIG. 15A shows an isometric view of an abrasive particle transfer sheet.
Figure 15B:
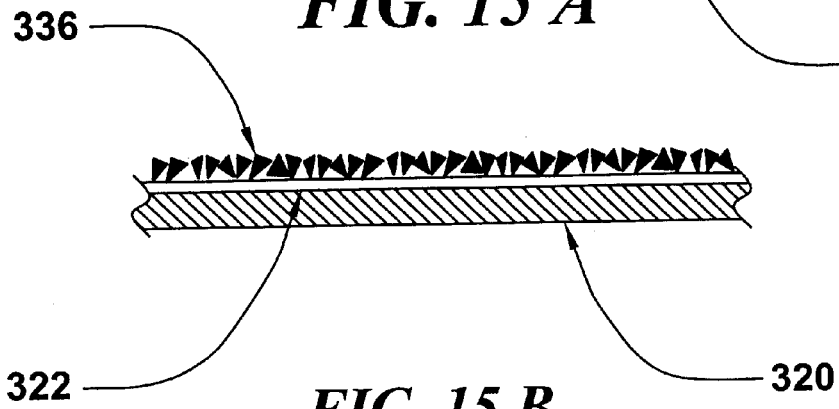
FIG. 15B shows a side view of an abrasive particle transfer sheet.
Figure 15C:
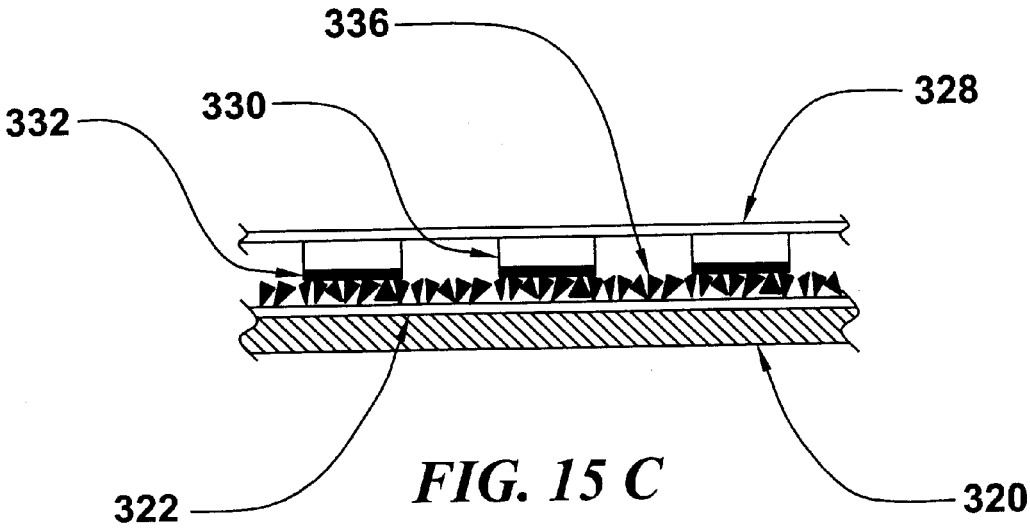
FIG. 15C shows a side view of a raised island backing in contact with a particle transfer sheet.

FIGS. 15A, 15B and 15C show isometric and side views of the powder transfer process. FIG. 15A shows a powder transfer sheet 322 with an annular area of abrasive powder coating 324 directly above the annular shape of an electrical ground plate 320. FIG. 15B shows a cross section view of the ground plate 320 with a transfer sheet 322 coated with abrasive particles 336. FIG. 15C shows a cross section of abrasive article backing sheet 328 with integrally attached raised island foundations 330 coated with an adhesive resin 332 in contact at the island resin wetted surfaces with abrasive particles 336 electrostatically bonded, and also held by gravity, to the transfer sheet 322 which is attached by gravity or static charge to the ground plate 320.

Electrostatic Island Ground Pin Coating

Problem: It is desired to apply an exact amount of abrasive particle powder to a specific sized raised island annular ring and to distribute the powder evenly across the surface of the raised islands with gap spaces between each abrasive particle. Application of all the fixed weight or volume quantity of powder to the abrasive island surfaces, without the loss of the powder which contacts the valleys between the raised islands, is desirable as compared to collecting, rescreening and redepositing the portion of powder lost in the island valleys. Annular ring patterns of circular raised island disk articles are the example form of abrasive articles presented here but the same difficulties exist for the production of continuous web abrasive sheet material.

Solution: The abrasive particle powder can be applied exclusively to the island surfaces by use of: electrostatic powder coating; a thin transfer sheet; and a ground plate having conductive island shapes which have a geometric replication of the island foundation shapes on the abrasive article. An electrically conductive ground plate can be constructed for an annular shaped island area pattern by drilling through-holes in a plastic plate where the holes have the same diameter and location as the raised foundation material islands of the abrasive article. Metal pins are inserted into the drilled holes with the flat surface of each pin positioned flush with the flat surface of the drilled nonconductive plastic plate. All the metal pins are electrically grounded with wire or other means so that each pin acts as a grounded surface. A thin sheet of plastic or paper which has limited electrical conductivity is attached to the flat pin surface of the island pin plate and the plate is attached to a rotatable spindle which can be positioned for the plastic, or paper, backing to be rotated in a vertical direction, or it can be mounted to be facing downward. Abrasive particles are then propelled from some distance from the sheet toward the sheet and are collected exclusively at the surface areas of the island ground pins as the pin plate is rotated, depositing particles with a uniform distribution across each island of the annular ring island pattern. Then a backing sheet having resin wetted raised islands of the same geometric shapes, size and position as the island pin plate is brought into contact with the pin plate sheet having abrasive particles attached. Concentric and rotational alignment of the individual islands of both the raised island backing sheet and the pin transfer sheet will effect a transfer of each particle to the resin wetted raised islands. The individual abrasive particles are then transferred from the transfer sheet to the island tops as the wet resin adhesive bonding action is stronger than the electrostatic bonding action, particularly if the resin is partially solidified prior to separation of the abrasive island backing sheet from the particle transfer sheet.

Figure 16A:
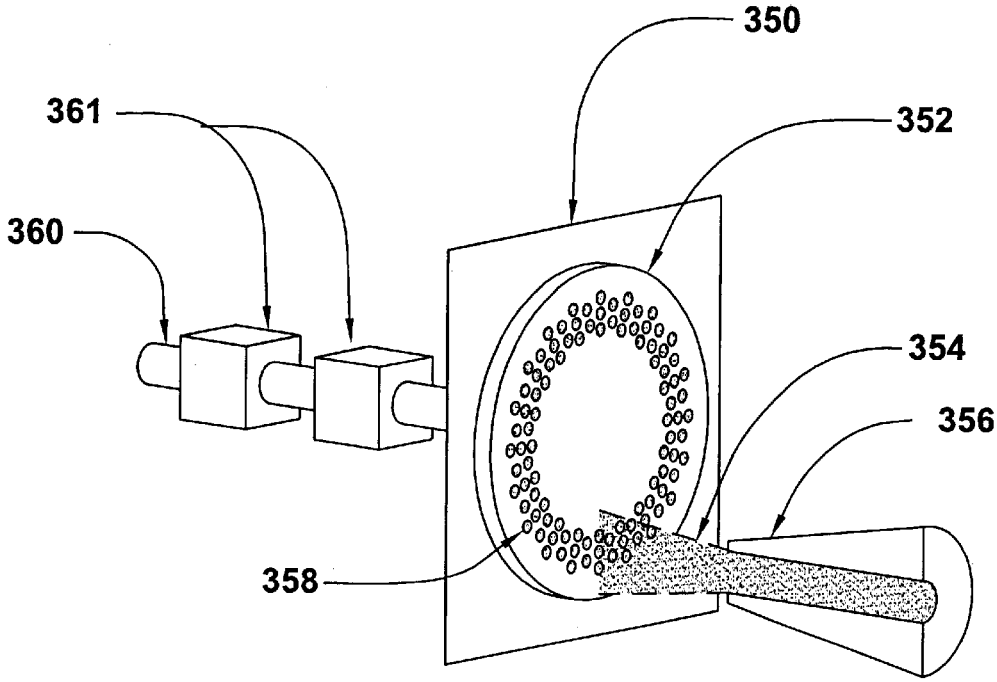
FIG. 16A shows an isometric view of electrostatic particle coating of a vertical island backing sheet.
Figure 16B:
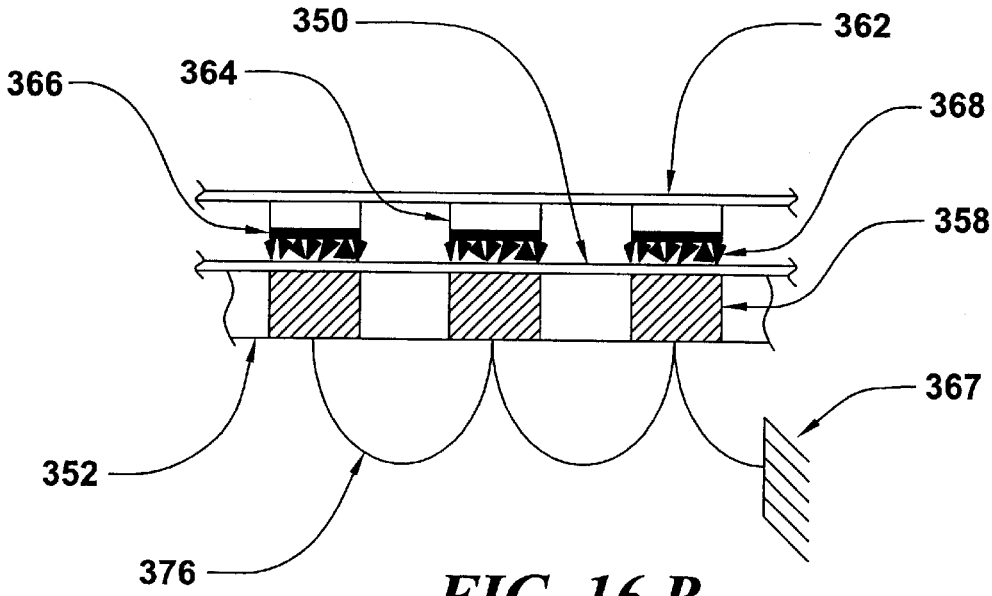
FIG. 16B shows a side view of an electrostatic raised island sheet.

FIG. 16A shows a particle transfer sheet 350 mounted vertically by vacuum, pressure sensitive or static charge on a rotatable ground-pin 358 platen plate 352 mounted to a shaft 360 supported by bearings 361. An electrostatic particle ejection head 356 propels abrasive particles 354 toward the annular ring of ground pins 358 which are covered by the plastic, paper or cloth particle transfer sheet 350. FIG. 16B shows a cross-sectional view of a platen plate 352 with integral ground pins 358 commonly attached by a wire 376 to a common ground source 367 with a particle transfer sheet 350 attached to the ground plate 352. Individual abrasive particles 368 are shown in common contact with both the transfer sheet 350 and the adhesive resin 366 coated platen island foundations 364 attached to the abrasive article backing sheet 362 at the location of the ground pins 358.

Narrow and Wide Powder Shaker

Problem: It is important to create a uniform surface layer of abrasive particles over the full radius of an annular band of raised islands on an abrasive article. Also it can be desirable to have concentric bands of different diameters of abrasive particles attached to a single abrasive disk.

Solution: An annular disk array of raised islands can be wet-resin coated on the island surfaces only and abrasive particles drop-coated onto the islands with a particle shaker device. The shaker can be either a wide particle screen device which bridges the annular width of islands with multiple revolutions of the annular disk during particle drop coating; or a small particle drop head can be traversed radially to create adjacent serpentine abrasive particle bands on the annular island pattern. The wide powder shaker screen box spans the width of the annular width of the raised islands. Abrasive particles are drop coated over the annular ring which is rotated at least one revolution but preferable five or six times during the progressive application of the particle powder to diminish the discontinuity of the stop and start lines when the powder deposition is first started and later in the deposition process when dropping the powder is stopped. The screen shaker box can be vibrated with varying amounts of oscillation amplitude to increase or decrease the density of the particles deposited, especially at the stop and start lines. Excess abrasive particles falling in the valley gaps between the islands can be collected and recycled for particle coatings. The wide screen box can be overhung at both the inner and the outer radius of the annular band of raised to create a uniform particle density over the annular ring. The excess particles of the outer and inner radius can also be collected and recycled. Narrow screen boxes can be used to create separate bands of different types of abrasive; and also, to create serpentine single bands of abrasive on an annular disk. Separate raised island annular bands of different diameter or different types of abrasive particles can be attached to a single abrasive disk by use of one or more narrow particle shaker boxes, each of which would deposit particles in annular bands on a resin wetted disk. The radial width of the annular bands can equal the radial width of the particle shaker box. Two or more different sized particles may be applied at the same time by use of two or more different shaker boxes, each located in a stationary position above a rotating resin wetted disk backing. A significant radial gap can exist between the two particle size bands to provide a physical transition area for use to rough grind a workpiece on the larger diameter abrasive particle annular band and then move the workpiece radially to the smaller diameter abrasive particle band for final polishing. The same technique of attaching two or more different sized abrasive particles to a single abrasive disk article can be used for single rectangular sheets and single endless belts of raised island abrasive articles.

Figure 17A:
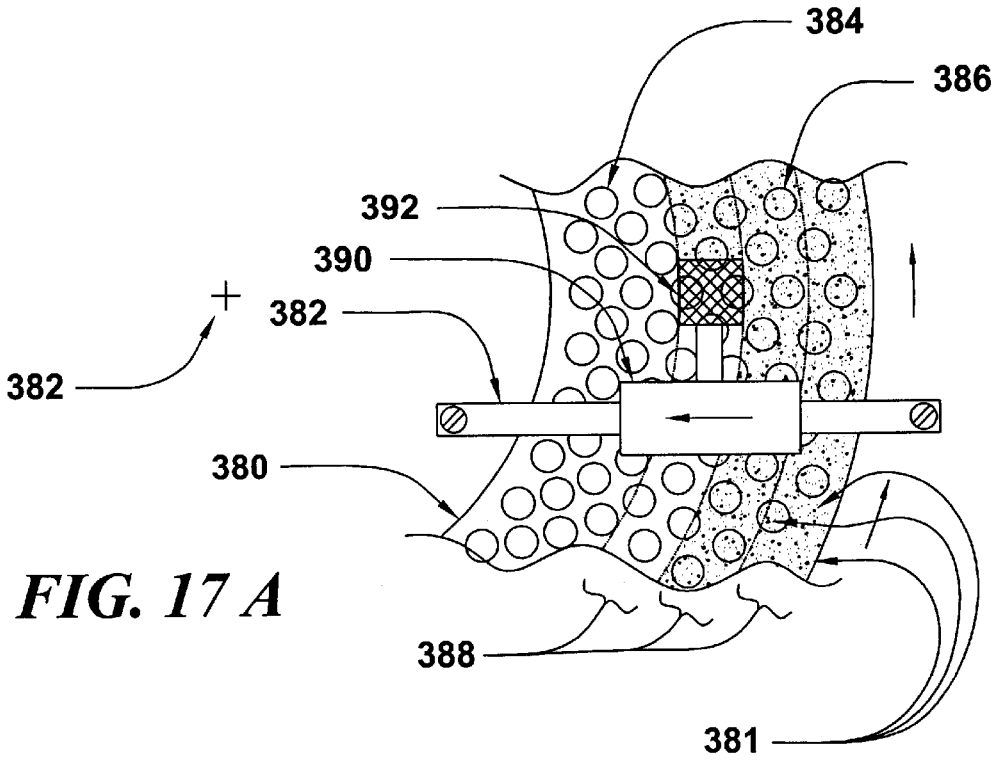
FIG. 17A shows a top view of a narrow particle drop box.
Figure 17B:
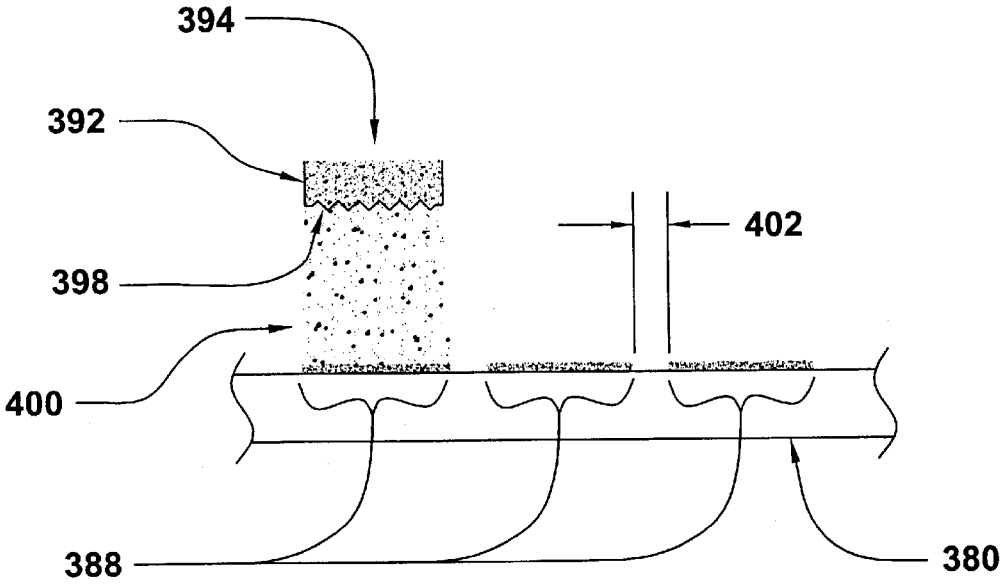
FIG. 17B shows a side view of a narrow particle drop box.
Figure 18:
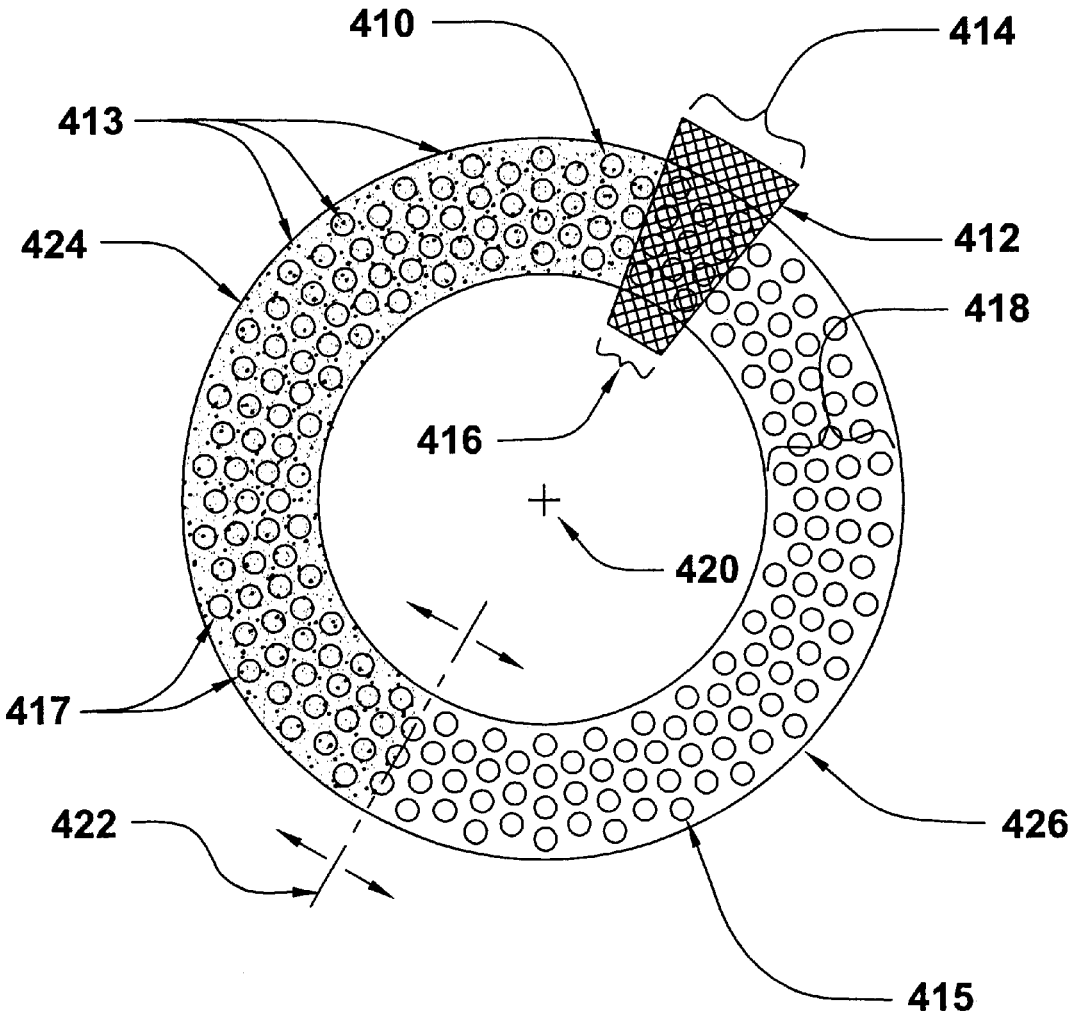
FIG. 18 shows a top view of a particle drop box for an annular abrasive sheet.

FIGS. 17A, 17B and 18 show two different techniques to coat abrasive particles on an annular disk with minimum discontinuities in the powder area paths. FIG. 17A shows a top view of an abrasive disk backing 380 having integral resin wetted island foundations without particle coating 384 and foundations with particle coating 386. The disk backing 380 is rotated about a center 382 under a radially traversing narrow particle shaker head 392 mounted on a slide mechanism 390 traversing on a stationary slide rail 382. Abrasive particles 381 are deposited in particle powder paths 388 which form serpentine paths along the radius of the backing 380. FIG. 17B shows a cross sectional view of bulk abrasive particles 394 contained in a particle shaker 392 having a mesh screen bottom 398 depositing falling particles 400 in particle powder paths 388 on a backing 380. Gaps 402 between the powder paths 388 are formed when the traversing shaker 392 traverses radially at a proportional speed greater than desired relative to the backing 380 rotational speed. Likewise, but not shown, there will be an overlap of the powder paths 388 if the radial traversing speed is too low relative to the rotational speed. FIG. 18 shows a top view of a continuous abrasive article disk backing sheet 424 having an integral annular area of raised islands 418 where the sheet 424 is attached to a rotatable platen 426 located under an abrasive particle screen shaker head 412 having a wider section 414 at the outer radius of the annular area 418 and proportionally narrow section 416 at the inner annular radius. The platen 426 rotates about a center 420 and abrasive particles 413 are shown deposited on approximately one half of the sheet 424 as shown by an abrasive particle 413 powder start and stop line 422 due to the shaker 412 dropping or depositing particles 413 while the platen 426 is rotated part of one revolution. The whole annular band 418 which is coated by the stationary shaker head 412 as the sheet 424 is rotated with a portion of the particles 413 deposited on wet resin coated islands 417 and another portion is deposited on the backing sheet 424 in the areas between the coated islands 417. Resin wetted islands not coated by particles 415 are shown positioned upstream of the particle shaker 412.

Resin Printed Island Particle Foundations

Problem: It is desired to form raised island foundations on the surface of a thin flexible-backing sheet where the foundation material may or may not be electrically conductive and constructed of a relatively inexpensive material. It is beneficial that special or unusual island shapes be constructed with a precise duplication of the size of each island surface; and also, that the whole array pattern of islands be consistent with their geometric locations to aid in the multi-step process of creating an abrasive particle coated sheet article. Use of electrically conductive foundation material can aid in the use of electrostatic coating of the island surfaces with abrasive particles.

Solution: A rectangular or round flexible backing sheet may be printed with arrays of a variety of island shapes in annular or rectangular pattern sites with a thin coat of adhesive resins where the resin would have a thickness of from 10 to 100 micrometers. Loose metal particles, ceramic, glass bubble, or other particle materials having an approximate particle diameter of from 30 to 500 micrometers inch can be loosely applied in excess amounts to the top surface of the backing sheet in a manner that the resin wetted island shapes are uniformly covered with the foundation particles where the particle diameter nominally establishes the raised height of the island foundation. The excess particles not in contact with the resin island areas can be shaken off or blown off the backing sheet and the island particles can be structurally bonded to the backing sheet by partially or completely curing the particle adhesive resin. Another surface leveling coating of resin can be applied to the top exposed surface of the attached island particles by a variety of methods. If desired, smaller foundation particles, with a diameter approximately one third the size of the base particles first attached to the island sites can be applied to the top surface of the island foundation to fill in the gaps between particles. A final coat of resin can be applied to the island top and the whole resin system can be fully cured after which each island can be precision ground to a uniform height across the surface of the whole island array pattern. Resins can be applied singularly or repetitively to the island sites by a variety of printing methods such as the use of a copy machine type of device using an adhesive resin in place of an inkjet fluid, or by use of screen printing fonts or other methods. Round disk articles with an annular band of resin printed island sites can be die cut from annular ring patterns printed on continuous web material.

Figure 19A:
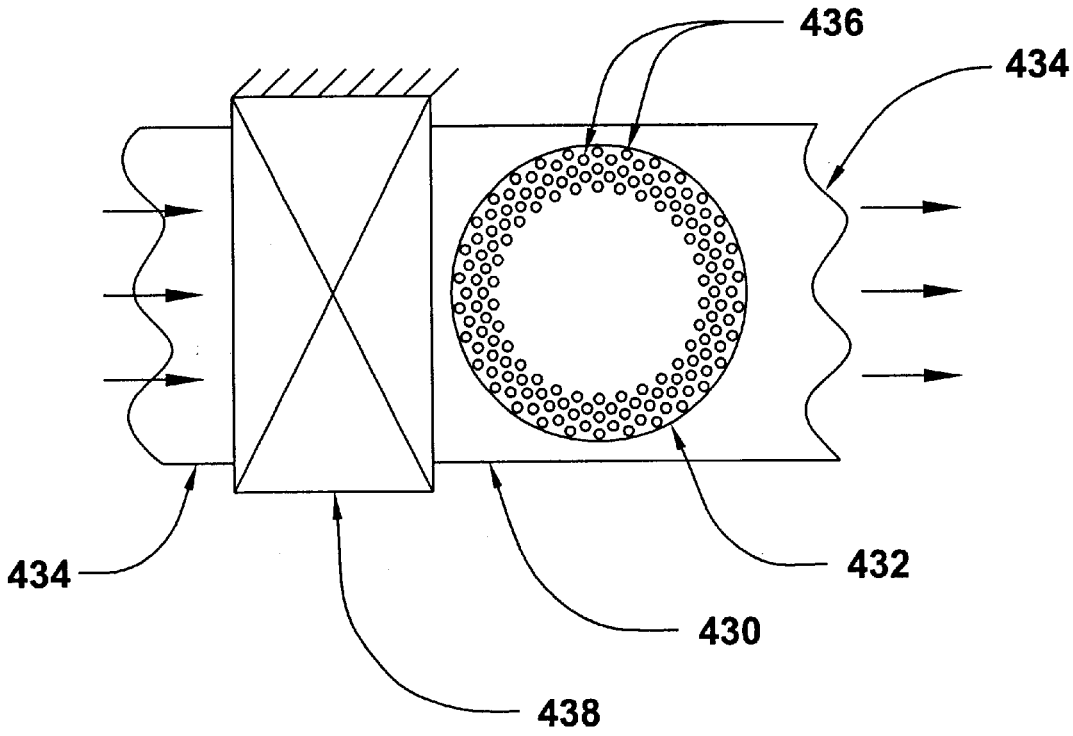
FIG. 19A shows a top view of a web island printing head.
Figure 19B:
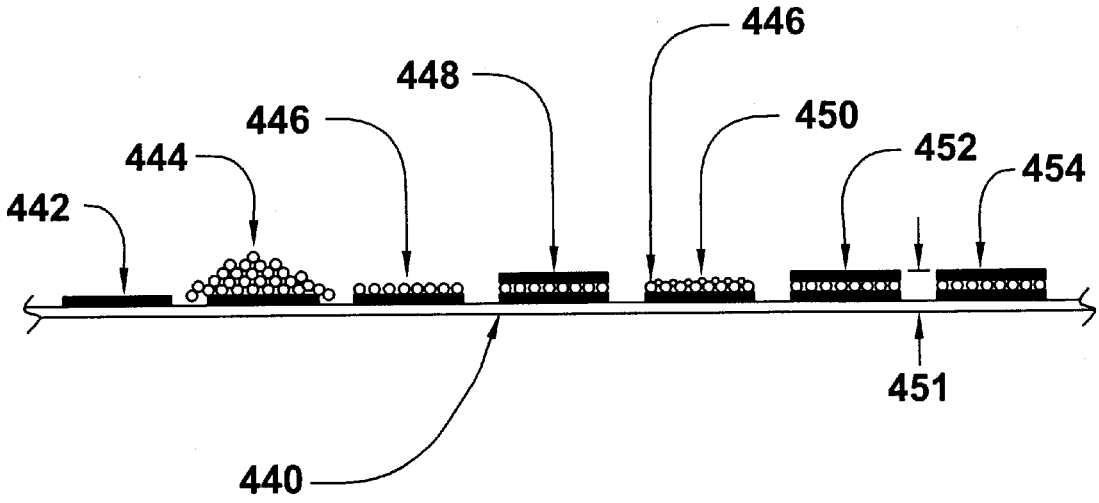
FIG. 19B shows a side view of raised island foundations.

FIG. 19A shows a top view of a continuous web backing material 434 routed under a resin printing head 438 where an array of resin island sites 436 are printed in an annular band having a band outside diameter 432. FIG. 19B shows a side view of an abrasive article backing 440 with resin island sites 442 covered with an excess quantity of abrasive particles 444. The excess particles are removed to produce a single layer or monolayer of particles 446 at each island site 442. A top layer of resin 448 is shown coated on the particles 446. A secondary coating of extra fine particles 450 which are shown having a substantially smaller diameter than the primary particles 446 allows nesting of the smaller particles 450 between the large particles 446. A final top coat of resin, which optionally may be filled with a variety of materials, 452 is shown as the final top coat to the island. After curing or solidification of the raised island foundation, the island top 454 is ground to a precise thickness 451measured from the bottom side of the backing 440.

Vibrating Conveyor and Abrasive Filler Fixture

Problem: It is necessary to apply a uniform dispersal of abrasive powder particles with gap spacing between the abrasive particles on the top surface of raised islands attached to a flexible-backing sheet.

Solution: Loose dry abrasive particles can be dispersed from a vibrating screen shaker head and dropped in free space onto the surface of a moving conveyor belt which carries the separated particles to a position under a backing sheet having a band of raised islands in an annular ring. The backing sheet is mounted to a rotatable platen with the islands facing downward. The end of the conveyor belt away from the dispersal head is positioned so that abrasive particles are approximately 0.15 to 1 mm from the island surfaces. The belt roller at the belt end is vibrated vertically to throw the particles off the belt to impact the wet resin surface of the islands resulting in the free particles adhering to the island resin with the approximate particle dispersal as existed on the belt under the particle shaker head. Those particles which are thrown upward into the valley gaps between the raised islands fall back to the conveyor belt and are either projected upward again by the vibrating belt or are carried to the end of the conveyor belt, fall off and are collected for future use in the shaker dispersal. A flat powder particle-trapping guard plate can be mounted a small distance of about 0.6 mm above most of the length of the conveyor belt with only the last 1 cm of the belt end exposed which keeps the individual particles from being thrown upward to the islands except at the belt end area position. Vertical vibrations of from 5 to 1,000 cycles per second will keep the particles in a fluidized bed state at the roller end. It is desired that the abrasive particles cover approximately 65 percent of the island surface but can range from 5 percent to 95 percent. Another method to create gap openings between abrasive particles on the island surfaces would be to apply a mixture of abrasive particles and a filler material such as clay particles or hollow or solid glass beads in excess to cover the top surface of wet make-coat resin wetted island surfaces. The clay or glass particles may be the same diameter as the abrasive particles or may be smaller or larger. After flooding the islands either from the top surface, or from the bottom surface, the excess powder mixture can be collected for repeated use after remixing. Clay is desired to prevent scratching of the workpiece which could occur from broken glass bubbles.

Figure 20A:
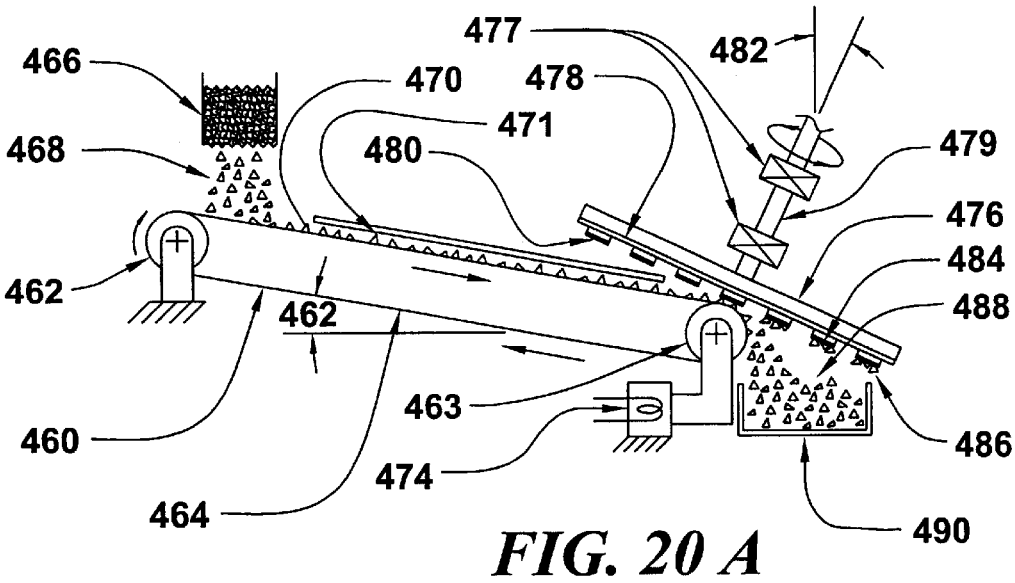
FIG. 20A shows a side view of a conveyor particle transfer system.
Figure 20B:
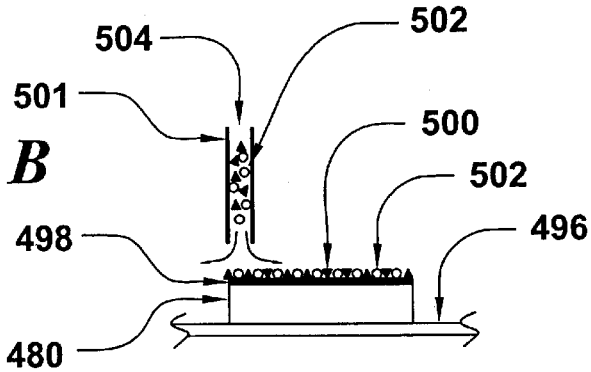
FIG. 20B shows a side view of an abrasive and filler particles on a raised island.
Figure 20C:
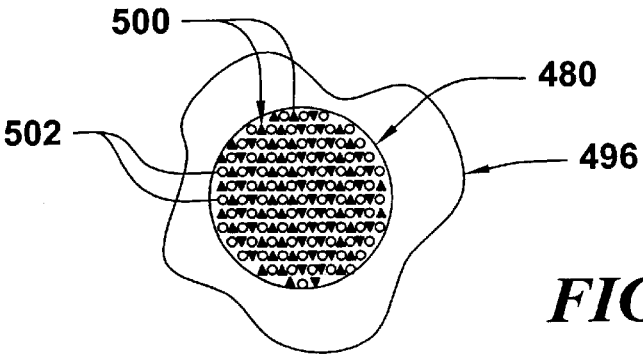
FIG. 20C shows a top view of a single raised island with abrasive and filler particles.

FIG. 20A shows a conveyor belt 460 mounted at an angle 462 of approximately 15 degrees with a conveyor belt 460 driven roll 462 which transports abrasive particles, abrasive composite particles, abrasive agglomerates or other filler particles 470 which drop as loose falling particles 468 from a particle shaker device 466. A particle stability guard plate 471 is positioned parallel to the top surface of the conveyor belt 460 to prevent particle motion due to vibration. A rotatable platen 476, supported by a shaft 479 mounted in bearings 477 holds a backing sheet 478 having wet resin coated islands 480 which contact the abrasive or other material particles 470 to form particle coated islands 484 with the excess particles 488 collected in a particle container 490. A vibratory device 474 attached to a conveyor belt idler roll 463 oscillates the roll 463 and the downstream portion of the conveyor belt 460 vertically which propels the individual particles 470 from the belt 460 surface into the resin on the resin coated islands 480. An option is to use the same basic system but not use the vibratory device 474 but rather simply press the end of the conveyor belt 460 and the idler roll 463 into contact with the downward facing resin coated islands 480. FIG. 20B shows a mixture of abrasive and filler particles such as clay or glass beads 500 and 502 traveling in a tube 501 as propelled by an air jet 504 and contacting the wet resin coating 498 of a raised island foundation 480 attached to a backing sheet 496. A single layer or monolayer of a mixture of abrasive particles 500 and filler particles 502 is bonded by the resin where the abrasive particles 500 are separated from each other by at least the diameter of the filler particles 502. FIG. 20C is a top view of a single raised island 480 attached to a backing sheet 496 with abrasive particles 500 and filler particles 502 attached to the island 480 top surface.

Solvent Coated Abrasive Transfer Sheet

Problem: It is desirable to evenly disperse abrasive powder particles with gap spacing between each particle on the top surface of raised islands located in an annular pattern on a thin flexible disk sheet backing. Dry abrasive particles can tend to agglomerate, thereby forming undesirable large particle clumps.

Solution: Abrasive particles can be mixed into a liquid solution of water, solvents or a combination water-solvent solution and can be kept in suspension by the use of mechanical mixing devices and the use of chemical particle suspension agents. Particles may comprise from 5 percent to 95 percent, by volume, of the mixture. The liquid portion of the particle-solvent mixture will tend to allow the particles to be evenly spread on the surface of a transfer sheet of sheet material, made of metal or plastic, when the mixture is applied to the sheet. The particles would be applied to the sheet material to evenly form a wetted annular band shape that matches the shape of an annular band of raised island attached to a flexible backing sheet. The particle mixture would be somewhat similar to paint, as the particles would typically have uniform diameters of 30 micrometers and a typical solvent would be MEK (methyl ethyl keytone). The mixture could be applied by use of a brush type applicator, by spraying, by use of a fluid pump fed hose which will supply the mixture to a transfer sheet rotated by a platen device. A variety of speed profiles can be employed to evenly spread the liquid particle coating fluid in an annular ring shape on the transfer sheet by spin coating techniques. After the particles are uniformly applied, by any of many coating techniques, the solvent liquid would be allowed to evaporate, leaving a mono layer coating of evenly dispersed dry particles over the full annular ring band. Then a sheet of resin wetted islands attached to a thin flexible backing sheet can be brought into flat contact with the particle transfer sheet to have each resin wetted island contact the dry abrasive particles, and after pressing the islands onto the abrasive, the island sheet can be removed with each island now covered with the abrasive particles as the particles are adhesively bonded to the islands. The remaining excess particles left on the transfer sheet can be recovered for future use by dumping them off the transfer sheet or washing them off the sheet with solvent.

Figure 21A:
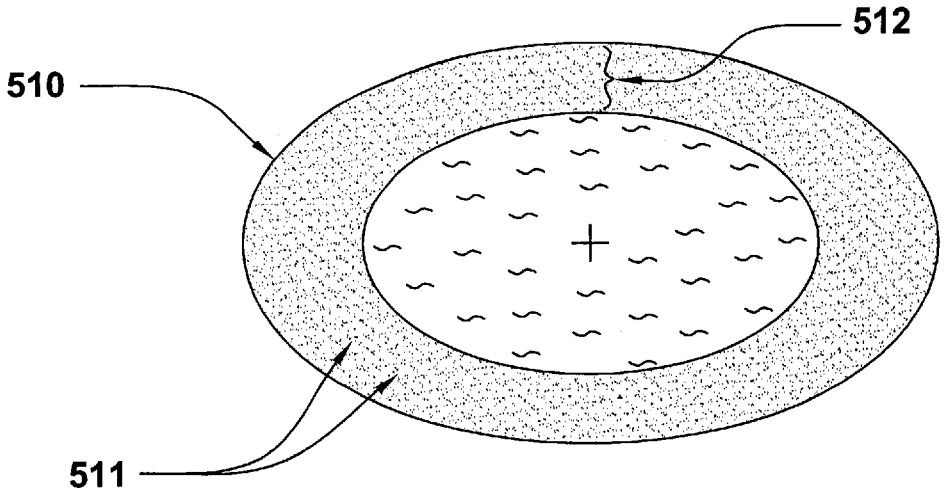
FIG. 21A shows an isometric view of transfer sheet with loose coated particles.
Figure 21B:
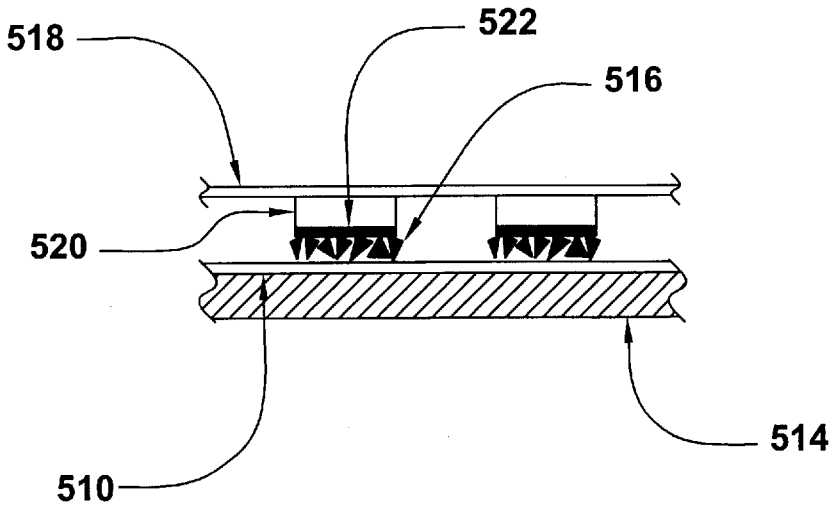
FIG. 21B is a side view of particles between raised islands and a particle transfer sheet.

FIG. 21A shows an isometric view of an abrasive particle circular shaped transfer sheet 510 with an annular band 512 of abrasive particles 511 coated on the transfer sheet 510. FIG. 21B shows a side view of a backing sheet 518 having integrally attached island foundations 520 coated with a wet resin binder 522 with abrasive particles 516 located between the resin 522 and the abrasive particle powder 516 transfer sheet 510 where the transfer sheet 510 is mounted on a flat platen 514.

Annular Ring Powder Guard Box

Problem: When abrasive powder particles are drop coated onto raised resin wetted islands or continuous flat coated abrasive formed in an annular ring on a flexible backing sheet which is rotated under a stationary powder shaker screen device, a discontinuity in the sparse but uniform powder coating occurs at the radial line where the powder starts and stops. If the backing is rotated past the start line, there will be an overlap of powder coating which will increase the al density of the powder in the overlap region. If the disk backing is stopped prior to completing a full 360 degree revolution, a radial powder gap will exist at the powder start and stop tangential position. Further, the powder shaker screen deposition head has a tangential width which supplies a constant or uniform flux density of powder which is progressively dropped on the wet resin island surface areas to create the desired 65 percent abrasive particle deposition density. The shaker head width prevents the use of a simple valve device to accurately start or stop the flow of powder across the full radial width of the shaker screen device.

Solution: A powder trap guard box can be used in conjunction with the shaker head to create a sharp definitive "start" line where the powder is drop deposited on the island, or continuous flat non-island, annular ring band area. Likewise, this same guard box can establish a sharp definitive "stop" line that is matched or aligned with the "start" line. The radial gap can be controlled to less than 0.5 cm or even less than 0.1 cm for a 40 cm diameter disk backing having a 7 cm wide annular band of raised islands. The powder shield guard box would be tangentially wider than the powder shaker head and would rotate with the disk backing under the shaker head to form a "start" line at the box wall trailing edge. Then the backing disk would be powder coated for most of the remaining tangential distance. Near the end of the annular band, the powder guard box, having vertical or vertical sloped walls would be moved into position where its leading box wall edge is aligned with the powder "start" line by positionally rotating the guard box backward relative to the powder coated backing disk. Both the powder guard box and the island backing disk would be rotated together, about the same center of rotation, under the powder shaker until the full annular band is circumferentially powder coated. The particle shaker head would not be interrupted in powder application during the time that the guard box is rotated backward to align its leading edge with the powder start line. The guard may have a straight radial edge, an angled radial edge, a serpentine edge or other shapes to create a radial powder stop and start line that is irregular in shape to better reduce the tangential abruptness of the powder line discontinuity.

Figure 22A:
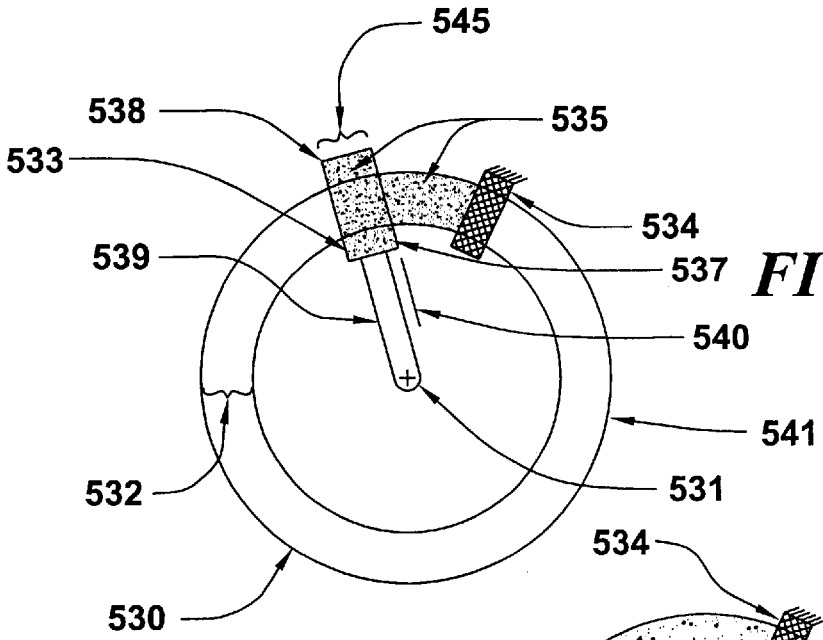
FIG. 22A shows a top view of a particle drop box with a traveling guard start line.
Figure 22B:
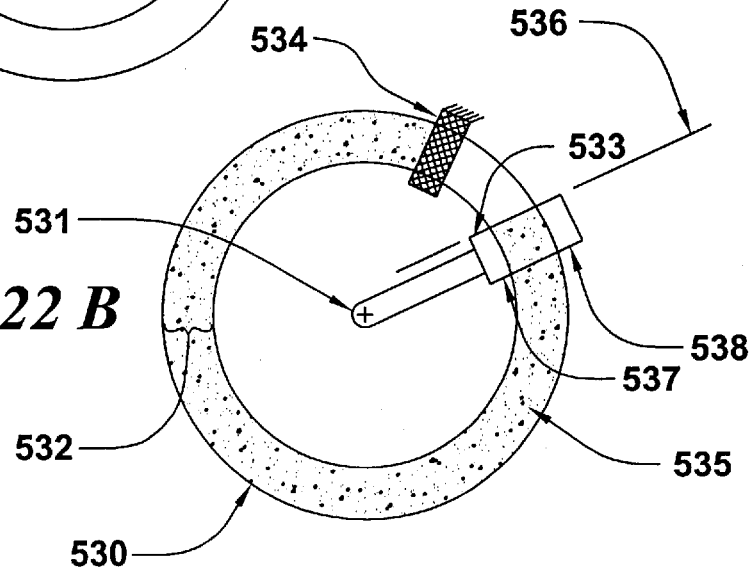
FIG. 22B shows a top view of a particle drop box with a traveling guard stop line.
Figure 22C:
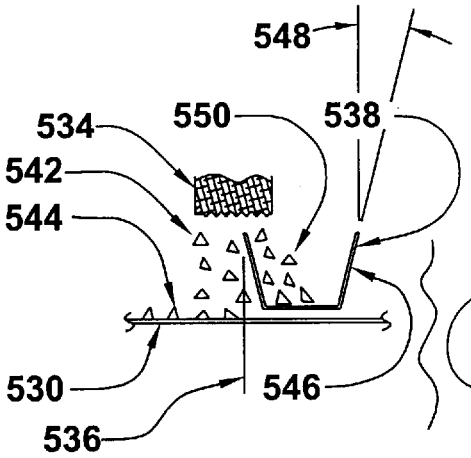
FIG. 22C shows a side view of a particle guard box.
Figure 22D:
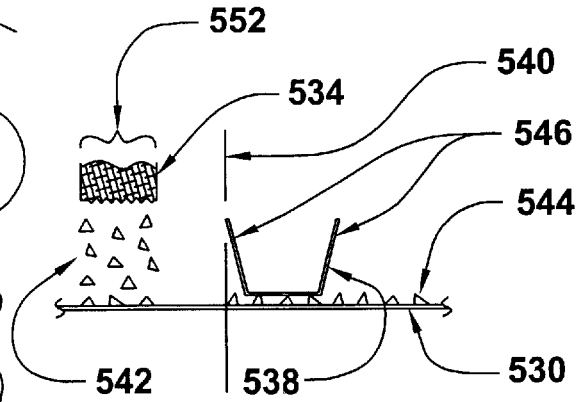
FIG. 22D shows a side view of a particle guard box alignment.

FIG. 22A shows a rotatable abrasive disk 530 having an annular band of abrasive 532 where the abrasive particles 535 are deposited either on the top surface of raised islands of the annular band or on the flat bottom of the guard box 538. The annular band 532 can either consist of abrasive particle coated raised islands or the abrasive particles are flat-coated directly on the surface of the abrasive disk article 530. A stationary powder drop coater head 534 is shown with a rotatable powder guard box 538 which is mounted on an independent guard box pivot arm 539 which rotates about the center point 531. The line 540 represents the radial start line of the abrasive particles 535 on the annular band 532 and it corresponds to the trailing edge 537 of the particle guard box 538 which initially travels rotationally in synchronism with the rotating abrasive disk 530 mounted on the rotating platen 541. The disk 530 is mounted on a rotatable platen 541 which rotates about the center point 531. The leading edge 533 and the trailing edge 537 of the guard box 538 defines the tangential length 545 of the guard box 538. The tangential length 545 of the guard box 538 is greater than the tangential length 552 of the shaker box 534 by 10 to 100 percent. FIG. 22B shows a top view of the rotating disk 530 and rotatable powder guard box 538, both of which rotate about the common center point 531. The disk 530 is wetted with resin in the annular band 532 area. The guard box 538 is now rotated back relative to the disk 530 start line 540 so that the leading edge 533 of the powder guard box 538 is aligned at the stop line position 536 referenced to the disk 530 and this line position is coincident with the start line position 540 shown in FIG. 22A. As both the abrasive particle start line 540 and the stop line 536 are coincident, there is no gap or overlap between the start and the end of the annular band 532 of abrasive particles 535. FIG. 22C shows a side view of the backing sheet 530 coated with abrasive particles 544 where falling abrasive particles 542 are dropped from a particle screen box 534. Abrasive particles 550 falling into the powder guard box 538 which has vertical side walls 546 which are at an angle 548 with a true-vertical line which creates a sharp box edge for accurate location of the abrasive particle start and stop radial lines 540 and 536. FIG. 22D shows the tangential length 552 of the powder shaker box 534 and also how the wall 546 of the powder guard box 538 is aligned with the powder start line 540. This system utilizes the downstream tangential length 545 of the guard box 538 to prevent falling particles 542 from falling on top of the particles 544 which have already been deposited on the resin wetted backing sheet 530.

Powder Guard Box Start-stop Line

Problem: It is desired to provide a uniform spacing between individual abrasive particles which are drop coated onto the resin wetted flat surfaces of raised islands patterned in an annular band on a thin flexible disk sheet backing. It is important that the flow rate of the particle powder be uniform across the full surface area of the powder shaker distribution device and that the flow of powder from the device is started and stopped without changing the powder distribution density. To create consistent abrading characteristics on the whole circumferential area of each complete abrasive article disk and also to achieve uniform abrading characteristics from each individual disk it is necessary that nominal controlled spacing exists between each abrasive particle, over the whole annular band of raised islands. Island shapes may include circular shapes, radial bars, and many other shapes which have the function of reducing the length and thickness of the water or other coolant fluid boundary layer, and also, to provide a radial flow path to continuously wash out grinding swarf from the annular abrasive area. Discontinuities of powder density at powder stop and start lines can cause polishing problems.

Solution: Abrasive particles, having an approximate 30 micrometer diameter, can be introduced or resupplied to a vibrating screen drop-coater head by another similar screen head or by use of a rotating feed roll having a rotogravure knurl or Meyer bar wound-wire surface. Each particle powder-leveling device would provide a more uniform bank of powder across the radial width of the following powder-leveling device which would increase the uniformity of particle dispersal from the following device. A number of these devices, of different designs such as screens or rotating metering roll bars, can be used in series to sequentially improve the powder dispersal. Analogies to this powder uniformity increasing technique is the use of a series of resistors and capacitors to reduce source electrical voltage variations; or, a series of lateral chambers and orifice restrictions to produce a constant fluid flow rate across the face width of an extrusion die. The deposition of the particle powder can be improved in particle density and powder particle-to-particle gap control in both a tangential direction and a radial direction for annular bands of abrasive disk articles with this series-type particle meter system. The same concept can be applied to powder deposition on continuous webs. Powder can be dropped on the surface of a resin wetted band of raised islands with the use of a traveling powder guard box which can be used to accumulate dropped powder over a period of time when the powder coating process is first initiated. After the flow rate of the powder reaches equilibrium, where the powder flow is uniform across the full surface of the vibrating screen device, the powder is then allowed to fall outside of the guard box walls to start contacting the raised islands with a sharply defined "start line" which may have different shapes. Correspondingly, the powder flow to the islands is interrupted with an identical "stop line" by the powder guard box device. The positional location of the start/stop line can be controlled to be aligned with a valley gap which exists between raised island formations so that the small powder density discontinuity which may exist at the start and stop line does not lay on the island surface. The geometry of the particle trapping walls of the guard box can be controlled to create a start and stop line which follows the island valleys in a nominally radial direction. Flushing the grinding swarf radially outward from the annular area of raised islands by introducing a controlled spray or flow of water at a location inboard of the inner radius of the annular ring of raised islands would not be impeded by this particle start and stop line. This source of flushing water would be used in place of, or in conjunction with water that is supplied to the top surface of the raised islands. The radial flushing water flow rate would be minimized to avoid introducing a hydroplaning effect which would tend to lift the surface of a workpiece being abraded from the moving surface of the abrasive sheet.

Figure 23A:
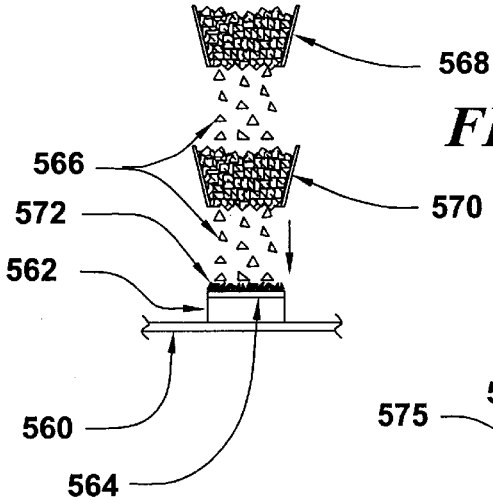
FIG. 23A shows a side view of a series of particle drop boxes.
Figure 23B:
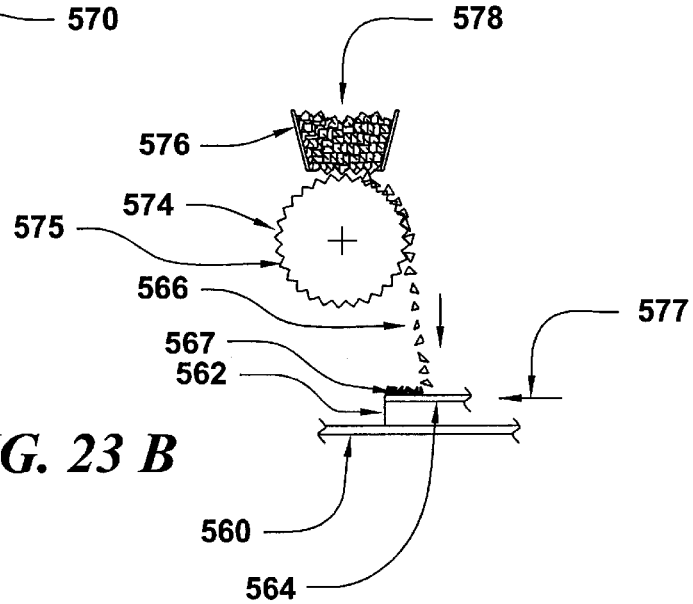
FIG. 23B shows a toothed particle distribution roll.
Figure 23C:
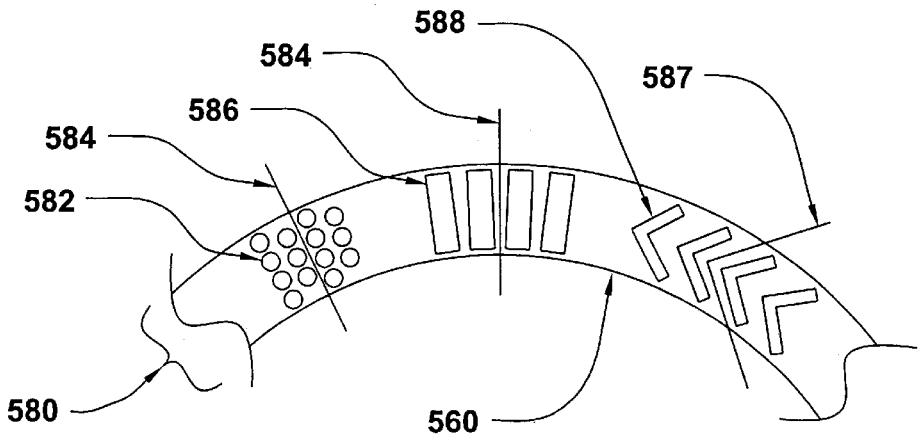
FIG. 23C shows pattern controlled particle start and stop lines.

FIG. 23A shows a side view of a first powder screen shaker 568 dropping powder particles 566 into a second screen shaker 570 which again deposits particles 566 to form a uniform layer of abrasive particles 572 on a wet layer of resin 564 attached to the top surface of a raised island foundation 562 which is an integral part of the abrasive articles backing sheet 560. FIG. 23B shows a side view of a powder screen shaker 576 filled with loose particles 578 which drop feeds particles to a roll 574 which has surface indentations 575 which pick up individual particles and transports them rotationally to fall as a line of loose particles 566 onto the resin 564 wetted surface of a raised island foundation 562 integrally attached to a backing 560 which is transported laterally 577 with the result of creating a flat layer of abrasive particles 567 on the resin 564 surface. FIG. 23C shows a top view of a arc section of an abrasive disk article 560 having a annular width 580 with a number of different island shapes including circular shapes 582 aligned with a radial free fluid and swarf passage shown by line 584; having narrow radial island bars 586 with a radial free passage line 584; and, having chevron shapes 588 which have an angled-radial passage line 587. Each of the water passage area lines 584 and 587 represent the island-free valley areas between raised island shapes 582, 586 and 588 where the particle deposition on the island surfaces can start and stop. The gap width at these lines 582, 586 and 588 locations allow some variance in the precision of the accuracy in the powder starting and particle powder stopping as the powder density variation in these island valley areas do not affect the powder density on the island top surfaces which control the abrading characteristics of each abrasive article. Each of the island shapes 582, 586 and 588 included are a few of many candidate shapes which provide a short localized tangential island surface length to break up the tangential fluid boundary layer created by the high surface speed of the abrasive article as it moves past the surface of a stationary or slow moving workpiece with a water or other coolant fluid present in the interface area between the surfaces. Each time the fluid-shear velocity progressively developed fluid thickness boundary layer encounters a valley gap opening between the raised island surface, the build-up of the fluid shear induced boundary layer thickness is interrupted.

Abrasive Particles Applied to Annular Ring

Problem: It is difficult to drop coat abrasive particles uniformly across the full flat surface of a raised island shaped annular ring without abrasive gaps or overlaps on the ring shape. There must be spaces between individual particles to provide effective cutting action of each particle.

Solution: Standard abrasive drop coating techniques employed to apply abrasive particles uniformly and with sparse coating of particles for a wide continues moving web can be employed for coating individual round disks having a raised annular ring of islands. This can be accomplished by the use of an abrasive particle powder shaker head or an electrostatic powder application unit that is at least as wide as the diameter of the raised island annular ring. Here, the abrasive disk is mounted on a conveyor belt where the disk passes under a powder drop coat head which drops particles onto the resin wetted surface of the annular ring as the disk travels under the stationary full width drop coat head. This drop coating can be applied to a sequence of disks which are progressively loaded onto the moving conveyor. All of the excess particles which are drop coated onto non-resin wetted portions of the disk, and also the particles which are dropped on the conveyor belt between disks can be collected and reused.

Figure 24A:
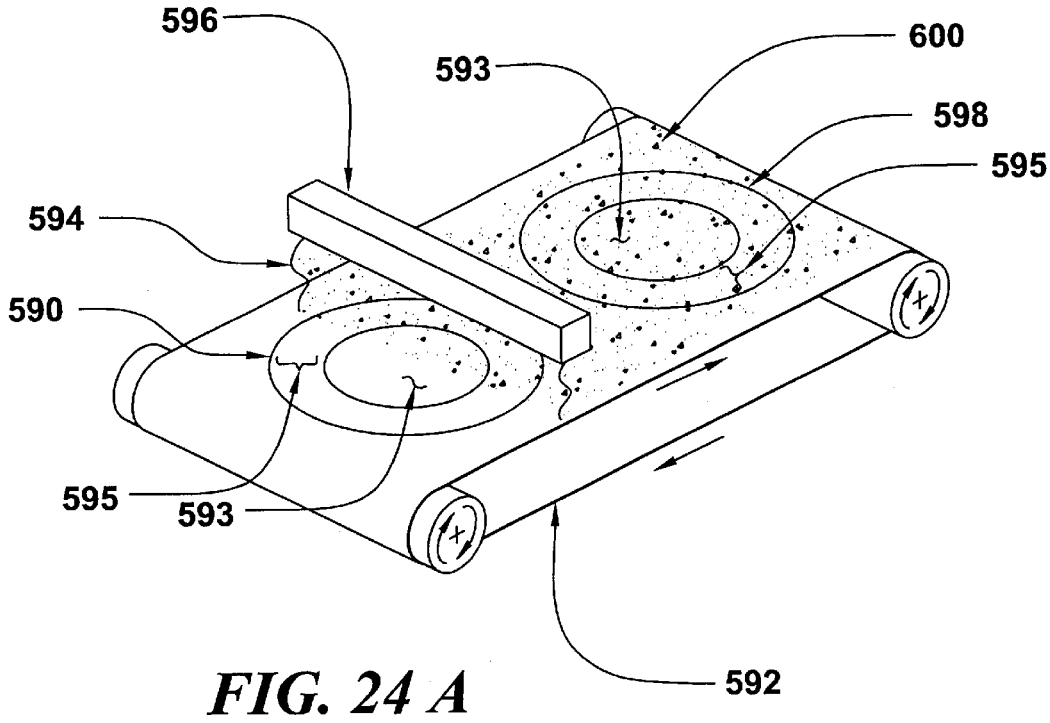
FIG. 24A shows an isometric view of a conveyor belt particle drop system.
Figure 24B:
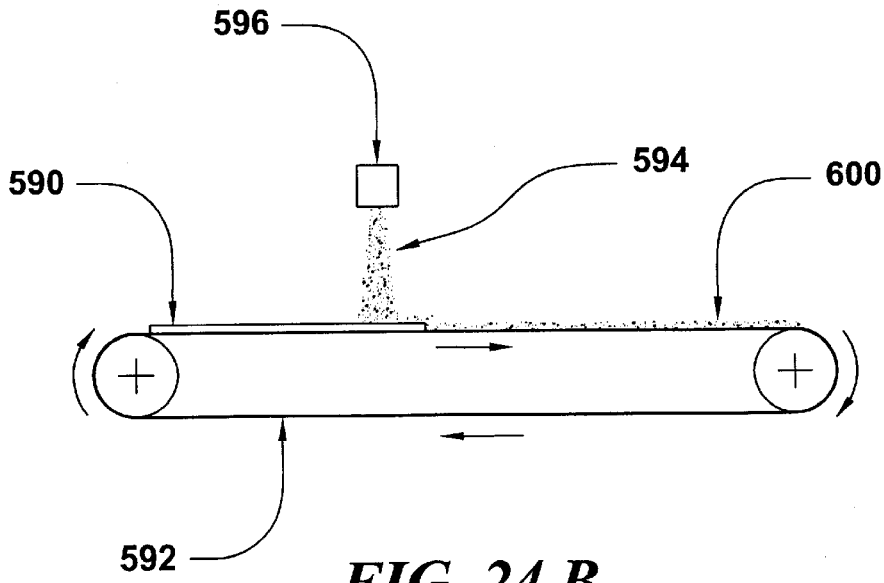
FIG. 24B shows a side view of a conveyor belt particle drop box.

FIG. 24A shows a view of a continuous backing disk 590 which has an annular area of wet resin coated 595 raised island foundations mounted on a traveling conveyor belt 592 which passes the disk 590 under a stationary particle drop coater head 596 which drops an area location 594 of abrasive particles 600 where the particle drop area is equal in size to the exposed surface area of the drop head 596 and extends across the drop coater head 596. The powder coated disk 598 is shown after having passed under the powder drop head 596 with abrasive particles deposited both onto the resin wetted surface of the disk 598 and onto the non-resin coated areas 593 of the disk. Also, particles 600 are deposited on the conveyor belt surface which is not covered by the disks 590 and 598. Both disks 590 and 598 are shown with a continuous backing in the central area inboard of the inner diameter of the annular ring and this central area 593 is free from either raised island foundations or adhesive resin coatings. All excess abrasive particles are collected and reused. FIG. 24B shows a side view of a disk 590 traveling on the surface of a conveyor belt 592 under the abrasive particle drop coater head 596 which applies free falling abrasive particles 594 with individual stationary dropped particles 600 shown laying flat on the surface of the conveyor belt 592.

Particle Collector for Annular Disk

Problem: It is desired to collect the excess abrasive particle powder which is drop coated onto a wet resin coated raised island area.

Solution: Collector pans can be positioned on or around the disk annular ring surface areas, which are not to be drop coated with abrasive powder, to collect the excess powder which is dropped from a powder dispensing bar shaped head. One collector pan can be circular in shape and would cover the inner radius of the annular disk area. Another associated collector pan having a circular cutout inside diameter can be placed on the outside of the annular raised island disk area. When both of these collector pans are placed on or around the abrasive disk, only the resin coated annular ring of the abrasive disk is exposed to the falling abrasive particles. Those particles which contact the wet resin areas of the annular ring will become attached to the abrasive disk backing. All of the remaining particles which are dropped from the powder dispensing head and are deposited inside or outside of the annular ring are then collected on the two pans and can be recycled for future drop coating. This particle coating technique can be employed for raised island annular rings or for annular rings of non-raised island shapes. The powder coating can also be used for continuous area annular rings where particles are sparsely coated on a continuous annular band shape, which can be raised from the disk backing material to form an annular plateau. The disk backing material can be plastic, metal, woven fiber, cloth, plastic impregnated cloth or fiber. The collector pans may be positioned in conjunction with a stationary disk with a moving powder head or the collector pans and abrasive disk may be placed together on a conveyor belt which transports the disk under a stationary particle drop-coating head. Collector pans would have shallow raised edges. Multiple sets of pans can be used to sequentially process multiple abrasive disks on a conveyor.

Figure 25A:
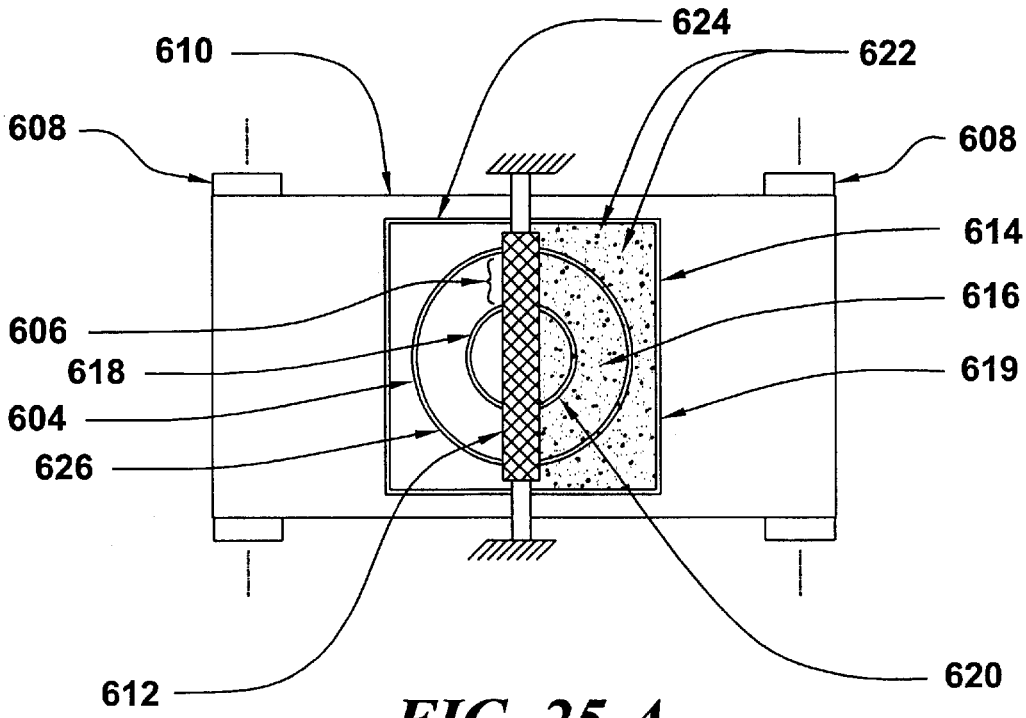
FIG. 25A shows a top view of a conveyor with annular particle guard boxes.
Figure 25B:
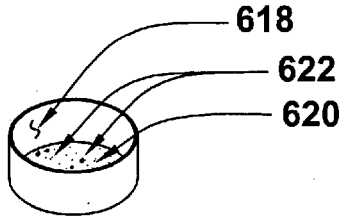
FIG. 25B shows an isometric view of an inner annular particle guard box.
Figure 25C:
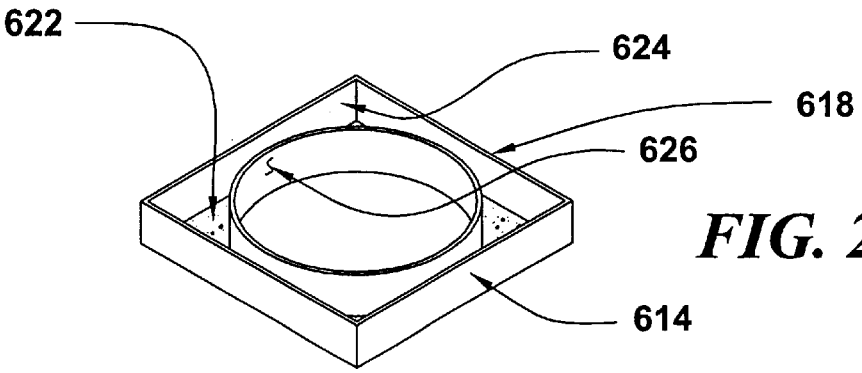
FIG. 25C shows an isometric view of an outer annular particle guard box.

FIG. 25A shows a top view of a conveyor belt 610 mounted on rotating rolls 608 where the belt 610 transports an annular abrasive disk article 604 having wet adhesive resin in the annular area 606. Also transported are two powder collector pans 614 and 620 which are positioned on top of the disk article 604 so that the two pans 614 and 620 and the disk article 604 travel together under a powder coating deposition head 612. The powder head 612 spans at least the width of the disk 604 but is less wide than the outer wall of the outer collector pan 614 which is shown with a rectangular outer wall 624 and a circular inner wall 626. The inner powder collector pan 620 has a flat circular center bottom and a circular outer vertical wall 618. The abrasive powder 622 is dropped on the annular area 606 of the disk 604 or onto the flat bottoms of the collector pans 614 and 620. FIG. 25B shows a view of the inner collector pan 620 with an outer circular raised vertical wall 618 and powder particles 622 deposited on the pan 620 flat bottom. FIG. 25C shows the outer pan 614 with raised outer rectangular walls 624 and a raised inner circular vertical wall 626 with abrasive particles 622 deposited on the flat bottom of the pan.

RTV Silicone Rubber Island Mold

Problem: It is necessary to form precisely shaped raised island foundations which are structurally attached to a thin backing sheet without weakening the bond between the island foundation and the backing during the island forming process. A technique of creating raised islands on backing sheet material which have enough structural bonding strength that the raised foundations will not be loosened from the backing during abrading action is required for circular annular shaped island patterns on abrasive article disks: and also, for other abrasive articles converted from continuous web formation of abrasives. Many techniques of forming raised islands by creating island foundations from adhesive resin based materials include process steps where the island foundation shape is formed by a mold device where the mold has to be removed from the backing after the islands are solidified. The island foundation material has a tendency to adhere to the mold body or to be trapped by imperfections in the mold body. If the island foundation material is strongly attached to the mold, the island foundation structure which is adhesively bonded to the backing will tend to be separated from the backing sheet as the backing sheet is removed from the mold body. This separation occurs if the island structure is more strongly attached to the island mold cavities, particularly at indentations or imperfections of a metal cavity mold, than the island structure is adhesively bonded to the backing sheet. At times, the strength of the bond between the island foundation and the backing sheet can be weakened without separation and separation of the island structure will occur later during abrading use of the abrasive article.

Solution: A rigid master mold plate can be created of the desired island shapes by a variety of processes, including machining, where raised island shapes protrude from the surface of the annular flat plate. The master mold plate as a example may have a thickness of 3 cm or less, can be circular, and made of metal. The plate would be through-drilled with a annular array of holes 10 mm in diameter to allow insertion of 10 mm diameter pins into each drilled hole where free ends of the pins would be raised from the surface of the mold plate. The pattern of island pins would be arranged to duplicate the shape of round raised islands positioned in an annular array on an abrasive sheet disk. The round pins are firmly attached to the metal mold plate and they are adjusted in height above the working surface of the mold plate article to a precise height equal to the desired height of the raised abrasive island foundation structures. A typical height of the pins protruding above the surface of the mold plate would be less than 1.5 mm and all pins would be adjusted to a standard deviation in height of less than 0.2 mm. Different diameter pins can also be used to represent different diameter round island shapes. Other island shapes such as chevrons or radial bars can be created by a variety of means and these island shapes can also be attached in annular array patterns to the metal mold plate by pinning them, welding them or adhesively bonding them to the mold plate. In addition, arrays of island mold shapes can be electrical discharge machined (EDM) into the metal surface of the metal master mold plate. Both the master mold plate and the island shapes can be made of a variety of materials, including metal, plastic, wood or inorganic materials. The raised island shaped side of the master plate is then coated with a thick layer of liquid RTV room temperature vulcanizing, silicone rubber. A typical sample rubber would be SILASTIC®L RTV supplied by Dow Corning Corporation, Midland Mich. Vacuum can be used to eliminate air bubbles in the liquid rubber and vacuum can also be applied and released a number of times in succession to improve the liquid rubber wetting of the most precise details of the raised island structures on the master plate. The RTV rubber forms a reusable easy-release non-sticking flexible mold which faithfully duplicates the precise shape of the raised island shapes which are an integral part of the master mold plate. By curing the silicone rubber, a flexible rubber mold having island shaped surface cavities is created for use to form raised island shaped structures on a flexible backing sheet. Due to the flat surface of the rigid master mold plate, each island cavity is located on the flat surface of the rubber mold. Multiple rubber island cavity molds can be made from the original rigid master mold plate. The island shape cavities in the rubber mold can be filled with a suitable island foundation resin material where the resin in each island cavity is leveled with the surrounding flat RTV rubber mold surface by a variety of methods including the use of an angled doctor blade. Vibration ranging from 5 to 25,000 cycles per second can be applied to the resin as the mold cavities is being filled: to reduce the effective viscosity of the resin mixture; to improve resin wetting of all minute surfaces of the island cavity shape; and to prevent air bubbles from becoming trapped within the island cavities. Vacuum ranging from 7 to 70 cm mercury can be applied to de-gas the resin prior to filling the cavities or this vacuum may be applied during the process of filling the cavities to reduce the presence of entrained air bubbles in the resin which fills the cavities. A flexible backing sheet is brought into contact with the filled cavity side of the rubber mold and the backing can be progressively rolled into contact with the exposed resin island foundation cavities. Joining the backing to the exposed resin filled cavity bases by use of a nip-roll pressure contact prevents air entrapment between the backing and each island foundation base. The backing sheet may have a primer coat or it may have a thin coating of adhesive is applied prior to being joined with the island foundation resin. A preferred shape of the plastic, cloth or metal backing is a circular shape which is used with a annular pattern of raised island structures. The composite RTV mold and backing sheet assembly may or may not be inverted during the island structure forming process. A uniform pressure can be applied, by use of a resilient pad, to force the adhesive coated backing sheet into intimate contact with the island foundation resin bases during the time of solidification of the solvent based drying or cure of the foundation resin and the backing adhesive resin. The composite backing sheet and island cavity mold can be inserted into a vacuum bag and vacuum from 7 to 70 cm mercury applied to the sealed bag interior to effect a pressure force which holds the flexible backing in intimate contact with the resin islands during the time of cure of the island structure islands. After the resin is cured, the backing sheet can then be stripped from the flexible easy release silicone mold without applying significant mold separation forces, thereby reducing the possibility of weakening the raised island structure adhesive attachment to the backing. The RTV silicone mold can be reused repetitively to form island structures. Use of commercial grades of RTV rubber commonly used in the rapid prototyping industry can be used to duplicate precise features of 10 micrometers or less of any island geometry form. This replication accuracy is more than sufficient for the creation of raised island foundations as the upper flat surfaces of these islands typically would be precisely ground to a height referenced to the backside of the backing prior to resin and abrasive particle coating. The flexible RTV silicone rubber mold also has the ability to faithfully duplicate special tapered island wall features. Island wall taper angles would be less than 45 degrees and can be either positive or negative. A positive wall angle produces an island top surface which is smaller than the island base and a negative taper angle produces an island top which is larger than the island base. A enlarged top surface of an island can be removed from the rubber cavity as the rubber can be selected to have adequate flexibility that it will distort upon separation without weakening the adhesive bond between the island base and the backing. The hardness or durometer of the RTV silicone rubber can be controlled by selection of the specific RTV silicone rubber. A RTV mold approximately 1 cm thick with a diameter of 40 cm would be easy to manually manipulate during an island foundation molding operation. Typical circular raised island foundations would have heights of approximately 0.037 cm diameters of 0.2 cm and would have center-to-center island spacing of 0.3 cm. The RTV silicone rubber has the advantage of providing a good adhesive release characteristic where any adhesive that would be a candidate for an island foundation material would not adhere to the RTV rubber mold body. Likewise, the RTV silicone rubber mold would not adhere to the island master plate body surface or the raised island pins, or island shape indentations. The great flexibility and natural surface bond release characteristics of the silicone rubber would allow the rubber mold to be separated from the disk backing with a minimum of force on individual island foundations. The structural toughness and durability of the RTV silicone rubber would allow repeated use for creating multiple raised island backing sheets with little wear of the silicone even if the island foundation material is highly filled with metal, inorganic or organic particles. Silicone rubber is typically a two-part system where a platinum based curing agent is mixed with a base rubber material. Curing of the rubber mold can be accelerated by the use of higher temperatures. The master mold plate, typically made of metal, can be used repetitively to produce many fully accurate RTV rubber molds. A smooth flat surface on the rubber cavity mold plate allows easy clean-up of the mold after use in preparation for molding island structures on another disk backing.

Figure 26A:
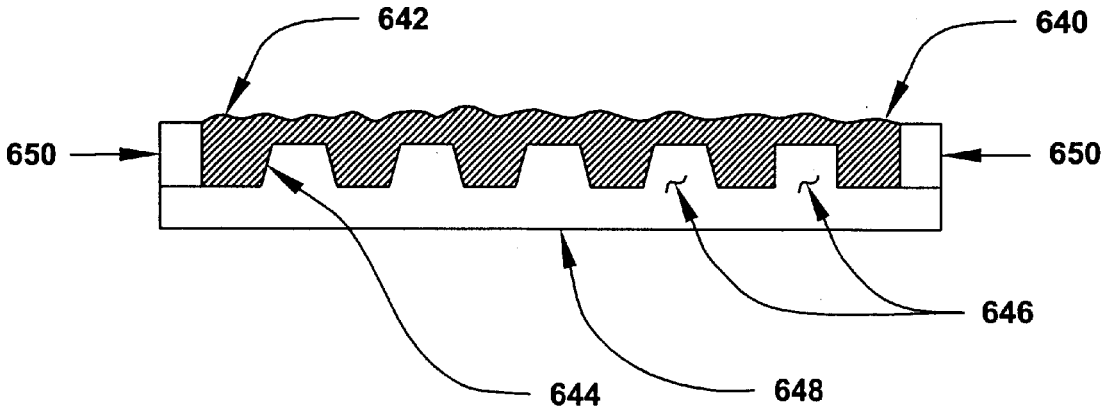
FIG. 26A shows a side view of a master mold plate.
Figure 26B:
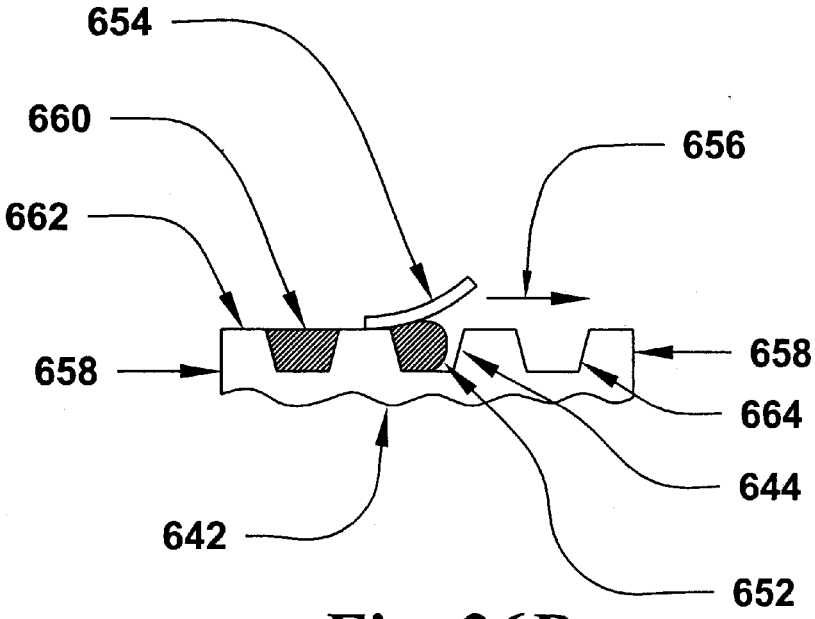
FIG. 26B shows a side view of filled cavities in an island foundation mold plate.
Figure 26C:
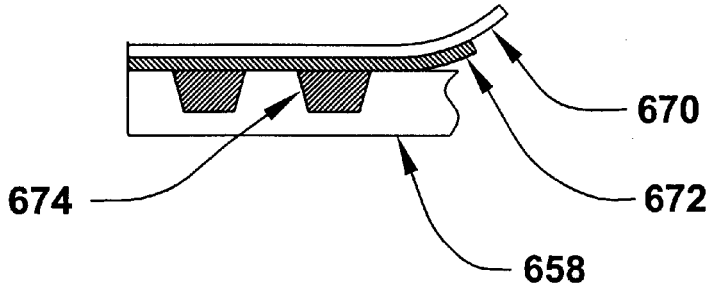
FIG. 26C shows a side view of a backing sheet with island foundations and a mold plate.
Figure 26D:
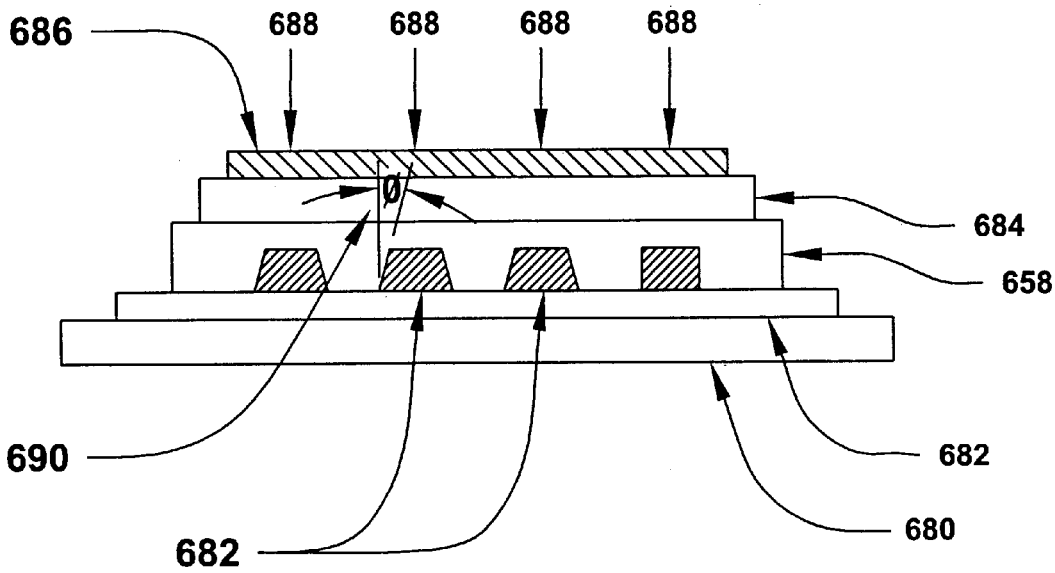
FIG. 26D shows a side view of an island mold plate assembly.
Figure 26E:
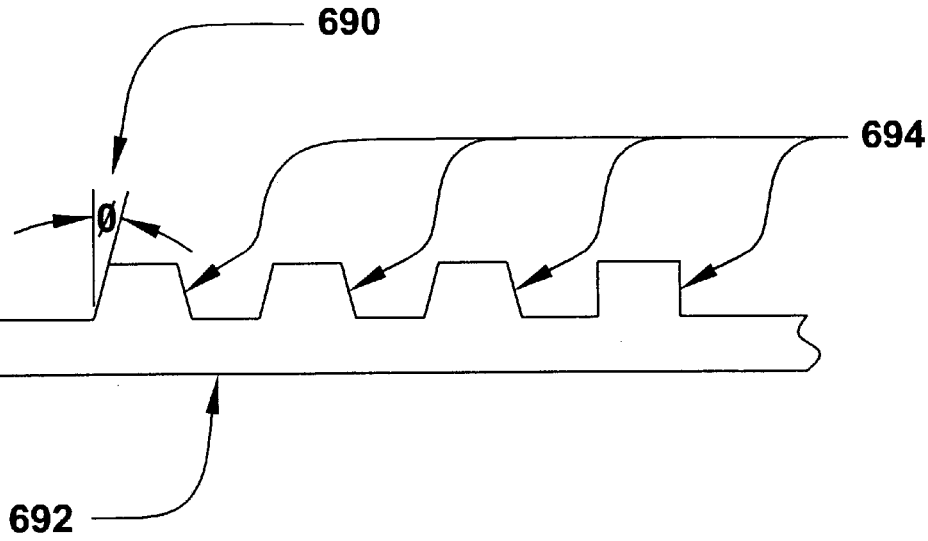
FIG. 26E shows a side view of a backing plate with integral island foundations.

FIG. 26A shows a rigid smooth and flat master mold plate 648 with different raised island shapes 646 having tapered walls 644 and an outer edge dam mold ring 650 which contains liquid RTV rubber 640 having a coarse rubber surface 642. FIG. 26B shows a precise flat and smooth rubber surface 662 of a cured RTV rubber mold 658 which has unfilled island shaped cavities 664. The mold 658 has many individual island cavities 644 and has a coarse rubber surface 642. Island foundation resin 652 which may be filled with particles, is shown located within an island shape cavity 644 and this resin 652 is leveled flat with the precise flat and smooth surface 662 by use of a doctor blade 654 which traverses across the flat precise mold surface 662. An island cavity which has been filled with foundation material and flattened level with the surface 662 is shown as 660. FIG. 26C is a side view which shows the separation of the backing sheet 670 coated with a cured resin layer 672 which is commonly bonded with the cured or solidified foundation material 674. The peeling separation of the now integral composite raised island backing sheet 670, the resin layer 672 and the island foundation 674 progressively lifts the backing sheet composite away from the RTV silicone rubber mold 658. FIG. 26D shows a side view of an assembly of an island foundation molding operation during the process of mold foundation solidification. Pressure force 688 is applied to a stiff base plate 686 which compresses a resilient conformable cover plate 684 which is in pressure contact with the coarse surface of the RTV rubber mold 658 having foundation material filled raised island shaped foundations 682 with the foundation islands having side walls with tapered positive mold-release angles 690. FIG. 26E shows a side view of a backing sheet 692 with a variety of integral raised island structures 694 where one raised island has a positive mold sidewall draft angle 690. The draft angle 690 could be negative in which case the top of the raised island foundation would be wider than the island base.

Printing Press Adhesive Coating of Raised Islands

Problem: Coating raised islands on a flexible sheet abrasive article with abrasive particles must result in uniform thickness thin abrasive layer coatings over the full areas of all the island surfaces for efficient and effective high speed abrasive lapping. Particles must be coated somewhat sparsely with a gap existing between most adjacent abrasive particles in order for individual particles to actively contact and engage the surface of a work piece being abraded. If an abrasive slurry is coated directly on a island surface, each abrasive particle should be attached to the backing island top with a make coat of resin binder where only the bottom one third of the individual particle is covered with resin, leaving approximately the upper two thirds of the particle exposed for direct contact with the work piece surface. If a size resin coat is added to further strengthen the bond of the particle to the backing or island surface, it is desired that approximately the upper one third of the particle remain exposed, or for there only to be a very thin resin coating on the uppermost top surface of the particle. A thin size coat which is conformable to the shape of the particle will be thicker at the particle base due to meniscus effects, providing structural support to the particle from contact forces which occur principally at the particle top. The thin upper portion coating will allow the upper portion of the size coating to be worn away, progressively exposing the particle top as it also wears away. A very common particle size for use in abrasive lapping is 30 micrometers which then requires that the resin make coat should be approximately 10 micrometers. Further, the make coat should be very uniform in thickness particularly for abrasive drop particle coating as individual particles would be supported by the nominal top surface of the make coat. If the make coat thickness varies by 20 micrometers, the particle height would vary by a similar amount, which would affect the abrading contact of individual abrasive particles attached to a round sheet of an abrasive article. If the abrasive article has a high surface speed above 1,500 meters per second, only the highest particles would contact the surface of a work piece. Assuming that a rotating platen used to support an abrasive sheet has a perfectly flat sheet platen supporting surface at full rotating speed, it can be seen that it is necessary to control the thickness of an raised island abrasive sheet so that each abrasive particle attached to the abrasive sheet is at a height precise to within approximately one half the diameter of the particle. It is also desired that a single layer, or monolayer, of abrasive particles be attached to the top of an island top surface as only the highest of particles in a layer with double-layered particles will contact a work piece surface.

The height of the abrasive particles is measured from the top of exposed abrasive particles to the base, or bottom, of the abrasive article backing sheet. The absolute height or thickness of the abrasive article is not important for lapping, in general, as a work piece is typically lowered to the abrasive surface until contact is made with the abrasive. Lowering the work piece easily allows different types and thickness abrasive sheets to be used in one abrading process, starting with coarse large diameter particle sheets and progressing to sheets with fine small diameter particles to produce a finished work piece article with a very smooth finish. Any variation in the thickness of the abrasive in either a radial direction or a tangential direction on an annular round disk will affect the performance in grinding or lapping work piece articles. A radial thickness difference, if it is a perfectly linear change, will not be very important if a free-floating spherical work piece holder is used to support a work piece. A tangential thickness variation will increase in importance as the rotational speed of the platen is increased. Throughout the process of manufacturing a raised island abrasive article, dimensional control of the variations of the island foundation heights or thickness, make coat thickness, or particle coating application can each affect the overall thickness and abrading performance of the abrasive article.

Abrasive article circular disks having annular rings band areas of raised islands should have an outside diameter peripheral border and an inside diameter border that are free from the precision height abrasive coated islands. These abrasive free border areas have a number of benefits: an aid in manufacturing the disk, improve manual handling by a lapping machine operator, allow mounting on a lapping machine without platen vacuum chuck holes distorting the thin flexible backing in the area of the raised islands; and also, provide protection to the critical raised island area during shipment and storage of the disks. Each disk should consist on a single flat continuous sheet, preferably without a center mounting hole in the disk backing at the rotational center of the disk as this hole can provide a leakage path for the vacuum when a disk is attached to the platen by vacuum.

A high speed lapping machine platen is quite heavy, typically over 20 kg and has a large diameter of typically 45 cm, which results in the platen having a large rotational mass of inertia while the thin lapping article disk attached to the massive platen is very lightweight, typically less than 20 gm. If a abrasive article lapping sheet is attached slightly off-center from the platen, the resultant out-of-balance condition typically has little effect on the vibration balance of the high speed 3,000 revolution per minute lapping machine. This indicates the use of a mounting hole at the abrasive disk center for concentric mounting of the disk to the platen is usually not important and therefore is not necessary to use.

A simple method of visually distinguishing different raised island abrasive articles which have different abrasive particle diameters, types of abrasive particles used, such as diamond or CBN, type of backing, and style of raised island shapes are all helpful to personnel involved, including operators using the article, those involved in manufacturing the articles and those involved in sales of the articles.

Solution: Printing press plates used to print graphic visual ink patterns on paper or plastic web material can also be used to print patterns of adhesive binders on flat sheets of abrasive article backing or to print adhesive coatings on the surfaces of raised island foundations attached to abrasive article backings. Printing plates can be used to very accurately print different coating thicknesses and print the four primary colors sequentially in different print color densities. The combination of overprinting different densities of only the four primary colors in an area on a sheet can together form color combinations which duplicate subtle final colors that are accurate representations of an original graphic prescribed by commercial graphic artists. The technology allows creation of large sized printing plates which are used on printing presses that readily position four plates to individually print four separate colors sequentially on the same area of paper. This printing is usually performed on a continuous web printer with the final result of printed sharp line demarcation edges which demonstrates the accuracy of the printing plate ink transfer process and the capability of printing machines to accurately register plates to a moving web sheet. Digital and optical pattern definition of the color patterns allow printing of half-tone colors with color print densities so sparse and with such small controlled color dot patterns that the dots and the dot-count density can not be easily seen by the naked eye without magnification. This well established printing technology can be very useful for use in creating raised island abrasive islands in a number of different ways by simply substituting an adhesive resin binder for printing ink used in color printing. First, the precisely flat ground raised islands arranged in a annular ring pattern on a backing sheet can be transfer printing-plate coated with a make coat of resin and then abrasive particles can be drop coated on the resin wetted raised islands. Second, a slurry of abrasive particles mixed with a resin can be print coated on an continuous flat surface raised annular portion of a flexible printing plate and this coated plate used to transfer coat the abrasive slurry to an array pattern of individual raised island foundations which are attached to a backing sheet. Third, island areas of adhesive resin can be printed on flat backing sheet material and then particle island foundation particle material can be applied to the wet resin to form the base of raised island foundations. Other variations of printing of adhesive resins include the printing of individual islands of adhesive on a transfer plate flat surface, aligning this coated plate with a duplicate patterned raised island backing and pressing the two together to transfer approximately 50 percent of the adhesive to the raised islands. This transfer of adhesive effectively produces a resin make coat on the raised islands which is only one half of the thickness of the original flat plate resin coating. When transfer coating is applied by this individual island area coating technique it is possible to create very thin coatings of higher viscosity resins; and also, no unused resin is printed in the "valley" areas which exist between the individual island areas.

Printing plates would primarily be used to transfer resin coatings of 10 to 50 micrometer thickness to specific island area regions of an abrasive article such as a round flexible disk backing having an annular ring area of typical 3 mm diameter raised island foundations which have a height of 0.3 mm measured above the surface of the backing. Each abrasive article would typically have an outside diameter of from 2 cm to 120 cm, or preferably from 20 cm to 80 cm but most preferably from 40 to 60 cm. Each annular disk would have annular rings of raised islands that have a outside annular diameter that is 95 percent or less of the outside diameter of the abrasive article disk backing which leaves a outside peripheral border on the disk that is free of raised islands. The island-free disk outside border would aid in the use of tooling clamps in manufacturing the disk, improves the ability to manually handle the disk during use or disk changing by a lapping machine operator, would aid in storage and shipping the disks without damage to the critical raised island areas of the disk, and also, to provide an area for vacuum attachment of the disk to a lapping machine platen by use of vacuum-chuck port holes in the platen which will not affect the flatness of the abrasive raised island portion of the disk. The inside diameter of the annular ring of raised islands extends from 20 percent of the disk backing outside diameter to 80 percent of the disk backing outside diameter but preferably extends from 50 percent to 70 percent and more preferably from 60 percent to 70 percent of the disk backing outside diameter. The island-free inside portion of the disk diameter allows manufacturing tooling to contact this area of the backing which is some distance away from the raised island annular area, allows more freedom in manual handing during changing disks during use for lapping and also, provides a surface for the plate vacuum port holes to be located some distance from the raised islands structures for vacuum chuck flexible disk clamping. The inside island-free area can have a small 1 cm or larger abrasive disk mounting through hole but in its most preferred embodiment there is continuous unbroken central area which will hold a vacuum seal for the whole surface area of the entire disk backing.

The printing plates may be 2 mm thick polymer plates such as those used in flexographic ink printing or they may be thin plastic or metal printing plates. An abrasive disk article annular raised island band area would be duplicated as a continuous raised flat area on the printing plate by creating a geometrically matching annular ring on the printing plate where the whole annular area of the printing plate is raised up from the floor, or the base, of the plate. Creating this raised printing plate area can be done by a digital representation or by using conventional optical projection techniques. The required annular shape is a very simple elemental shape so it could be produced in a variety of sizes at low cost. This same shape can be used for a variety of different configuration island shapes as there would only be a few standard abrasive article disk diameter sizes but there would be many different abrasive particle diameters and island shape configurations for each of the standard disk diameters. The printing plate annular area would be coated with an abrasive slurry binder, or coated with an abrasive-free adhesive binder, and the binder would be transferred to the abrasive article raised island area by pressing the liquid-state coated printing sheet to the surface of the islands. The binder transfer from the printing plate to the island tops can be controlled by first aligning the transfer plate annular ring concentrically with the abrasive article with the annular ring area of the raised island backing and then processing this sandwich of printing plate and island backing through a nip roll having controlled nip pressure. Approximately 50 percent of the adhesive binder would be transferred to the raised island surfaces. After use in transferring the adhesive coating, the same flexographic plate can be reused by coating it again with fresh adhesive by processing the plate through a nip roll printing press machine, where new adhesive binder is supplied, and a new precisely controlled thickness of binder coating is applied to the same printing plate. The nip roll adhesive roll coater would provide a resin smoothing action to compensate for the uneven coated pattern that exist on the transfer flexible plate, which can be reprocessed for use in another coating transfer event. Adhesive of reduced thickness is present in the small discrete island surface areas on the transfer plate where the adhesive was partially removed during the previous process step of adhesive transfer to the abrasive article sheet. Other roll coaters including gravure roll coaters can be used to re-coat a transfer plate. Particles of abrasive can be drop coated on the wet resin coated islands to provide an abrasive surface to the island. Size coatings can also be applied to the abrasive article by use of printing plates. A make coat can also consist of a mixture of abrasive particles and resin. Another technique can be used to provide spacing gaps between abrasive particles by the use of dissolvable diluent particles. First, a make coat of resin is applied to the islands and a mixture of abrasive particles and other similar sized water, or other special solvent, dissolvable particles are drop coated onto the wet resin. Particles which can be dissolved with the use of water include sugar, salt and other materials. Other particles can be used which can be dissolved with alcohol or other solvents. Solvents can be selected which will have a minimum effect on the curing or solidification of the binder resin which bonds the abrasive particles to the island top surfaces. Likewise a variety of dissolvable particles or combinations of dissolvable particles and solvents can be selected to eliminate the dissolvable particles after the make coat of resin after it has solidified enough to bond the abrasive particles to the island tops. After dissolving, each dissolvable particle will leave a gap opening between the non-dissolvable abrasive particles which will aid in improving the grinding characteristics of the abrasive article. Different percentage ratios and size difference ratios of abrasive particle to dissolvable particles can be optimized for grinding performance. The dissolvable particle substance would comprise approximately 35 percent of the mixture by volume of dissolvable and abrasive particles that are preferred to be roughly equal in diameter. Particles can be applied by use of a fluidized bed to the adhesive wetted islands. After the make coat of adhesive binder, which may be a MEK (methyl ethyl keytone) or toluene solvent thinned phenolic, epoxy or other material is partially or fully cured, the dissolvable temporary filled materials are washed away leaving approximately 65 percent density diamond or other abrasive particles on the island surface with random spacing gaps between abrasive particles. After dissolving the diluent particles leaving the randomly spaced abrasive particles attached to the island surfaces a size coat of resin can be applied either to the island tops or to the full annular ring area coating both the island tops and island valleys as this conformable thin size coating will only decrease the valley depth slightly.

These printing plate abrasive-coating techniques can be used to print round annular ring disks on a continuous web in a printing press type of machine. Also, multiple adhesive transfer sheets can be made at one time from a single printing press machine operation.

Numerous color code schemes can be employed to distinguish different raised island abrasive articles including the use of basic primary colors of the backing, coloring agents in the resin binder systems, the use of tangential or radial bands of color, and also the use secondary visual aids such as colored "polka dots" having different sizes and shapes.

Figure 27:
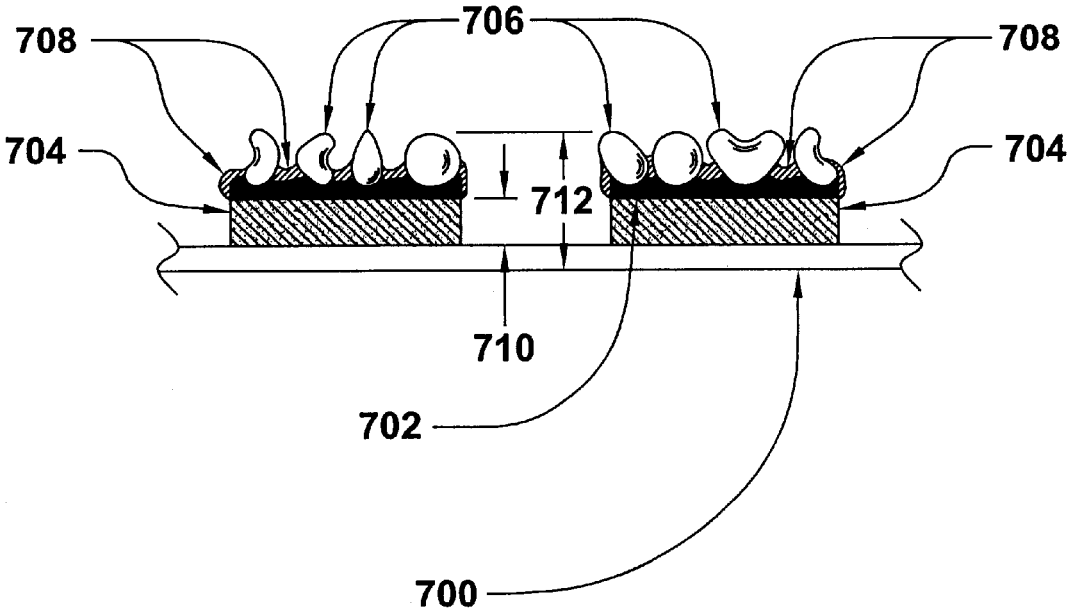
FIG. 27 shows a side view of raised islands having a surface layer of abrasive particles.

FIG. 27 shows a side view of raised islands having a top surface layer of abrasive particles. An abrasive article backing sheet 700 having integral raised island foundations 704 coated with a layer of abrasive resin 702 which bonds diamond or other abrasive particles 706 to the island foundations 704 which are attached to the backing 700. The make coat resin 702 encompasses only the lower portion of the particles 706 and the resin size coating 708 encompasses a higher portion of the particles 706 where the size coating 708 adds structural support to the particles 706 but nominally allows the top surface of the particles to be exposed for abrading action on a workpiece. The height of the island foundations 704 as measured from the top of the island foundations 704 to the proximal side of the backing 700 is shown by the distance 710. The thickness 712 of the abrasive sheet as measured from the top surface of the abrasive particles 706 to the distal support surface of the backing 700 is shown by the distance 712.

Printed Particle Coating of Island Tops

Problem: Avoiding particle coating of the valleys between raised island top surfaces reduces the use and recovery of expensive super-abrasive powder such as diamond or cubic boron nitride (CBN), as these particles would only reside on the island top surfaces. It is desired that small gap spacings exist between each abrasive particle for clearing of swarf and to allow individual abrasive particles to contact a work piece surface. Obtaining a single or monolayer of abrasive particles on the top surface of the precision height raised island surfaces with a variety of island shapes is important.

Solution: Accurately defined raised island surfaces on a abrasive sheet article can be coated with precisely separated individual abrasive particles by use of a printing plate which is in common use in the printing industry. This printing plate would have an array of microscopic dot patterns of silicone rubber which is attached to a metal backing sheet. Each microscopic dot of silicone rubber would have a surface diameter approximately equal to that of abrasive particles coated on the abrasive article; these particles would typically have a 30 micrometer diameter. The rubber micro dot areas can also be positioned some slight distance from adjacent micro dot areas which would result in gap openings between adjacent particles positioned on adjacent micro dot areas. Although not wanting to be bound by theory, it is believed that the presence of the exposed silicone rubber attracts and weakly bonds the abrasive particles to this silicone rubber microscopic dot areas. Abrasive particles are not weakly bonded to the open areas adjacent to the silicone rubber micro dot areas as the silicone rubber has been removed from these open areas, leaving the exposed metal of the printing plate backing. If the silicone rubber micro dot island shapes are approximately the same diameter, or somewhat smaller, than the diameter of an individual abrasive particle, only a single particle will reside on an individual microdot silicone rubber area. Use of a 25 micrometer diameter rubber microdot area with a 30 micrometer diameter particle would only allow the weak bond attachment of a single particle to a single micro dot area. After the powder transfer sheet is produced by digital control of light sources or by use of a optical exposure half-tone font sheet to light activate the array pattern of silicone rubber micro dots, the unexposed areas of silicone rubber are mechanically brushed off the plate leaving a bare metal of the metal backing sheet at the source light unexposed areas on the sheet. Following the manufacture of the circular silicone rubber plate having discrete rubber islands spaced evenly over the whole surface of the plate, the plate rubber surface is subjected to loose abrasive particles which become attached to each silicone rubber microdot site. Excess particles are then removed from the transfer plate. An abrasive article annular raised island band backing sheet disks prepared to receive the abrasive particles by having a thin uniform thickness adhesive resin coating applied to the top surface layer of each island foundation. Then the circular abrasive particle coated printing plate transfer sheet is used to transfer the abrasive particles with their individual precisely controlled locations and spacing to the resin coated island sheet by registering the printing sheet to be in concentric alignment with the backing sheet and pressing them together. The abrasive particles are wetted at their bases by the precision thickness resin adhesive coating on the islands which has a greater bonding affinity for the particles than does the weak bond of the silicone rubber which allows the two sheets to be separated with the particles remaining attached to the island tops. One option in separating the sheets is to effect a partial cure or solidification of the particle adhesive prior to separating the sheets to increase the bond strength of the resin on the particles but still allow separation of the two sheets without adhesive induced damage to the silicone rubber sites. Only part of the abrasive particles will have been removed from the rubber particle transfer plate as those particles not in contact with the wet resin coating on the island surfaces will remain attached to the rubber sheet after the abrasive island backing sheet has been separated. Each typical island site diameter would approximately 3 millimeter in diameter which is much larger than the typical 30 micrometer abrasive particle which results in many spaced abrasive particles attached to a single raised abrasive island. The printing plate can have the spaced micro dot pattern array of silicone rubber areas over the full surface (of a circular printing plate sheet ) which is larger than the diameter of a abrasive article backing having an annular area of raised island foundations to which the abrasive particles are to be transferred. Also, the rubber printing plate can have a annular area of microdots with the diameter and size of the annular area matching the annular area of the raised islands on the abrasive article disk which results in a annular area of particles that matches the annular area of the islands.

Another alternative technique is to create larger diameter silicone rubber microdot areas where two or four or ten, and up to fifty abrasive particles, are bonded to each individual microdot area. These particles are then transferred to the resin coated islands by pressing the two sheets together.

A number of different methods can be employed to create particle transfer printing plates. One method includes making square shaped transfer plates with continuous annular bands of rubber micro dot sites to allow transfer of particles to an annular band of islands but some of the excess abrasive particles will still remain attached to the rubber sheet upon separation of the two sheets. Another method is to create island shapes of micro dots of rubber where the abrasive particles can be directly applied to matching island shapes on the abrasive article backing with essentially all of the abrasive particles originally attached to the rubber sheet becoming transferred to the abrasive islands.

Abrasive particles can consist of individual particles or they may be agglomerates or spherical beads of very fine abrasive particles that are transferred from a rubber plate to a raised island-backing sheet. Further, a mixture of abrasive particles, along with other diluent particles, can be attracted to the surface of the silicone rubber and the metal particle transfer sheet can be used to transfer this mixture of particles from the silicone print sheet to the raised island sheet. Also, a silicone rubber or other plastic sheet material transfer sheet without precise island patterns could be uniformly coated with spaced particles and this transfer sheet pressed in contact with islands of many different shapes, or combinations of different shapes, such as a mixture of circular and chevron shaped islands, to transfer the particles. After separation of the transfer sheet, the silicone rubber can be cleaned and recoated with particles and used again.

The diamond particles may be of a blocky shape or may be needle-like in shape and the diamond particles may be surface coated with metal such as nickel, aluminum or copper; or coated with an inorganic film such as silica or an organic material, to aid in better bonding of the diamond to the make coat resin binder of phenolic, epoxy, polyimide, polyamide, or other resins.

Use of water, organic lubricants, detergents or a combination of these as a surface lubricant or cooling agent can aid in efficient lapping and attain superior flatness. The flow rate controlled excess cooling lubricant can carry the workpiece grinding swarf debris away from the work piece contact surface down within the valleys without the swarf reentering the grinding surface to create new scratches. Eliminating the application of abrasive particles in the island valleys improves the smoothness of the valley for ease of cooling lubricant flow and minimizes the possibility of valley blockage which reduces the capability of water to clear away swarf debris. Other undefined beneficial effects are considered to exist when water and other lubricant mists or streams are used in the lapping process which result in the promotion and creation of flat work piece surfaces.

Backing materials very suitable for use with the attached raised islands include an acrylic acid polymer or ethylene acrylic acid copolymer primed polyethylene terephthalate sheet material.

Figure 28A:
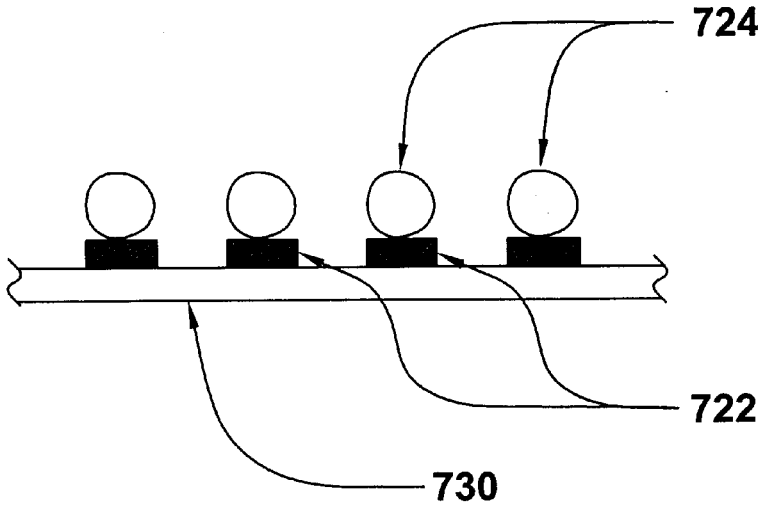
FIG. 28A shows a side view of a printing plate with microdot islands of silicone rubber.

FIG. 28A shows a side view of a silicone rubber covered printing plate with abrasive particles loosely attached to silicone rubber microdot islands. The metal backing 730 of the printing plate is coated with a thin layer of silicone rubber photo polymer which is exposed with a light source through a patterned font sheet to create individual microdot island areas 722 by brushing off the unexposed rubber areas. Individual abrasive particles 724 are attracted to and weakly bonded to the microdot island areas 722. Excess abrasive particles which exist in the exposed metal, backing 730 portions of the printing plate between the microdots 722 do not become bonded to the exposed metal and these excess particles are removed from the printing plate leaving only the particles 724 attached to the microdots 722.

Figure 28B:
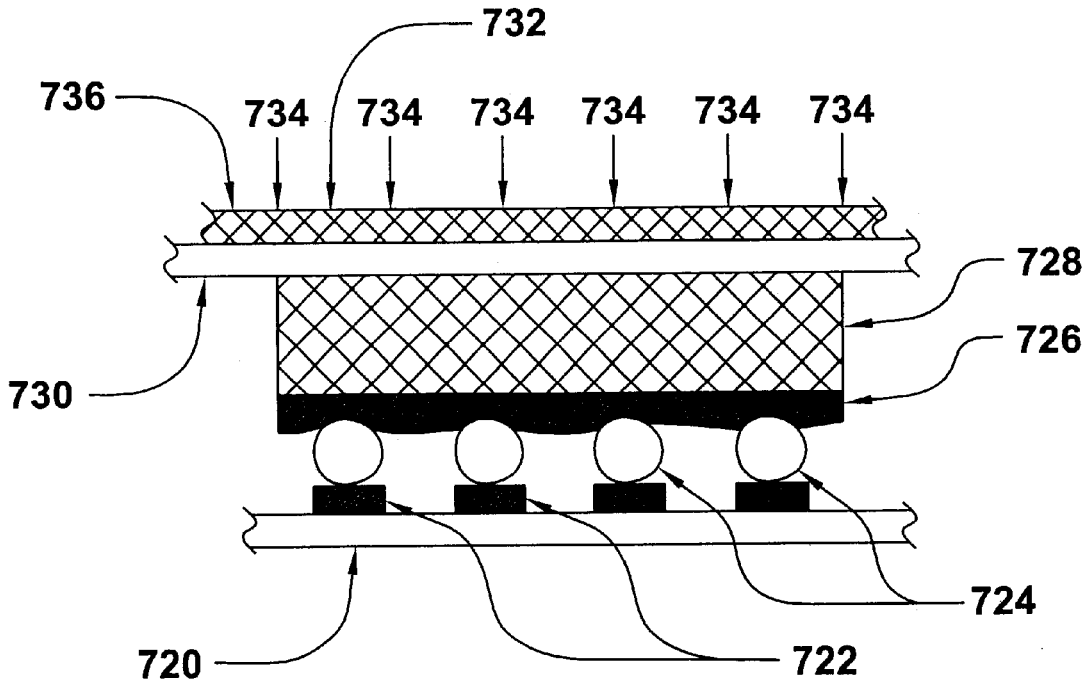
FIG. 28B shows a side view of a microdot island printing plate and a raised island backing with abrasive particles.

FIG. 28B shows a side view of a silicone rubber printing plate with abrasive particles which are in contact with a resin coated raised island abrasive sheet. The metal backing 720 of the printing plate has attached silicone rubber microdot islands 722 to which are weakly bonded abrasive particles 724. The particles 724 are shown in contact with and bonded to an adhesive resin make coat binder 726 which is coated onto the surface of a raised island foundation 728 which is integrally attached to an abrasive article flexible backing sheet 730 which is in contact with a backing plate 736 which is subjected to a uniform pressure force 734 where the pressure force 734 applies a pressure force on the abrasive particles 724 which indents the particles 724 somewhat into the wet liquid state resin 726. The silicone rubber coated metal printing plates can be obtained from the Toray Industries, Inc. company, Tokyo, Japan.

Continuous Web Raised Island Foundations

Problem: It is desired to form patterns of different shapes of raised island foundation structures and attach them to the surface of a continuous web where the island top surfaces can be coated with abrasive particles in another process operation.

Solution: Raised islands of a wide variety of shapes, including circular, bar and chevron shapes can be formed and integrally attached to a continuous flexible web sheet, where arrays of these islands can be formed in rectangular or annular ring patterns. These three dimensional island structures would be formed of a polymeric resin which is bonded to the surface of a flexible web sheet material. A set of two rolls can be pressed or nipped together where one roll has a pattern of island shaped cavities on its surface and the other roll has a rubber surface. The two rolls are positioned at the same horizontal level to create a fluid receptacle fluid containment volume by sealing the common open ends of the rolls and this volume is filled with a polymeric resin to form a resin bank. As the two rolls are rotated together, a continuous sheet web material is routed over the non-cavity roll to enter the roll nip area where it contacts the resin bank and also the surface of the island cavity roll. Resin fills each open island cavity and also wets one surface of the web as the web is transported through the nipped rolls which squeeze resin from most of the surface of the web but leave individual resin foundation shapes at the location of each island cavity. Vibration of different amplitudes over a frequency range of 50 cycles per second to the ultrasonic range of 20,000 or 25,000 cycles per second can be applied to the resin or the apparatus to enhance the filling and wetting of the island cavities with the island foundation resin. The web is held in conformal contact with the surface of the cavity roll after leaving the nip area. One or more energy sources including heat, ultraviolet light, electron beam, and others, are directed at the backside of the web, and through the typically clear web, in the zone just downstream of the roll nip to effect solidification of the resin island shapes. Upon solidification, the island shapes are now adhesively bonded to the web backing. After sufficient strength of the resin bond of each island to the backing is attained, the backing having the integral island shapes is peeled from the continuous rotating cavity surfaced roll. Separating the island structures from the cavities can be aided by the use of mold release agents and mold coatings or by the use of cavity mold materials which have good release characteristics. Different island cavity shapes can be produced on the surface of the cavity roll by machining, by electrical discharge machining, by embossing or by molding techniques. The cavity roll material may be metal or plastic such as Teflon, silicone rubber, polyurethane rubber, nylon, polycarbonate or others. The cavity roll may also have a surface of room temperature vulcanizing rubber into which island shaped cavities have been molded into the surface. The resin may be particle filled, mixed with fillers such as glass beads, glass fibers or other fibers, inorganics, or other materials. The rotating speed of the nipped rolls can be adjusted to match the strength of the energy source to complete island solidification prior to separating the web sheet from the cavity roll. Island cavities can be arranged in a pattern on the cavity roll where a annular ring of islands can be formed on the web sheet as the web is processed through the nip rolls. After solidification of the island structures, a circular disk encompassing this annular ring of islands can be cut from the continuous web backing which creates a technique of making circular raised island disks from continuous web material. Abrasive particles can be bonded to the top surface of the islands to produce a variety of abrasive articles. Examples include rectangular sheets or band strips of arrays of raised island backing which are cut or converted from the web to produce various abrasive articles including rectangular sheets, hand laps, daisy wheels and continuous belts.

Figure 29:
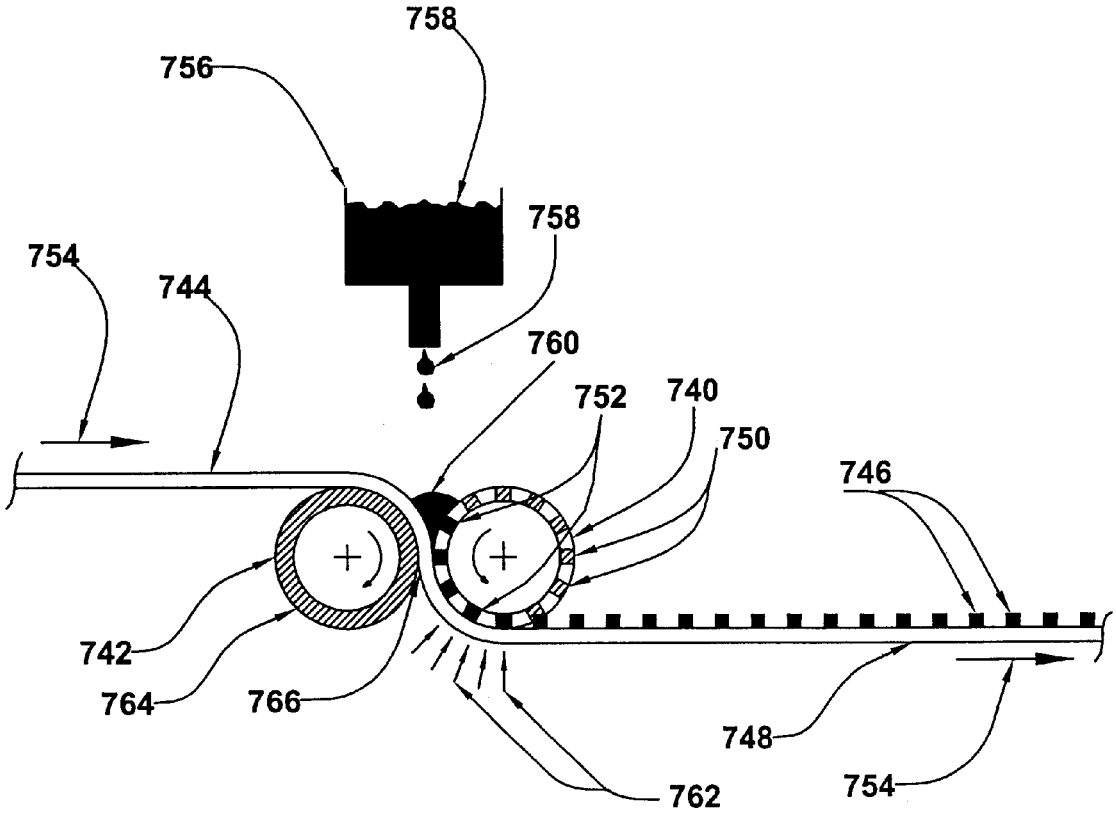
FIG. 29 shows a side view of raised island structures deposited by a nip roll system.

FIG. 29 shows a side view of a rubber 764 covered driven roll 742 having a nipped contact area 766 with a cavity roll 740 having unfilled island cavities 750 and resin filled cavities 752. Polymeric resin 758 in a resin container 756 falls to a resin bank 760 formed by the common upper area between the two rolls 740 and 742. Continuous sheet web 744 is routed between the rolls 740 and 742 in a direction 754. Web sheet 748 having integral raised island shapes 746 is separated from the cavity roll 740 after being subjected to a energy source zone 762 which solidifies the islands 746.

The invention may be further characterized and summarized as including at least an abrasive article having raised islands arranged in an array pattern that can be produced by attaching island foundations to a inexpensive flexible backing sheet, precisely grinding the height of each island, coating the top of the islands with a thin layer of precise thickness resin, applying a monolayer of abrasive particles to the resin, solidifying the resin and applying a size resin coat to the particles. The preferred shape of a raised island abrasive article is a circular backing disk having an outer annular band of islands which is an abrasive article configuration which lends itself to use of economical and effective batch manufacturing techniques completely different than the traditional continuous web abrasive maker system. Small and relatively simple pieces of production equipment readily purchased with a relatively low investment can be placed in a small workroom and a large size and style selection of precise high performance lapping disk articles can be produced by a semi-skilled operator. A variety of technical issues related to this batch abrasive disk manufacturing are presented along with numerous techniques to accomplish each step or phase of the production process. Ingredients used for many years in the abrasive industry such as sorted diamond particles, industry standard phenolic resins and polyethylene terephthalate backings can be readily obtained and used to manufacture these disks worldwide. In addition to batch manufacturing of these raised island disks, continuous web processes can also be used to make a variety of abrasive articles including disks, daisy spoke wheel disks, rectangular sheets and endless belts. A distinct advantage of these raised island articles is the capability to use them at high surface speeds that utilize the very rapid rate of material removal of diamond abrasives which occurs at high surface speeds of above 1,500 meters/minute or more. Monolayer abrasive coated raised island articles produce both smooth lapped surfaces and precision flatness because of the reduction of hydroplaning which tends to occur with flat coated abrasives. Printing plates and spin-coated sheets can be used to transfer coat resin coatings to island surfaces without resin coating island valleys. Abrasive particles can be drop coated, electrostatic coated or applied in fluidized beds to the resin coated island tops. A metal printing plate can be covered with a pattern of microdots of silicone rubber to transfer coat individual abrasive particles with controlled gap spaces between particles to the island tops. A method is described of molding island shapes on flexible backing disks with the use of a RTV silicone rubber mold plate which allows accurate island shapes to be reproduced without damage to the island foundations when the backing sheet is separated from the reusable rubber mold. Monolayer raised island abrasive articles can reduce abrasive media costs for high speed lapping; and also, can improve performance for low speed abrasive articles such as daisy wheel disks used for lens polishing.

Raised Island Web and Disk Casting

Problem

It is desired to form web backing sheets with raised island structures where the islands are an integral part of the backing sheet by using a production process that is fast and economical. Raised island structures which have a continuous integral material construction with the backing sheet eliminates the possibility of an island structure becoming separated from the backing during abrading action.

Solutions

A continuous web having raised island structures can be produced by extruding a thin layer of molten polymer onto a web casting chill roll having a pattern of island cavities recessed into its surface and separating the thin web layer of solidified polymer from the cooling roll. Each recessed island cavity would form an island structure on the web having a raised wall height equal to the depth of the recessed cavity. The overall thickness of the web backing would be controlled by accurate positioning of the polymer exit lip of the vertical extrusion die a small distance away from the surface of the casting chill roll. Both the raised island structure and the web backing would be formed from the same molten polymer material. A co-extrusion of two different polymers can also be made by using two extrusion dies positioned in series above the chill roll where one heated molten polymer is deposited in the casting wheel cavities and another polymer is applied downstream of the first die to form a web sheet where the island structures are thermally fused onto the web backing sheet. Alternatively, molten polymer island structures can be fused to an existing continuous web sheet by use of an extrusion die. Here the chill roll surface cavities can be filled with a molten polymer after which a web backing material may be brought into intimate contact with the chill roll, resulting in the islands becoming thermally fused integral with the backing sheet. The island foundation structure polymer may be filled with a variety of materials including metallic, inorganic or organic powders. In another configuration, a molten layer of polymer may be extruded into a web backing sheet material, a section of this hot polymer coated web cut into a length and a flat platen chill mold plate, having an island structure surface pattern, would be pressed into contact with the molten polymer to form raised island structures prior to solidification of the polymer by cooling. In another embodiment a solvent based polymer can be coated on a web backing sheet and an island embossing die pressed into contact with the fluid polymer prior to solidification of the polymer to form raised island shapes on the surface of the backing sheet.

Figure 30:
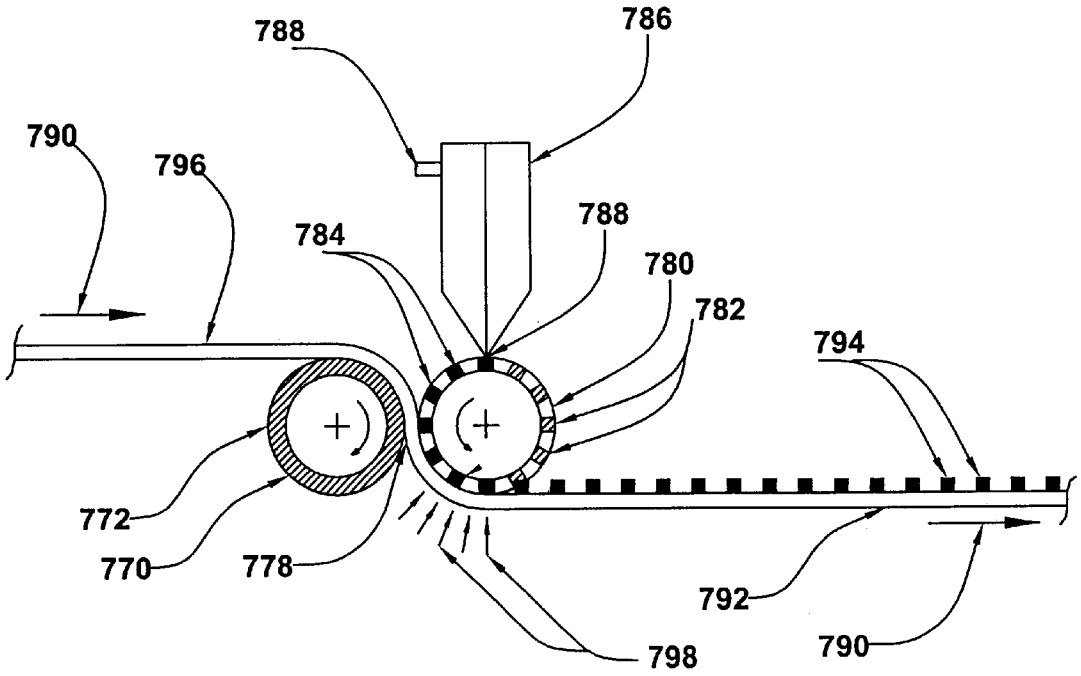
FIG. 30 shows a side view of an extrusion die applying raised polymer island structures to a web backing sheet.

FIG. 30 shows a side view of an extrusion die applying raised polymer island structures to a web backing sheet. A rubber 770 covered driven roll 772 has a nipped contact area 778 with a cavity chill roll 780 having unfilled island cavities 782 and molten polymer filled cavities 784. Continuous sheet web 796 is routed between the rolls 772 and 780 in a direction 790. Web sheet 792 having integral raised island shapes 794 is separated from the cavity roll 780 after being subjected to a an optional cooling source zone 798 which further solidifies the islands 794 and thermally fuses the islands 794 to the web backing sheet 792. Molten polymer enters an extrusion die 786 at the inlet 788 which extrudes the polymer in a line across the full width of the cavity chill roll 780 which is internally cooled by circulating cooling water. The exit lip 788 of the extrusion die 786 is accurately positioned approximately 50 micrometers of the island cavity chill roll 780.

What is claimed:

1. A flexible, continuous abrasive sheet disk comprising a flexible backing sheet with an annular band of spaced, shaped, raised abrasive island foundation structures where an inner annular band radius is greater than 30% of an outer annular band radius, the abrasive island foundation structures comprising islands of a first structural material having a raised island top surface and a raised island side wall or walls, the raised island top surface having at least a monolayer of abrasive particles supported in a polymeric resin, the height of all islands measured perpendicularly from the top surface of the raised island top surface to a proximal island structure where the side or sides intersect the backing is less than 1.5 mm, and a total thickness of the abrasive sheet at all island locations measured perpendicularly from the top surface of the at least monolayer of abrasive particles to a back-side surface of the backing sheet has a standard deviation in thickness of less than 80% of the average diameter of the abrasive particles.

2. The disk of claim 1 where the polymeric resin is applied to the raised island top surfaces by spin-coating an annular layer of resin onto a transfer sheet and the coated transfer sheet is pressed into conformation in contact areas with the nominally flat top surfaces of the array band of raised islands until the resin wets a top surface on each island, after which wetting the coated transfer sheet is removed, leaving at least 5% of the resin within the contact areas attached as a uniform layer on the island top surfaces.

3. The disk of claim 1 where the polymeric resin is applied to the raised island top surfaces by roll coating an annular layer of resin onto a transfer sheet and the coated transfer sheet is pressed into conformation in contact areas with the nominally flat top surfaces of the array band of raised islands until the resin wets a top surface on each island, after which wetting the coated transfer sheet is removed, leaving at least 5% of the resin within the contact areas attached as a uniform layer on the island top surfaces.

4. The disk of claim 1 where the polymeric resin is applied to the raised island top surfaces by coating an annular layer of resin on a printing plate and the coated printing plate is pressed into conformation in contact with the nominally flat top surfaces of the array band of raised islands until the resin wets a top surface on each island, after which wetting the coated web transfer sheet is removed, leaving at least 5% of the resin within areas of contact between the adhesive and the raised islands attached as a uniform layer on the island top surfaces.

5. The disk of claim 1 where the abrasive particles are applied to the raised island top surfaces by coating an annular band of individually spaced microdot island areas of silicone rubber attached to a metal backing printing plate, with each individual rubber microdot area containing less than 10 abrasive particles, and pressing the printing plate into pressurized contact with the island top surfaces to transfer the abrasive particles into the wet resin coating on the top of each raised abrasive island.

6. The disk of claim 5 where each individual rubber microdot area on the metal backed printing plate contains one abrasive particle.

7. The disk of claim 1 where the total abrasive sheet thickness measured perpendicularly from the top surface of the abrasives to the back-side support surface of the backing has a standard deviation in thickness of less than 30% of the average diameter of the abrasive particles.

8. The abrasive disk of claim 1 where the annular array of raised island structures is made up of circular cross-section shapes.

9. The abrasive disk of claim 1 where the annular band of raised abrasive island structures has a configuration selected from the group consisting of narrow serpentine shapes extending radially outward, chevron-bar shapes, and diamond shapes.

10. A thin flexible abrasive sheet disk with an annular band of raised abrasive top-surface coated island structures which are positioned with less than 0.5 cm gap spacing between the top edges of islands measured in a tangential direction, the islands positioned at least around the outer periphery of the disk, wherein the annular band of islands is made up of single island shapes that are arranged with varying gap spacing between individual islands with regard tangential spacing.

11. The disk of claim 1 where spacing gaps between islands varies among at least 10% of islands on a tangential path by at least 10% of average spacing between island edges on that tangential path.

12. The abrasive disk of claim 1 where the single island shape configuration is used but at least 10% of the island shapes are at least 10% of average surface area smaller in size than others.

13. A flexible, continuous abrasive sheet disk comprising a flexible backing sheet with an array of annular band of spaced, shaped, raised abrasive island foundation structures where an inner annular band radius is greater than 30% of an outer annular band radius, the abrasive island structures comprising islands of a first structural material having a raised island top surface and a raised island side wall or walls, the top surface having at least a monolayer of abrasive particles supported in a polymeric resin with a disk outer peripheral border area being free of the raised island array and with the array of islands extending to within 0.2 cm to 3.0 cm of the outer radius of the disk, leaving an outer annular border ring free of abrasive islands.

14. The abrasive disk of claim 1 where the islands have top surface widths measured in a tangential direction ranging from 0.5 mm to 12 mm.

15. The abrasive disk of claim 8 where the islands have top surface diameters ranging from 0.5 mm to 12 mm.

16. The disk of claim 1 where gaps measured in a tangential direction between top edges of the island surfaces of adjacent raised islands is between 0.2 mm to 4.0 mm.

17. The disk of claim 1 wherein a plateau height of a local group of from one to five islands measured perpendicular from the plateau formed by the one to five islands exposed abrasive surfaces to an area between the islands on an exposed proximal upper surface of the backing is from 0.1 mm to 2.0 mm.

18. The disk of claim 17 where the measured plateau height of the abrasive coated island local group is from 0.2 mm to 0.8 mm.

19. The flexible abrasive disk of claim 1 where the backing sheet is made of a metal, cloth, composite material, or polymeric material.

20. A process of making a flexible metal disk backing having non-abrasive particle coated raised island foundations continuous over its full diameter comprising:

a) chemically machining or chemically etching of raised islands onto the backing;

b) forming a disk backing with an annular ring distribution of islands having flat top surfaces, leaving an annular array of islands raised above the backing surface; or c) machining the top surface of each island to generate a island thickness measured perpendicular from the top surface of a raised island to the backside support surface of the backing to a standard deviation in thickness of less than 10 micrometers.

21. The process of claim 20 with process steps comprising:

a) coating the raised island side of the metal disk backing, including both the raised island surfaces and the exposed surface of the metal backing in areas between the islands with a non-electrical conducting coating of resin;

b) bare metal is exposed at the top surface of the islands by removing, with solvent or by other means, the resin prior to curing of the resin; or, the resin is cured, after which the top surface of the surfaces of the raised islands are machined or ground to expose the bare metal at the raised island surfaces; and c) abrasive particles are attached to the top surface of the bare metal islands by electroplating.

22. The process of claim 20 where the machined island top surfaces of each island are transfer coated with a layer of polymeric resin and depositing at least a monolayer of abrasive particles supported in the polymeric resin.

23. The disk of claim 1 wherein vertical edges of the raised island foundation structure walls are tapered at a positive angle of less than 20 degrees so that the top surface of islands are smaller than a base of the island at a location where an island base joins with the backing.

24. The disk of claim 1 wherein non-abrasive particle coated raised island foundation structures have a flat surface where disk thickness, measured perpendicularly from the top surface of an island to the backside of the support, has a standard deviation in thickness of less than 0.02 mm.

25. The disk of claim 1 where a continuous sheet web manufacturing process is used wherein top exposed surfaces of the island foundations are resin-coated by a web transfer coating process wherein a coated transfer web is pressed into areas of conformation with a nominally flat top surface of an array of raised islands until the resin wets a top surface on each island, after which wetting the coated web transfer sheet is removed, leaving at least 5% of the resin in the areas of conformation attached as a uniform layer on the island top surfaces.

26. The disk of claim 25 where the coated resin transfer sheet web is manufactured by printing press, knife coating, gravure coating, or roll coating.

27. The abrasive disk of claim 1 where an outer annular array of raised island shapes are top coated with a monolayer of abrasive particles or abrasive agglomerates at least 7 up to 400 micrometers in average particle diameter.

28. The abrasive disk of claim 1 where the annular band of islands has each island base foundation top surface coated with a layer of diamond or other hard abrasive particles that are have number average diameters smaller than 10 micrometers, and where the abrasive particles are stacked into a single coated layer that is from 10 to 20 micrometers thick.

29. The disk of claim 25 where the hard abrasive particles are attached to the island base foundation top flat surfaces by drop coating onto or electrostatically coating abrasive particles on a wetted resin coating surface, followed by a size coat coated over and surrounding the abrasive particles attached to the resin make coat.

30. The disk of claim 29 where the size coat is applied by a transfer coat process or a spin coat process or a spray coat process.

31. The disk of claim 29 wherein a supersize coat is applied by spin coating or by transfer sheet coating or a spin coat process or a spray coat process.

32. The abrasive disk of claim 1 where the raised island foundation structure material comprises a particle filled resin or a non-particle filled resin.

33. A process of making a island cavity flexible silicone rubber mold comprising:

a.) a metal master mold plate having a precision flat and smooth circular shape with a thickness of 3 cm or less;

b.) the master mold plate having through island pin holes of 10 mm or less, the pin holes arranged in an array pattern forming an annular ring with the inside diameter of the annular ring greater than 30% of the diameter of the circular master plate;

c.) circular island pins of the precise diameter of the master plate pin holes, the individual island shape pins inserted into the master mold plate pin holes with precise control of the height of the end of each pin protruding above the master mold plate surface, the height measured from the free exposed end of the pin to the proximal surface of the master plate, where the height is less than 10 mm with a standard deviation in height of each pin less than 0.5 mm;

d.) a mold dam annular ring member having a ring height of 2 cm or less mounted to the outer diameter of the master plate working surface to provide a liquid silicone rubber fluid dam at the outer edge of the master plate with a fluid dam height equal to the dam ring height comprising a fluid receptacle inner flat area of the mold plate encompassing the annular patterned array ring of the island pins;

e.) a room temperature cure two part catalyst activated liquid silicone rubber poured into the fluid receptacle open area of the master plate with the silicone rubber added in sufficient quantity to fill the central dammed area of the master mold plate with a thickness of silicone rubber equal to the height of the outer dam ring;

f.) after curing and solidifying, the silicone rubber forms a flexible island cavity mold plate, when the solid rubber mold plate is removed from the metal mold plate by separating the rubber from the raised island pins which project up into the rubber from the surface of the metal mold plate, forming a annular array of raised island cavities in the surface face of the rubber mold plate which has a flat and smooth cylindrical surface;

g.) the rubber island mold plate is positioned on a flat work surface with the rubber mold plate cavities surface, having open pin shaped island annular array of cavities exposed upward, the raised island shaped cavities are filled with a fluid island foundation structure resin filler material where each of the resin filled cavities are leveled to the flat surface of the rubber mold;

h.) an annular shaped flexible backing sheet is pressed into flat surface contact where each of the island resin foundation bases are in wetted adhesive contact with the backing sheets, the island foundation structure material resin is partially or fully solidified after which the backing sheet with the integrally bonded raised island foundations is separated from the silicone rubber island mold.

34. The process of 33 where the backing sheet having the integral raised attached island foundations is thickness machined by a cutting machine tool or grinder that removes material from the top surface of each island foundation structure to precisely control the height of each island foundation surface measured from the top surface of the structure perpendicular to the distal bottom support surface of the backing to a standard deviation in thickness of less than 30 micrometers, or where the raised island shapes are chevron-bar shapes or radial bar or diamond- configuration shapes with the raised island shapes attached to the metal mold plate by pins, welding or adhesively bonding the shapes to the metal mold plate, or wherein the exposed surface portion of each island shape pin is precisely machined to a flat end area surface and the exposed vertical wall portion of each pin machined to establish the protruded height of each pin measured from the pin raised surface area perpendicular to the proximal surface of the flat mold plate within a height standard deviation of less than 10 micrometers;or where vacuum may be applied to the mold assembly to remove air from the mixed liquid silicone rubber after the rubber has been poured onto the master mold plate island pin surface to encourage the liquid rubber to fully wet and capture all the mold details of the raised island pin members and the master mold plate surfaces, or where the island shapes have a positive wall mold release draft angle of 20 degrees or less where the upper surface area of a mold island is smaller than the distal base island surface area, where the island is attached to the backing; or where 60 to 25,000 cycles per second vibration is applied to the rubber mold assembly during the time when the flexible backing sheet is joined to the rubber cavity mold to encourage the liquid resin to fully wet and capture all the mold details of the raised island cavity shapes and to reduce entrained air within the island structure resin mixture; where 7 to 70 cm mercury vacuum is applied to the rubber mold assembly during the time when the flexible backing sheet is joined to the rubber cavity mold to encourage the liquid resin to fully wet and capture all the mold details of the raised island cavity shapes and to reduce entrained air within the island structure resin mixture.

35. A flexible, continuous abrasive sheet disk comprising a flexible backing sheet with an annular band of gap-spaced, shaped, raised abrasive island foundation structures with an inner radius and an outer radius where the inner annular, band radius is greater than 30% of the outer annular band radius, the abrasive island structures comprising islands of a first structural material having a raised island top surface and a raised island side wall or walls, the top surface having at least a monolayer of abrasive particles supported in a polymeric resin, where a resilient pad from 0.1 mm to 4 mm thickness is bonded to a backside of the raised island backing sheet to form a raised island disk with a resilient backing.

36. A flexible, continuous abrasive sheet disk comprising a flexible, backing sheet with an annular band of gap-spaced, shaped, resilient, raised abrasive island foundation structures, the annular band having an inner radius and an outer radius, where the inner annular band radius is great~r than 30% of the outer annular band radius, the abrasive island structures comprising islands of a first structural material having a raised island top surface and a raised island side wall or walls, where each raised island structure comprises a polymeric resin coated resilient island from 0.1 mm to 4 mm thickness which has a layer of abrasive particles supported in the resin.

37. A process where a continuous web backing has arrays of raised island shapes formed into patterns where the islands are attached to the backing, the process comprising:

a.) a cavity roll where open island cavity shapes are formed at the surface of the roll in array patterns;

b.) a smooth surfaced driven nip roll is pressed into contact along the length of the adjacent cavity roll to form a nip contact line area and the ends of both the cavity roll and nip roll are sealed to form a open pocket at the top common surface of both the nip and cavity rolls which have the same horizontal elevation;

c.) a flexible web material of less width than the cavity roll and nip roll is routed over the top surface of the nip roll into the nip area where the nip roll is pressed in axial contact with the cavity roll and the web exits the nip area as the web is routed along the bottom surface of the cavity roll in conformal contact with the cavity roll as the nip roll and cavity roll are mutually rotated together;

d.) polymeric resin is introduced to the open pocket area formed at the top surface of the nip roll and the cavity roll to create a fluid resin bank volume where resin contacts one surface of the web and resin also fills the open mold cavities which enter the resin bank as the cavity roll is rotated;

e.) nip pressure between the nip roll and the cavity roll squeeze resin off the smooth surface of the web in the areas between the island cavities as the nip roll and cavity roll rotate when pressed in nipped contact;

f.) web having three dimensional volumes of resin at each island cavity site is transferred by the rotating nip roll and cavity roll to a energy source zone downstream of the roll nip area where energy including heat is applied to the web to effect solidification of the resin contained in each island cavity and to bond the array of island shaped structures to the web surface while the web is held in conformal contact with the cavity roll surface;

g.) the web having integral raised island structures is separated from the cavity roll.

38. A process for forming a continuous web having arrays of raised island shapes on a surface of the backing comprising:

a.) depositing hardenable composition in a cavity chill cooling roll into open island cavity shapes formed in the surface of the roll as the cavity roll is rotated;

b.) pressing a smooth surfaced driven nip roll into contact with the cavity chill roll to form a nip contact line area;

c.) feeding a flexible web material of less width than the cavity chill roll and nip roll routed over a top surface of the nip roll into the nip area so that the nip roll is pressed into axial contact with the cavity roll and d.) compressing the web with nip pressure between the nip roll and the cavity roll, compressing the surface of the web backing into direct intimate contact with the molten resin contained in the island cavities on the surface of the chill roll as the nip roll and cavity roll rotate when pressed in nipped contact;

d) withdrawing the flexible web from the nip area with material from the cavities in the chill roll deposited on the web;

e.) the web having solidified integral raised island structures.

39. The process of claim 38 wherein the hardenable material is molten and is extruded into cavities on the chill roll.

* * * * *